US011939752B2

(12) United States Patent
Wong

(10) Patent No.: US 11,939,752 B2
(45) Date of Patent: Mar. 26, 2024

(54) SPLASH GUARD

(71) Applicant: Yiu F. Wong, North Andover, MA (US)

(72) Inventor: Yiu F. Wong, North Andover, MA (US)

( * ) Notice: Subject to any disclaimer, the term of this patent is extended or adjusted under 35 U.S.C. 154(b) by 0 days.

(21) Appl. No.: 17/621,093

(22) PCT Filed: Jul. 5, 2020

(86) PCT No.: PCT/US2020/040847
§ 371 (c)(1),
(2) Date: Dec. 20, 2021

(87) PCT Pub. No.: WO2021/007139
PCT Pub. Date: Jan. 14, 2021

(65) Prior Publication Data

US 2022/0275612 A1 Sep. 1, 2022

Related U.S. Application Data

(60) Provisional application No. 62/871,035, filed on Jul. 5, 2019.

(51) Int. Cl.
*E03C 1/186* (2019.01)

(52) U.S. Cl.
CPC ..... *E03C 1/186* (2013.01)

(58) Field of Classification Search
CPC ..... B32B 2307/7265; B23B 3/266; B23B 2571/00; E03C 1/181; E03C 1/186; A47K 1/06; A47K 3/001
See application file for complete search history.

(56) References Cited

U.S. PATENT DOCUMENTS 1,408,812 A * 3/1922 Leighton ..... E03C 1/181 68/237
2,635,253 A * 4/1953 Kirvay ..... E03C 1/186 4/658

(Continued)

FOREIGN PATENT DOCUMENTS

JP 6429182 B2 11/2018

OTHER PUBLICATIONS

Copenheaver, Blaine R., International Search Report and Written Opinion for parent PCT App. No. PCT/US2020/040847, dated Sep. 14, 2020, 9 pgs., USPTO, Alexandria, VA, USA.

*Primary Examiner* — Erin Deery
(74) *Attorney, Agent, or Firm* — John J. Brooks, III; John Brooks Law LLC

(57) ABSTRACT

A splash guard is disclosed comprising a guard sheet having an opening and a slit extending from one edge of the guard sheet to the opening. In some embodiments, the splash guard further comprises a raised edge on one or more edges of the guard sheet. In some embodiments, the splash guard further comprises one or more raised edges forming a slit channel to receive one edge of the slit and make a water-resistant seal. In some embodiments, the opening is on the guard sheet and the opening further comprises a raised edge forming a collar. In some embodiments, the guard sheet includes a flexible collar to be frictionally coupled to a neck of a faucet and the flexible collar is frictionally coupled to the flexible collar whereby the guard sheet is secured to the flexible collar and the neck of the faucet.

20 Claims, 69 Drawing Sheets

(56) References Cited

U.S. PATENT DOCUMENTS

| | | | | |
|---|---|---|---|---|
| 2,762,062 | A | 9/1956 | Barton | |
| 4,722,103 | A | 2/1988 | Kliebert | |
| 8,214,939 | B2 * | 7/2012 | Spurlock | E03C 1/181 4/654 |
| 9,179,804 | B2 * | 11/2015 | May | A47K 10/02 |
| 10,058,218 | B2 | 8/2018 | Purvis | |
| 10,376,105 | B2 * | 8/2019 | Opasik | A47K 3/001 |
| 2003/0017300 | A1 * | 1/2003 | Clay | B32B 5/26 428/131 |
| 2019/0014953 | A1 | 1/2019 | Shields | |
| 2020/0039177 | A1 * | 2/2020 | Reddy | B32B 3/266 |

* cited by examiner

SPLASH GUARD

CROSS-REFERENCE TO RELATED APPLICATIONS

This application claims benefit to U.S. Pat. App. No. 62/871,035, filed Jul. 5, 2019 and entitled "SPLASH GUARD", the entire contents of which are herein incorporated by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

1. Field of the Invention

This invention relates to fluid diversion devices, in particular a splash guard for controlling the diversion of material such as water that may splash or drip around the faucet of a sink.

2. Description of the Prior Art

U.S. Pat. No. 2,762,062, filed Jun. 18, 1951 to G. G. Barton for a "Protective Cover for Surfaces at Sinks", which is herein incorporated by reference in its entirety, discloses a cover that is mounted to the wall and countertop with screws and glue to drain splashes and drips into the sink. This device is not mounted to the faucet.

U.S. Publication No. US 2019/0014953, for application Ser. No. 15/646,247, filed Jul. 11, 2017 to Thyria Shields for a "Device for Redirecting Water Underneath a Shower Chair", which is herein incorporated by reference in its entirety, discloses a device to redirect the flow of water coming through and going underneath a shower chair. This device is not used with a sink and is not mounted on the faucet.

U.S. Pat. No. D662,417, filed Nov. 11, 2009, to Julie Reinhold for a "Combinations cup holder and Drip Catcher for Liquid Detergent Dispensers and Liquid Fabric Softener Dispensers", which is herein incorporated by reference in its entirety, discloses a design for a tray to hold a cup and catch drips from detergent and fabric softener dispensers. This device is not used with a sink and is not mounted on the sink faucet.

BRIEF SUMMARY OF THE INVENTION

The following summary is included only to introduce some concepts discussed in the Detailed Description below. This summary is not comprehensive and is not intended to delineate the scope of protectable subject matter, which is set forth by the claims presented at the end.

In an example embodiment, a splash guard is provided comprising a guard sheet having an opening and a slit extending from one edge of the guard sheet to the opening. In some embodiments, the splash guard of further comprises a raised edge on one or more edges of the guard sheet. In some embodiments, the splash guard further comprises a raised edge forming a slit channel to receive one edge of the slit and make a water-resistant seal. In some embodiments, the opening is on the guard sheet and the opening further comprises a raised edge forming a collar.

In an example embodiment, a splash guard is provided comprising: a flexible guard sheet having an upper portion, a lower portion and a middle portion; the middle portion having a through hole defining an opening; and the upper portion comprising a slit extending from a proximal end of the flexible guard sheet to the opening whereby the upper portion of the flexible guard sheet may be deformed to receive an object through the slit. In some embodiments, the lower portion further comprises a ridge extending from a distal end of the lower portion to the opening, and the ridge defining a raised portion on a top side surface of the flexible guard sheet whereby a fluid retained on the top side surface of the flexible guard sheet will be urged to flow away from the ridge by a force of gravity. In some embodiment, the slit comprises a through-seam extending from the top side surface of the flexible guard sheet to a bottom side surface of the flexible guard sheet, and a raised edge extends over the slit on the top side surface of the flexible guard sheet whereby a fluid retained on the top side surface of the flexible guard sheet will be urged to flow away from the slit by a force of gravity. In some embodiments, the raised edge forms a slit channel to receive one edge of the slit and make a water-resistant seal with the slit. In some embodiments, the splash guard further comprises a raised edge on one or more edges of the flexible guard sheet whereby a fluid retained on the top side surface of the flexible guard sheet will be urged to be retained on the top side surface by the force of gravity. In some embodiments, the opening further comprises a raised edge forming a collar extending on the top side surface of the flexible guard sheet whereby a fluid retained on the top side surface of the flexible guard sheet will be urged away from the object by the force of gravity. In some embodiments, the collar further comprises a notch whereby a sensor on the object will not be covered by the collar when the splash guard is secured to the object. In some embodiments, the object is a neck of a faucet, the opening frictionally secures the flexible guard sheet to the neck, and the sensor is a motion sensor on the neck. In some embodiments, the splash guard further comprises a flexible collar having a collar slit along a length whereby the flexible collar may be deformed to receive the object through the collar slit and frictionally couple the flexible collar to the object, and the opening configured to receive the object and the flexible collar through the slit to couple the flexible guard sheet to the flexible collar. In some embodiments, the flexible collar further comprises one or more protrusions extending from a surface of the flexible collar whereby the one or more protrusions engage a bottom side surface of the flexible guard sheet and support the flexible guard sheet on the object, and the length of the flexible collar configured to define a raised edge on a top end of the flexible collar extending beyond a top side surface of the flexible guard sheet whereby a fluid retained on the top side surface of the flexible guard sheet will be urged away from the object by a force of gravity. In some embodiments, the lower portion further comprises a ridge extending from a distal end of the lower portion to the opening, and the ridge defining a raised portion in a top side surface of the flexible guard sheet whereby a fluid retained on the top side surface of the flexible guard sheet will be urged to flow away from the ridge by a force of gravity. In some embodiments, a cross-sectional profile of the ridge consists of one cross-sectional profile selected from the group of: an arcuate profile, a rectangular profile; and a v-shaped profile. In some embodiments, the slit comprises a through-seam extending from the top side surface of the flexible guard sheet to the bottom side surface of the flexible guard sheet, and a raised edge extends over the slit on the top side surface of the flexible guard sheet whereby a fluid retained on the top side surface of the flexible guard sheet will be urged to flow away from the slit by a force of gravity.

In an example embodiment, a splash guard for use around a neck of a faucet is provided, the splash guard comprising, a flexible guard sheet, the flexible guard sheet comprising a substantially elastic material, the flexible guard sheet having a substantially planar shape with a substantially even thickness and an undulating side profile, the flexible guard sheet having an upper portion, a lower portion and a middle portion, the upper portion having a slit through the thickness of the flexible guard sheet and extending from a upper end of the flexible guard sheet to the opening whereby the upper portion of the flexible guard sheet may be deformed to receive an object through the slit, the middle section having a through hole defining an opening to receive and frictionally engage the object when positioned in the opening, the lower portion further comprises a ridge extending from a distal end of the lower portion to the opening, the ridge defining a raised portion in a top side surface of the flexible guard sheet whereby a fluid retained on the top side surface of the flexible guard sheet will be urged to flow away from the ridge by a force of gravity, and the ridge further defining an elastically deformable section of the flexible guard sheet whereby: the slit may be expanded to allow the object to pass through the slit and engage the opening, the elastically deformable section of the flexible guard sheet urges the slit to close, and the elastically deformable section urges the opening to frictional engage the object and secure the flexible guard sheet to the object. In some embodiments, a cross-sectional profile of the ridge consists of one of the group selected from: an arcuate profile, a rectangular profile, and a v-shaped profile. In some embodiments, the splash guard further comprises one or more raised edge forming a slit channel to receive one edge of the slit and make a water-resistant seal with the slit. In some embodiments, the splash guard further comprises a raised edge on one or more edges of the flexible guard sheet whereby a fluid retained on the top side surface of the flexible guard sheet will be urged to be retained on the top side surface by a force of gravity. In some embodiments, the undulating side profile is a single-curve "J" shaped side profile. In some embodiments, a drip end edge of the flexible guard sheet further comprises a notch.

Other objects, features, and advantages of the techniques disclosed in this specification will become more apparent from the following detailed description of embodiments in conjunction with the accompanying drawings.

BRIEF DESCRIPTION OF THE SEVERAL VIEWS OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 17C shows a rectangular shaped ridge and FIG. 17D shows a v-shaped ridge;

FIG. 18C shows a rectangular ridge and FIG. 18D shows a v-shaped shaped ridge;

FIG. 23B showing a bottom perspective view thereof; FIG. 23C showing a front view thereof; FIG. 23D showing a back view thereof; FIG. 23E showing a top plan view thereof; FIG. 23F showing a bottom plan view thereof; FIG. 23G showing a left view thereof; and FIG. 23H showing a right view thereof;

FIG. 24B showing a bottom perspective view thereof; FIG. 24C showing a front view thereof; FIG. 24D showing a back view thereof; FIG. 24E showing a top plan view thereof; FIG. 24F showing a bottom plan view thereof; FIG. 24G showing a left view thereof; and FIG. 24H showing a right view thereof;

FIG. 25B showing a bottom perspective view thereof; FIG. 25C showing a front view thereof; FIG. 25D showing a back view thereof; FIG. 25E showing a top plan view thereof; FIG. 25F showing a bottom plan view thereof; FIG. 25G showing a left view thereof; and FIG. 25H showing a right view thereof;

FIG. 26B showing a bottom perspective view thereof; FIG. 26C showing a front view thereof; FIG. 26D showing a back view thereof; FIG. 26E showing a top plan view thereof; FIG. 26F showing a bottom plan view thereof; FIG. 26G showing a left view thereof; and FIG. 26H showing a right view thereof;

FIG. 27B showing a bottom perspective view thereof; FIG. 27C showing a front view thereof; FIG. 27D showing a back view thereof; FIG. 27E showing a top plan view thereof; FIG. 27F showing a bottom plan view thereof; FIG. 27G showing a left view thereof; and FIG. 27H showing a right view thereof;

FIG. 29B showing a bottom perspective view thereof; FIG. 29C showing a front view thereof; FIG. 29D showing a back view thereof; FIG. 29E showing a top plan view thereof; FIG. 29F showing a bottom plan view thereof; FIG. 29G showing a left view thereof; and FIG. 29H showing a right view thereof;

FIG. 30B showing a bottom perspective view thereof; FIG. 30C showing a front view thereof; FIG. 30D showing a back view thereof; FIG. 30E showing a top plan view thereof; FIG. 30F showing a bottom plan view thereof; FIG. 30G showing a left view thereof; and FIG. 30H showing a right view thereof;

FIG. 31B showing a bottom perspective view thereof; FIG. 31C showing a front view thereof; FIG. 31D showing a back view thereof; FIG. 31E showing a top plan view thereof; FIG. 31F showing a bottom plan view thereof; FIG. 31G showing a left view thereof; and FIG. 31H showing a right view thereof;

FIG. 32B showing a bottom perspective view thereof; FIG. 32C showing a front view thereof; FIG. 32D showing a back view thereof; FIG. 32E showing a top plan view thereof; FIG. 32F showing a bottom plan view thereof; FIG. 32G showing a left view thereof; and FIG. 32H showing a right view thereof;

FIG. 33B showing a bottom perspective view thereof; FIG. 33C showing a front view thereof; FIG. 33D showing a back view thereof; FIG. 33E showing a top plan view thereof; FIG. 33F showing a bottom plan view thereof; FIG. 33G showing a left view thereof; and FIG. 33H showing a right view thereof;

DETAILED DESCRIPTION OF THE INVENTION

Figure 1:
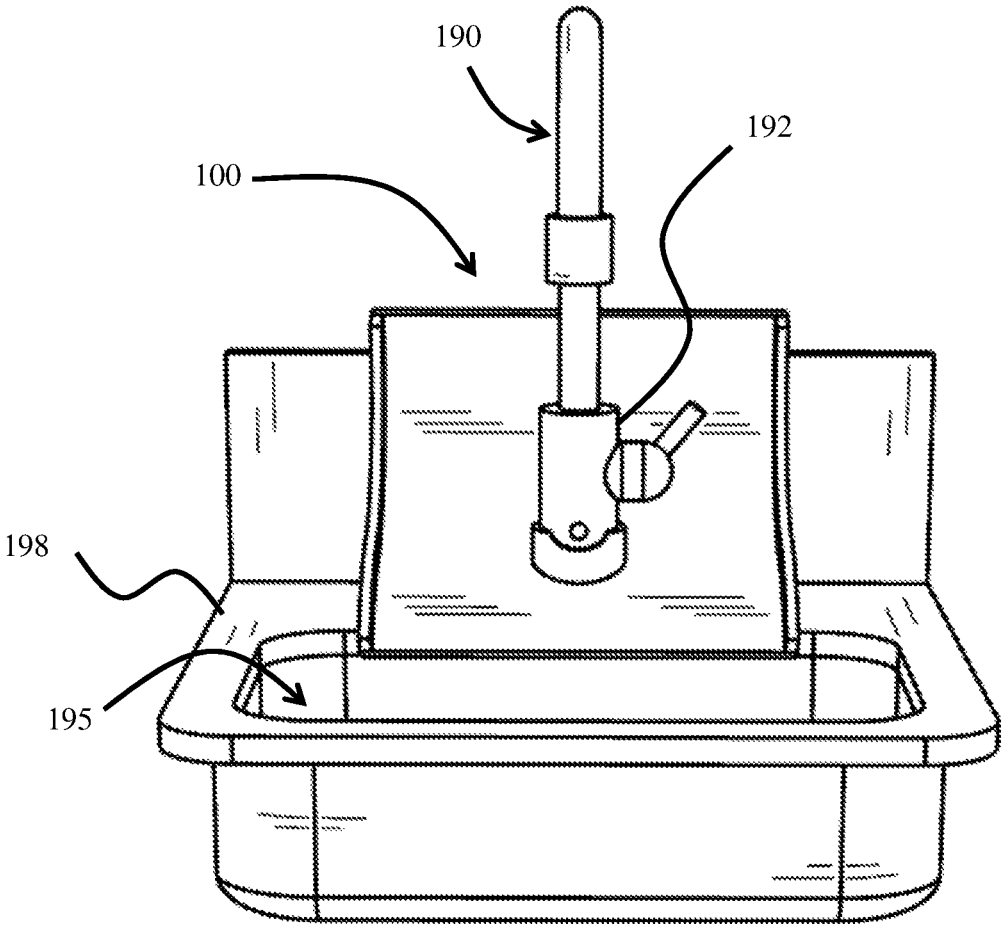
FIG. 1 shows a top perspective view of one example embodiment of a splash guard coupled to the neck of a faucet.

COPYRIGHT NOTICE: A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. The following notice applies to any software and data as described below and in the drawings hereto: Copyright © Yiu F. Wong, 2019-2020, All Rights Reserved.

Splash guards and methods of their use will now be described in detail with reference to the accompanying drawings. It will be appreciated that, while the following description focuses on a device that protects a sink and countertop from water drips and splashes from use of the faucet, the device disclosed herein has wide applicability. For example, the splash guard described herein may be readily employed with liquid chemical dispensers, beverage dispensers. liquid spray hoses and liquid spray nozzles. Notwithstanding the specific example embodiments set forth below, all such variations and modifications that would be envisioned by one of ordinary skill in the art are intended to fall within the scope of this disclosure.

One Example Embodiment of a Splash Guard:

The splash guard generally comprises a planar surface configured to be coupled to the neck of a faucet and shaped to divert water from around the faucet, from the hands of the user, from dish washing or from cleaning articles into the sink and not onto the countertop.

For illustration purposes and not for limitation, one example embodiment of the splash guard is shown in FIG. 1. As shown, the splash guard 100 generally comprises a planar surface or guard sheet configured to be coupled to the neck 192 of a faucet 190 whereby the lower end of the splash guard 100 extends over the edge of a countertop 198 so that any water splashed around the faucet is diverted into the bowl of the sink 195. As shown, the planar surface may have an undulating shape.

Figure 2A:
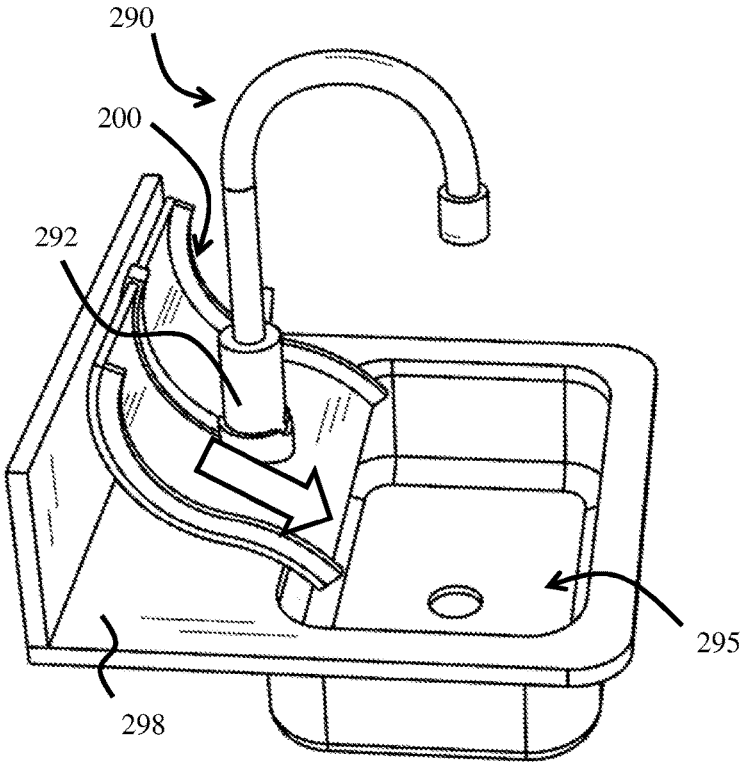
FIGS. 2A-2E show additional perspective, top and side views of the example embodiment shown in FIG. 1.
Figure 2B:
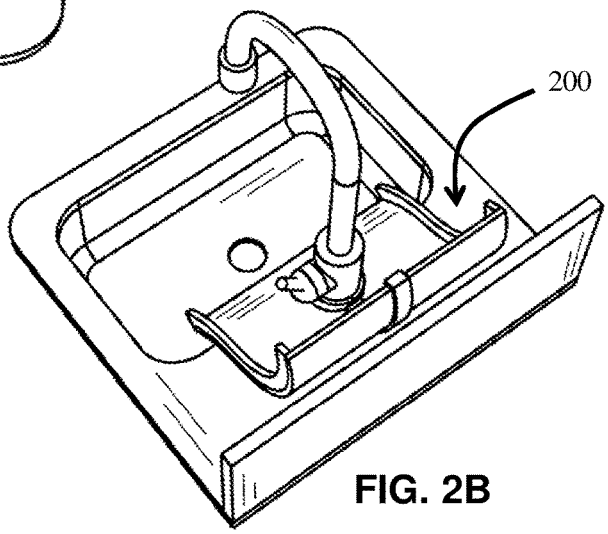
Figure 2C:
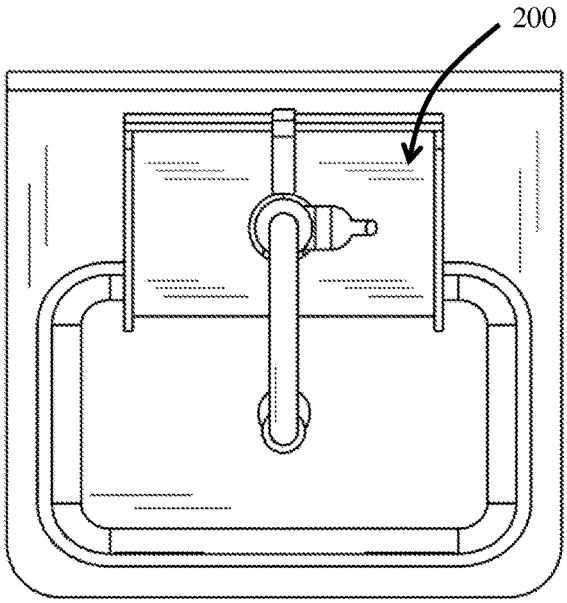
Figure 2D:
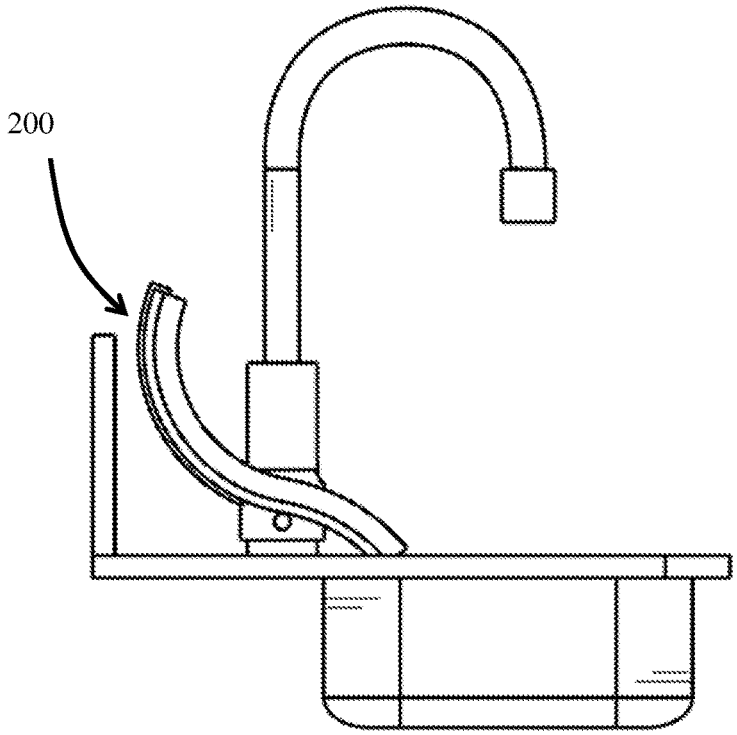
Figure 2E:
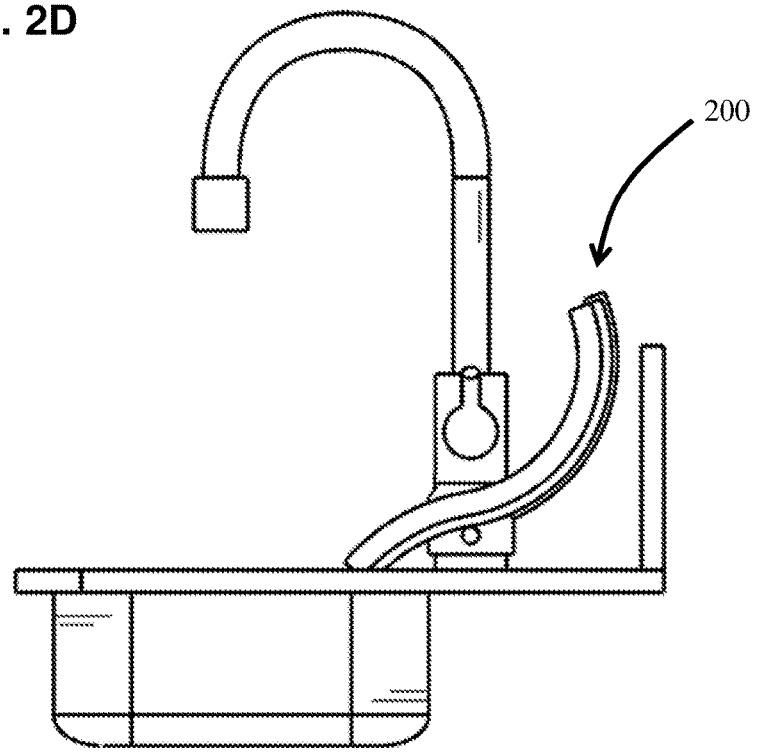

FIGS. 2A and 2B show additional perspective views of the splash guard 200 coupled to the neck of the faucet at a position above the counter and below the faucet handle. FIG. 2A shows a side, top perspective view of the splash guard 200 coupled to the neck 292 of the faucet 290. As shown, the splash guard 200 is configured and coupled so that water is diverted from the surface of the splash guard over the counter 298 and into the sink bowl 295 generally in the direction shown by the arrow. FIG. 2B shows a rear, top perspective view of the splash guard 200 of FIG. 2A and FIG. 2C shows a top view. FIG. 2D shows a left side view and FIG. 2E shows right side view.

Figure 3A:
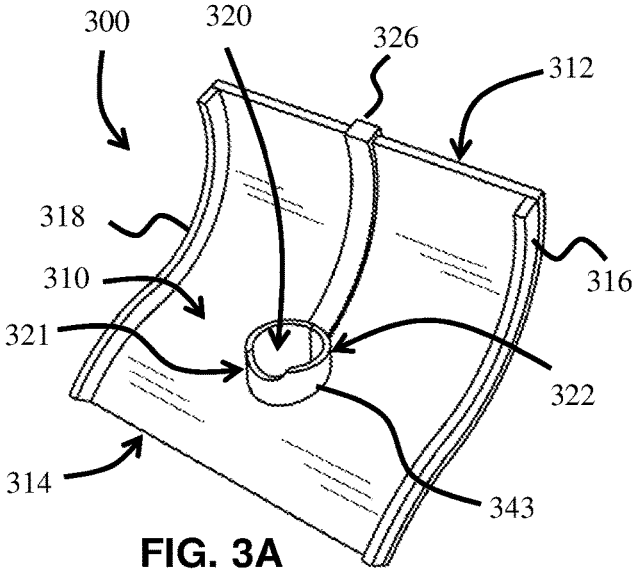
FIG. 3A shows a top perspective view of an example embodiment of a splash guard.

As shown in the example embodiment of FIG. 3A, the splash guard 300 comprises a guard sheet 310 having a middle portion having an opening 320 and a slit (beneath the raised edges 326) extending though the guard sheet 310 and extending from one edge of the guard sheet to the opening 320. The guard sheet 310 is generally configured with an upper portion having an upper end 312 and lower portion having a drip end 314 whereby the drip end 314 is configured to be the lower end of the guard and configured to extend over the countertop and over the bowl of the sink. The guard sheet 310 generally has a smooth, non-permeable surface configured to repel water and redirect the water toward the sink. The width (see FIG. 3D) of the splash guard 300 may be any reasonable width along the back of the sink to cover more countertop area if needed. Similarly, the length (see FIG. 3D) of the splash guard 300 may be any reasonable length to cover more countertop area if needed and to ensure fluids fall off of the drip end into the sink. For example only, and not for limitation, in one example embodiment, the width may have a range of about 5 to 22 inches and the length may have a range of about 5 to 15 inches. For example only, and not for limitation, in a preferred embodiment, the width is about 11 inches and the length is about 7.8 inches.

The slit (beneath the raised edges 326) is generally configured to run from one edge, here the top end 312, of the splash guard 300 to the opening 320. The slit (beneath the raised edges 326) is used as a channel to allow the faucet neck to slide through the splash guard 300 to the opening 320.

The opening 320 generally comprises a through-hole in the guard sheet that is configured to couple the guard sheet around the faucet neck. The edges of the opening are configured to frictional engage the surface of the faucet neck and also minimize the amount of water that may spill over between the guard sheet and the faucet neck.

As shown, the guard sheet 310 may also have raised edges around some sections to keep water on the guard sheet 310. For example, the guard sheet 310 may have raised edges 316 and 318 on either side edge of the guard sheet 310 to keep water on the sheet rather than spill over the side edges of the sheet. The guard sheet 310 may also have raised edges 326 on either side of the slit (beneath the raised edges 326) to keep water on the sheet rather than spill over and through the slit. The guard sheet 310 may also have a raised edge 322 around the opening 320 forming a collar 343. The raised edge 322 may also have a notch 321 to distribute forces when the collar 343 is deformed in the mounting process or to prevent blocking items like a motion sensor on a faucet. The raised edges 322 may be any type of wall or other raised area that helps urge a fluid to stay on one side of the raised edge 322. In some embodiments, the opening 320 may also have a notch to remove any part of the collar that may otherwise block a motion sensor if the faucet is so equipped. The notch 321 may be positioned on the collar to accommodate faucets with the motion sensor on the front of the faucet neck as well as positioned on the collar to accommodate a motion sensor on the side of the faucet neck.

Figure 3B:
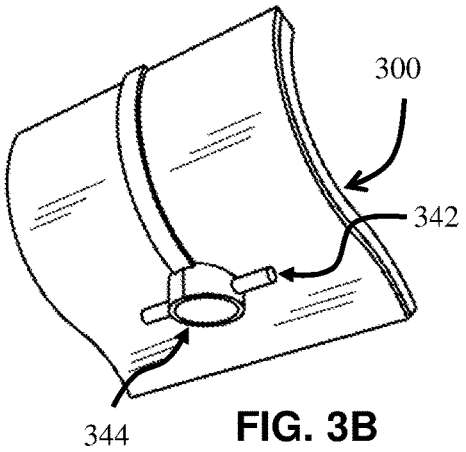
FIG. 3B shows a bottom perspective view of an example embodiment of a splash guard.
Figure 3C:
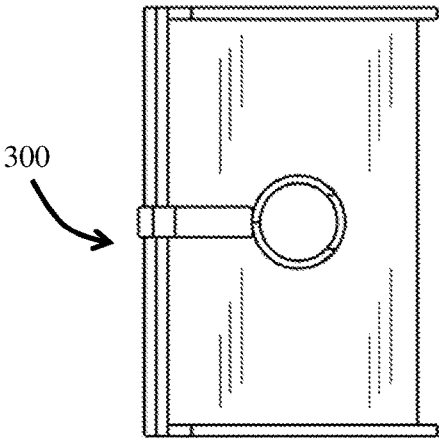
FIG. 3C shows a top view of an example embodiment of a splash guard.
Figure 3D:
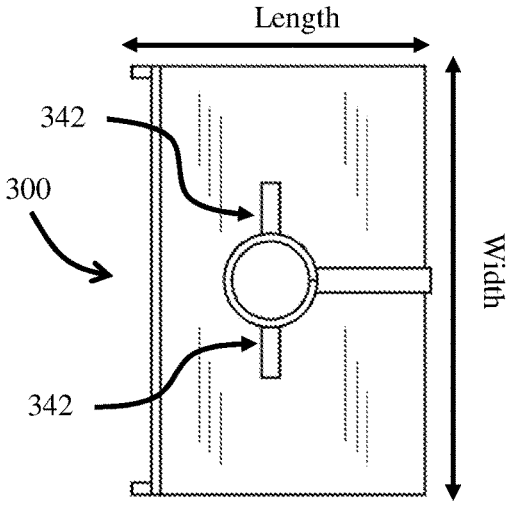
FIG. 3D shows a bottom view of an example embodiment of a splash guard.

Shown in FIGS. 3B and 3D is the bottom side view of an example embodiment of a splash guard with a lower edge 344 and one or more protrusions 342 extending from the surface of the lower edge 344. In some embodiments, the protrusions 342 may be shaped to act as guide pins to help position and secure the guard sheet to the object. In some embodiments, the protrusions may extend from other portions of the collar, such as the raised edge of the collar.

In some embodiments, the risk of water passing through the slit may be addressed by having a slot, or slit channel configured to couple both sides of the slit, cover the slit and reduce water passing through. Referring to FIGS. 10A-10G, the example embodiment shows a splash guard 1000 having a guard sheet 1010, a slit 1025 and raised edges 1026 on one side of the slit 1025 forming a slit channel whereby the other edge of the slit 1025 fits within the slit channel and forms a water resistant or water tight seal when the slit is closed (see FIG. 10G). FIG. 10D shows a rear perspective view of two raised edges 1026 forming a slit channel to receive the edge of the slit 1025 to form a seal. FIGS. 10B and 10C show additional views of the slit channel. FIG. 10E show a view of the slit channel with the collar removed as the slit 1025 is being closed. FIG. 10F shows a view of the slit 1025 being closed around the collar 1043 as the collar 1043 is still open and in the process of being closed. FIG. 10G shows another view with collar inside when split is closed.

Figure 10A:
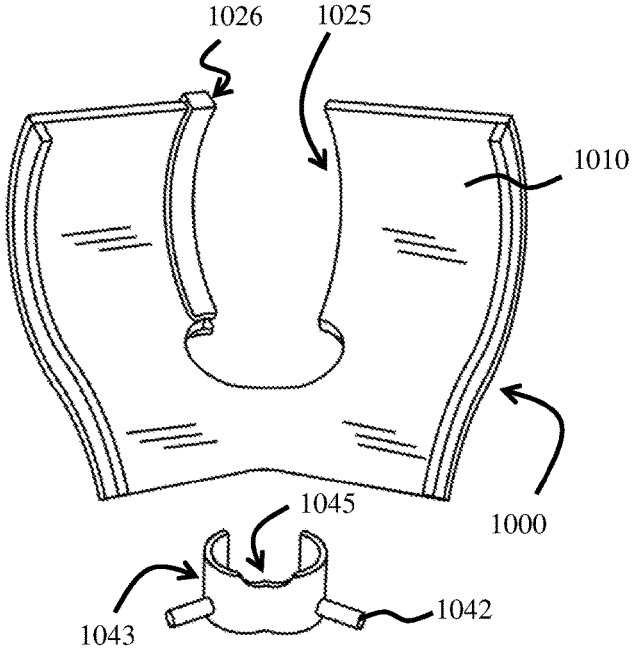
FIGS. 10A-10G show different views of an example embodiment of a splash guard that may be used with a separate collar.
Figure 10B:
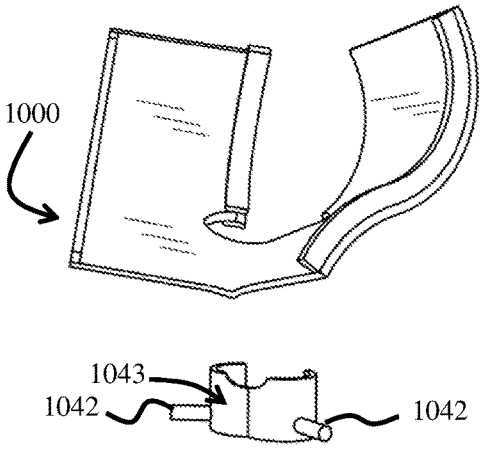
Figure 10D:
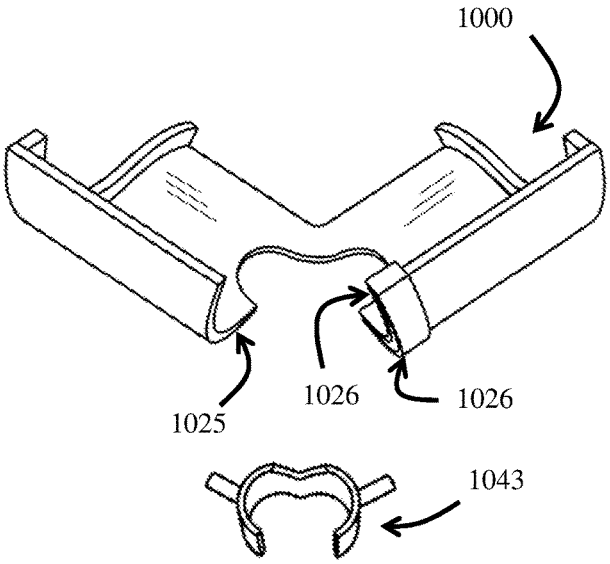
Figure 10C:
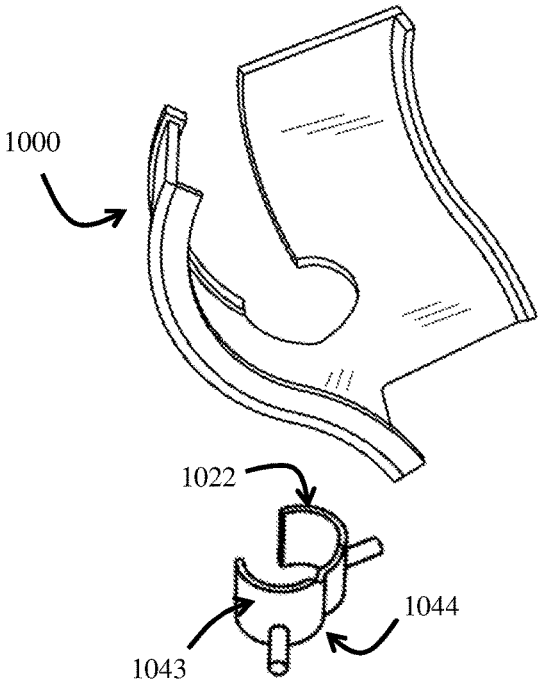
Figure 10E:
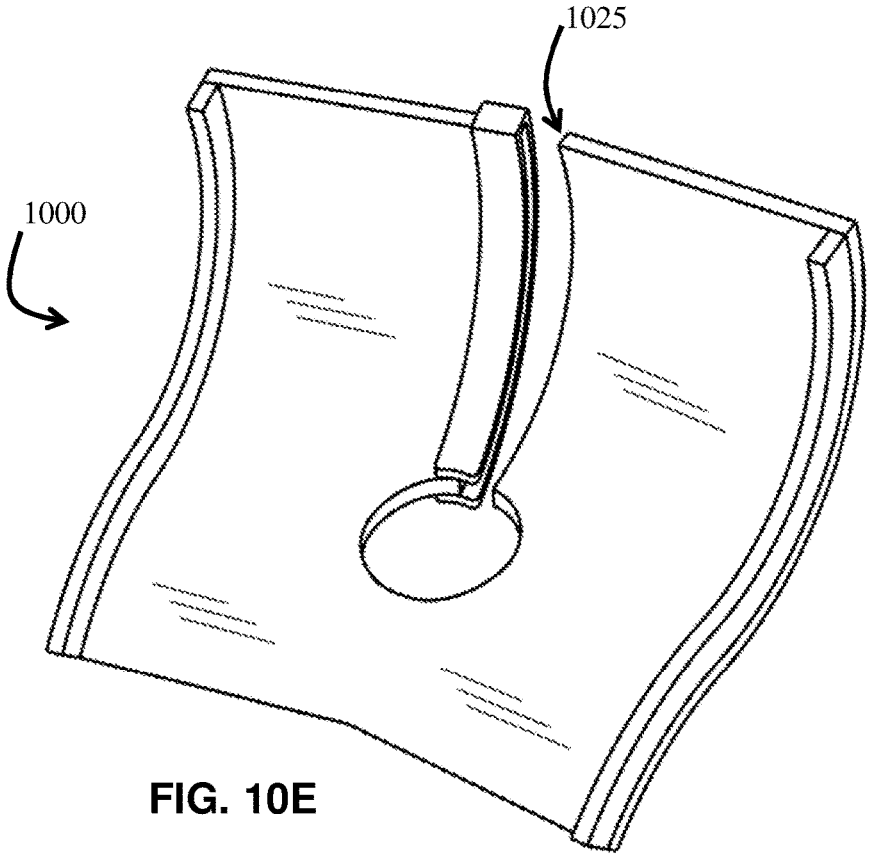
Figure 10F:
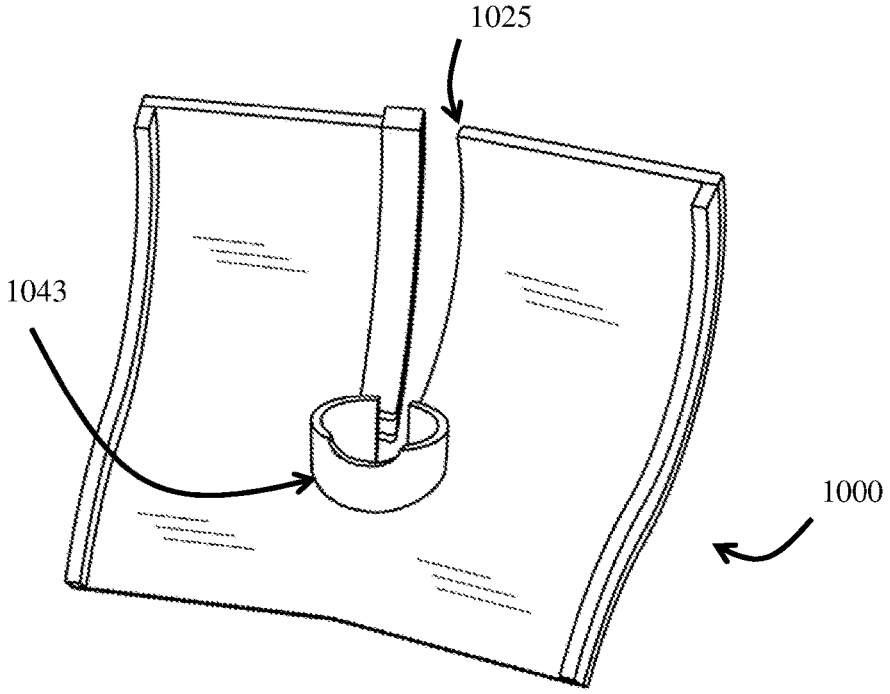
Figure 10G:
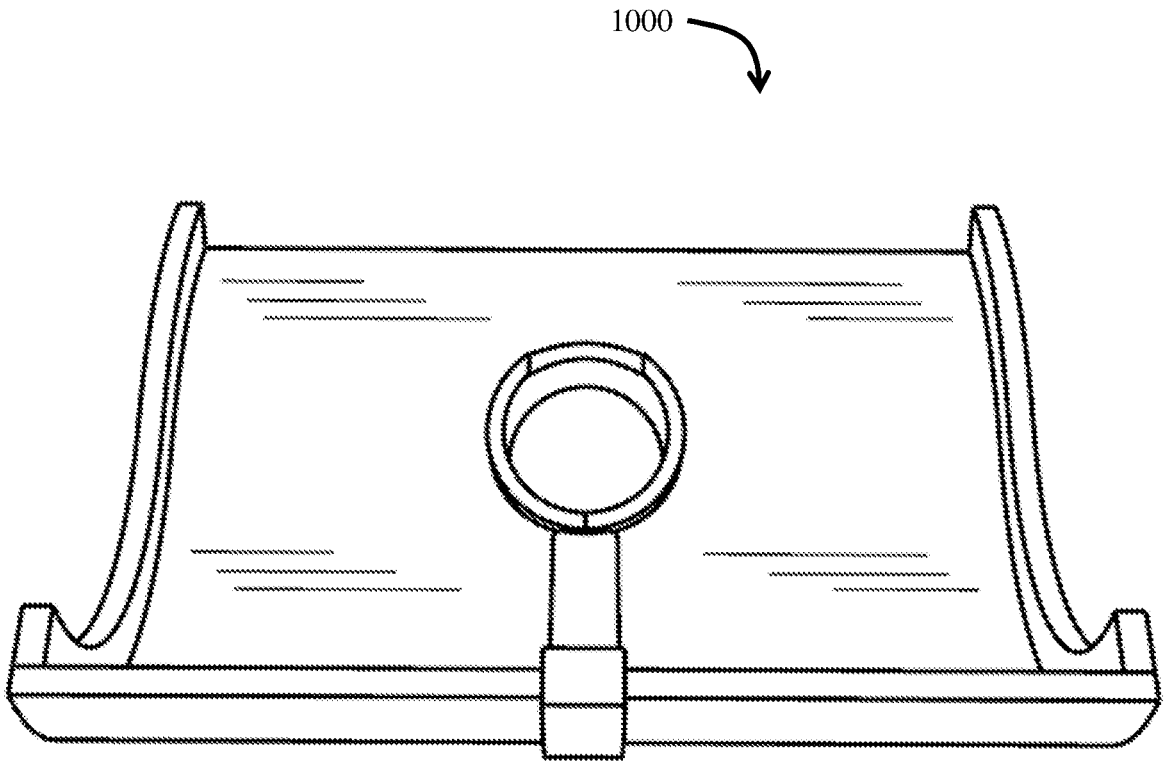

FIGS. 10A-10C also show a separable collar 1043 configured to be positioned around the object, like the neck of a faucet, and configured to be retained within the opening of the guard sheet. The collar 1043 may be a flexible collar configured to be frictionally secured to the object and frictionally secured to the opening of the guard sheet whereby the collar helps secure the guard sheet to the object. The collar 1043 may have one or more protrusions 1042 to help support the guard sheet on the object. The protrusions may be guide pins. As shown in FIG. 10C, the collar 1043 may have a raised edge 1022 to rise above the surface of the top side surface of the guard sheet to urge liquid away from the opening and the object. The collar 1043 may also have a lower edge 1044 configured to extend below the bottom side surface of the guard sheet. As shown in FIG. 10A, the collar 1043 may also have a notch 1045 to provide stress relief on the collar 1043 when a slit in the collar is expanded to allow the collar to go around the object.

Referring back to FIG. 3A, the coupling of the splash guard 300 to the faucet neck is generally a frictional coupling between the edges of the guard sheet opening onto the neck of the faucet. This frictional coupling is done by sliding the faucet neck through the slit in the splash guard. Because of the use of the split as part of the method of mounting the splash guard, and the desired small sizing of the slit to minimize ways for water to pass through the splash guard, the splash guard is generally made from a semi-rigid and elastic material or a foam like elastic material. Suitable materials will allow the faucet neck to pass through the slit and will allow the guard sheet to resume its shape and minimize the size of the opening formed by the slit. The elastic properties and surface textures of the material may also enhance the frictional engagement of the opening edges with surface of the faucet neck. The guard sheet may also be made from a combination of more than one type of flexible material. For example, the top portion and lower portion may be made from two different types of flexible material to accommodate different usage environment. For example, the top portion of the guard sheet may be made from a more flexible material than the lower to accommodate the need of the slit to deform around objects. Additionally, the area of the opening that contact the collar may be made from a softer material than the rest of the slit, like a soft foam, so that the splash guard can have a better seal and frictional engagement around the collar and the object.

In some embodiments, the collar around the opening may comprise a different material than the guard sheet to enhance the frictional properties of the collar while the guard sheet and/or raised edges may be made from a different, for example only, more rigid material. The collar, guard sheet and raised edges may then be coupled or otherwise integrated to form the splash guard.

Figure 4A:
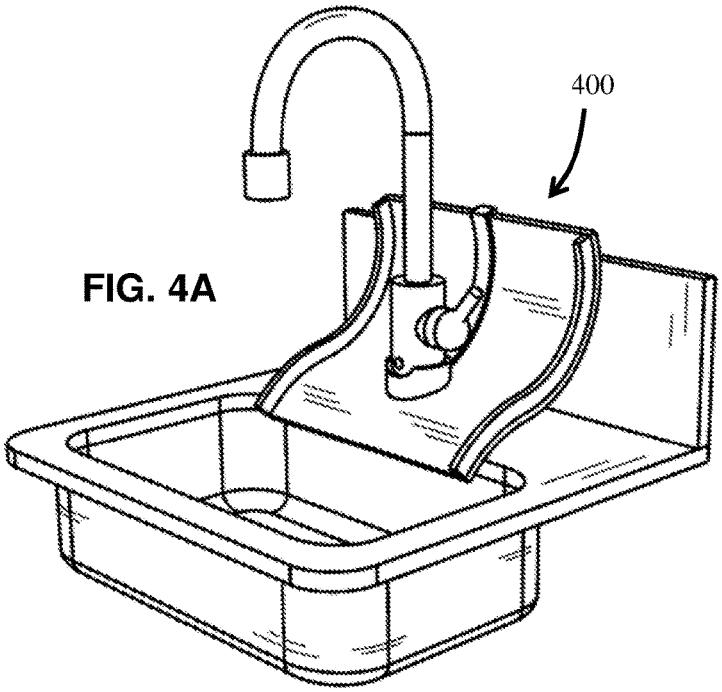
FIGS. 4A-4D show perspective views of example embodiments of a splash guard coupled to a faucet neck.
Figure 4B:
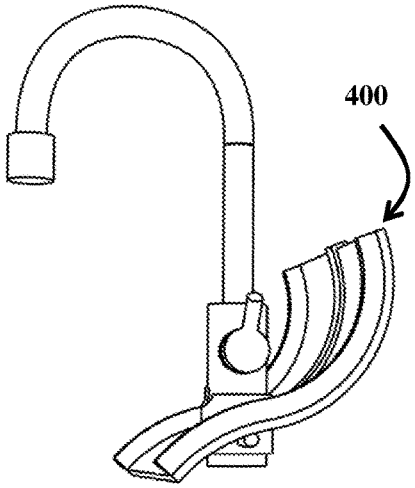
Figure 4C:
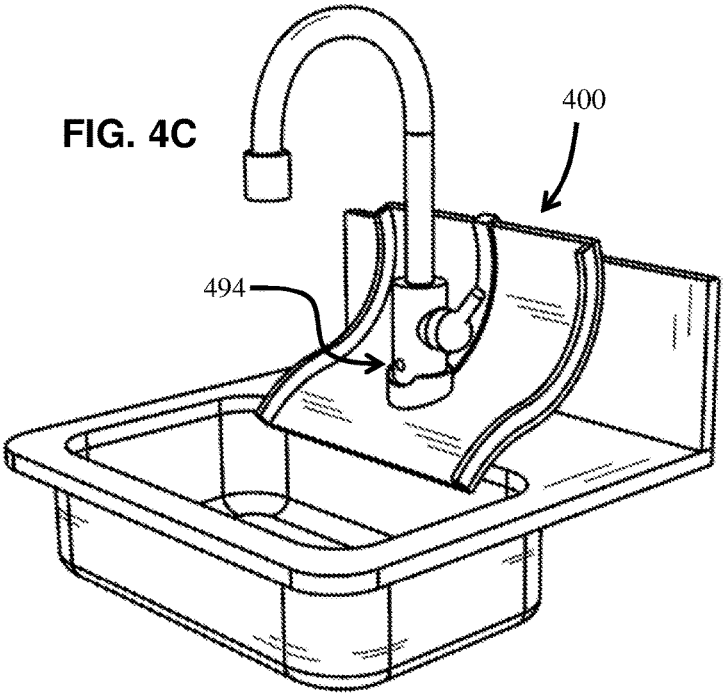
Figure 4D:
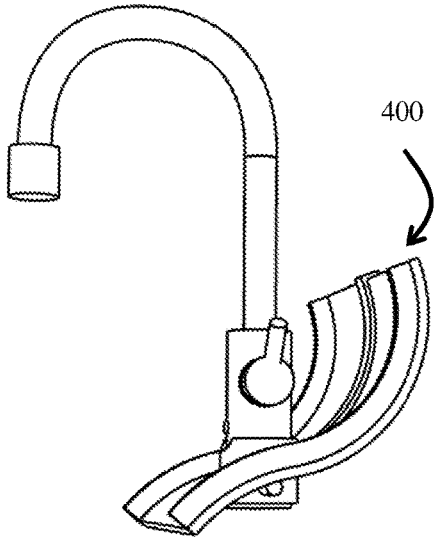

In some embodiments, the opening is configured to easily allow the splash guard to be moved up and down the neck of the faucet by extending the opening to reduce the friction. This movement allows for the splash guard to be used with different types of faucets that may have different dimensions or elements, such as motion sensors, that should be positioned above the surface of the guard sheet. See FIGS. 4A and 4B that show the splash guard 400 mounted higher on the faucet neck than the embodiment shown in FIGS. 4C and 4D to accommodate the sensor 494 mounted on the lower end of the faucet neck.

In some embodiments, the collar on the top side surface of the guard sheet surface has a common height as measured from the top or bottom surface of the guard sheet. In some embodiments, the collar height on the bottom side of the guard sheet is uneven as shown in FIGS. 3A and 3B.

FIG. 3C shows a top view of the embodiment of FIG. 3A and FIG. 3D shows a bottom view.

Figure 3E:
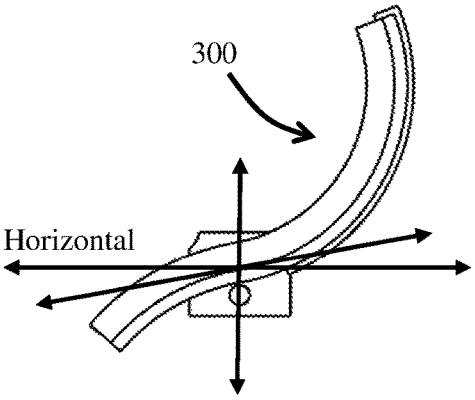
FIGS. 3E and 3F show side views of an example embodiment of a splash guard highlighting the general angles of different embodiments.
Figure 3F:
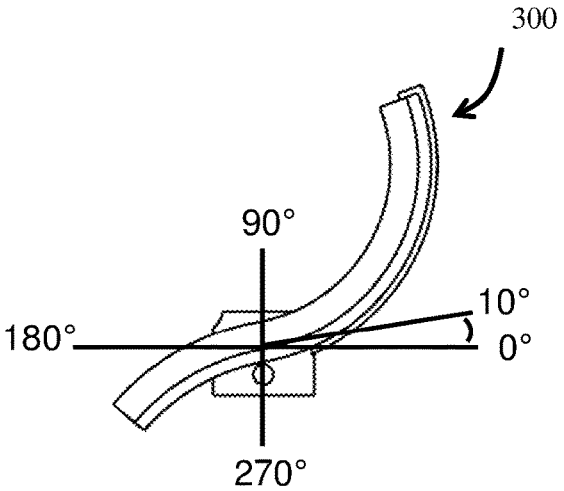

Generally, the axial orientation of the opening or collar is configured to align with the faucet neck and is generally perpendicular to the orientation of the countertop surface and the horizon. The angle of the top side surface of the guard sheet is slightly sloped from this perpendicular and the horizon. See the side profile views of guard sheet 300 in FIGS. 3E and 3F. The angle of this slope ensures that the top side surface of the guard sheet maintains a slope toward the drip end of the splash guard. In one preferred embodiment, when looking at a side profile of the guard sheet, the slope of the top side surface of the guard sheet has an angle in the range between about 0 degrees and 90 degrees off of a perpendicular of the axial orientation of the opening at a centerline of the opening. This angle creates a positive angle from horizontal towards the upper end of the guard sheet and a downward angle from horizontal toward the drip end of the guard sheet. These angles are helpful to ensure that the guard sheet top side surface will repel and urge water towards the drip end and the sink. In some embodiments, the angle from perpendicular is in the range between about: 0 degrees and 60 degrees; 0 degrees and 45 degrees; 0 degrees and 30 degrees; 0 degrees and 20 degrees; and 0 degrees and 10 degrees. In some embodiments, the angle is about 10 degrees as shown in FIG. 3F.

The guard sheet surface may be curved or otherwise shaped to capture splashes of water and enhance the tendency for the water to flow towards the sink. As shown in FIGS. 3A-3F, in one example embodiment, the guard sheet is a thin, semi-rigid but flexible sheet having an upward curve on the upper end of the guard sheet and a downward curve on the drip end. In some embodiments, the curve profile comprises one or more polyline segments, or combination of both curves and polyline segments arranged to achieve a polyshape that allows a fluid to flow toward the drip end of the splash guard due to the force of gravity. In some embodiments, the curve profile has a generally concave shape from the faucet neck to the upper end and a generally convex shape from the faucet neck to the drip end.

Figure 15A:
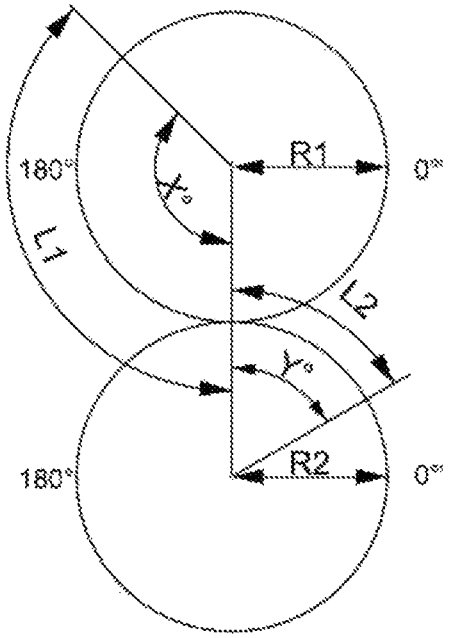
FIGS. 15A-15C show side profiles views of an example embodiment of a guard sheet illustrating the curved surface of the guard sheet.
Figure 15B:
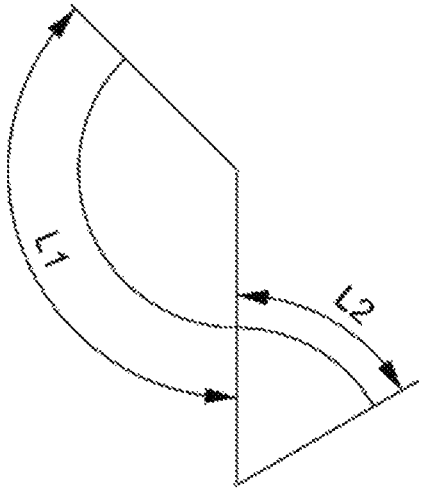
Figure 15C:
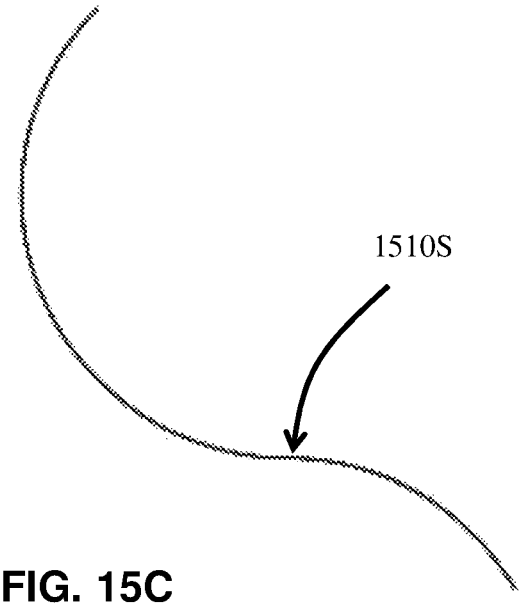

Referring to FIGS. 15A-15C, in some embodiments, the curved side profile of the guard sheet is an undulating "S" shaped curve geometry, based on connecting two generally circular arches together to form a smooth surface transition from the upper end of the guard sheet to the drip end. The function of the design is to allow the guard sheet to divert water from in a continuously curved surface from the upper end down to the drip end by force of gravity without having an area where the fluid will pool. One example embodiment of this "S" shaped curve geometry is shown the side profiles of the guard sheet in FIGS. 15A-15C. As shown in FIG. 15A, the guard sheet curve for the upper portion is defined by a circular curve with a radius of R1 and the length of the upper end portion being L1 over an angle of the curve of X° and the curve for the drip end portion is defined by a circular curve with a radius of R2, a length of this portion being L2 over an angle of the curve of Y°. FIG. 15 B shows a side profile illustrating the length of the upper end portion of L1 and the length of the drip end portion of L2. FIG. 15C shows the side profile of the resulting guard sheet showing the surface 1510S of this guard sheet. It is understood that the radius of the two curves may have any relation to each other including one having a larger radius than the other or one having an equal radius to the other. It is also understood that the length of the portions may be any length over any angle that functions to divert a fluid from the upper end to the drip end of the splash guard. It is also understood that a portion of the "S" shape curve may be used whereby the curved/undulating side profile of the guard sheet is a single-curve "J" shaped side profile geometry.

Figure 34:
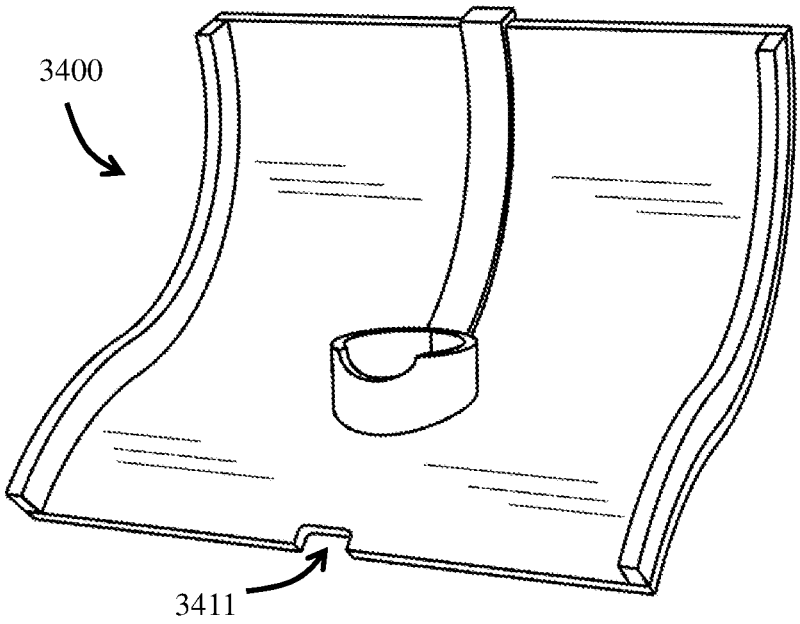
FIG. 34 shows a top perspective views of example embodiments of the top side surface of a splash guard with a collar and a notch in the bottom edge of the guard sheet.

In some embodiments, the drip end edge of the guard sheet further comprises a notch. Referring to FIG. 34, the notch 3411 in splash guard 3400 may be helpful in distributing stress forces in the guard sheet when it is deformed around the faucet neck. The notch 3411 may be configured to distribute stress forces in the guard but it is also configured so that it does not reduce too much of the frictional force applied by the collar. The larger the area of the notch with respect to the guard sheet area, the more stress force is distributed.

In a preferred embodiment, the drip end edge does not have a raised edge.

The guard sheet and other splash guard elements may be made from any material, such as but not limited to being manufactured from, alone or in combination, thermoplastic polyurethane, Teflon®, flexible poly vinyl chloride (PVC), a nylon, silicone, rubber, elastomer, low density polyurethane (LDPE), foam or foam like materials. In a preferred embodiment, the guard sheet is manufactured from thermoplastic polyurethane (TPU).

It is understood that embodiments of the splash guard may be made from a single type of material, for example from a single mold for a moldable material, or the splash guard may be made from different materials for different elements and those elements may be coupled to form the splash guard. For example, only and not for limitation, referring to FIG. 3A, the collar 343 may be made from a material with elastic and frictional properties that allow it to more easily deform around and frictionally engage the faucet neck while the guard sheet 310 and edges 316 may be made from a different, more rigid material. The collar 343, the edges 316 and the guard sheet 310 may then be coupled or otherwise integrated to form the splash guard.

Figure 5:
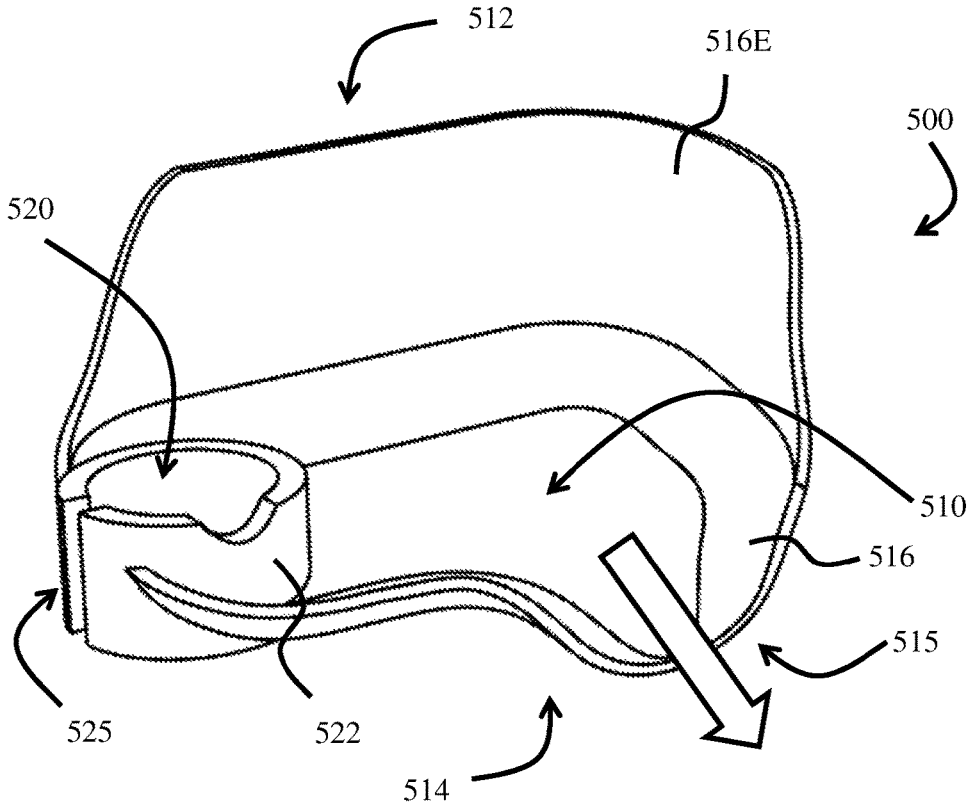
FIG. 5 shows a perspective view of an example embodiment of a splash guard.

Alternative Embodiments of a Splash Guard:

An alternative embodiment of a splash guard is shown in the perspective view of FIG. 5. As shown in this example embodiment, the splash guard 500 comprises a guard sheet 510 having a middle section having an opening 520 and a slit 525 extending though the opening 520. The guard sheet 510 is generally configured with an upper portion having an upper end 512 and lower portion having a drip end 514 whereby the drip end 514 is configured to be the lower end of the guard 500 and configured to extend over the countertop and over the bowl of the sink. The guard sheet 510 generally has a smooth, non-permeable surface configured to repel water and redirect the water towards the sink.

As shown, the guard sheet 510 may also have raised edges around some sections to keep water on the guard sheet 510. For example, the guard sheet 510 may have raised edges 516 around the guard sheet 510 to keep water on the guard sheet rather than spill over the side edges of the sheet. The guard sheet 510 may also have extended raised edges 516E to further keep water on the sheet. The guard sheet 510 may also have a raised edge 522 around the opening 520 forming a collar. The raised edges may be any type of wall or other raised area that helps urge a fluid to stay on one side of the raised edge.

In this embodiment, the guard sheet 510 is shaped like a tray with the raised edges 516 to capture splashes and direct them toward the drip end 514 of the guard. This embodiment also has the drip end 514 of the splash guard having a downward sloping spout shaped portion 515 to further control the directional flow of fluids from the guard sheet 510 into the sink.

Consistent with previous descriptions, the coupling of the splash guard to the faucet neck is generally a frictional coupling by the opening edges of the guard sheet onto the collar. This frictional coupling is done by sliding the faucet neck through the slit in the splash guard. Because of the use of the split as part of the method of mounting the splash guard, and the desired small sizing of the slit to minimize ways for water to pass through the splash guard, the splash guard is generally made from a semi-rigid, elastic, flexible material to provide the flexibility of the splash guard. Suitable materials may include any of the materials detailed above for the embodiments shown in FIGS. 1-4D and will allow the faucet neck to pass through the slit and will allow the guard sheet to resume its shape and minimize the size of the opening formed by the slit. The elastic properties and surface texture of the material may also enhance the frictional engagement of the opening edges with surface of the faucet neck.

Figure 6A:
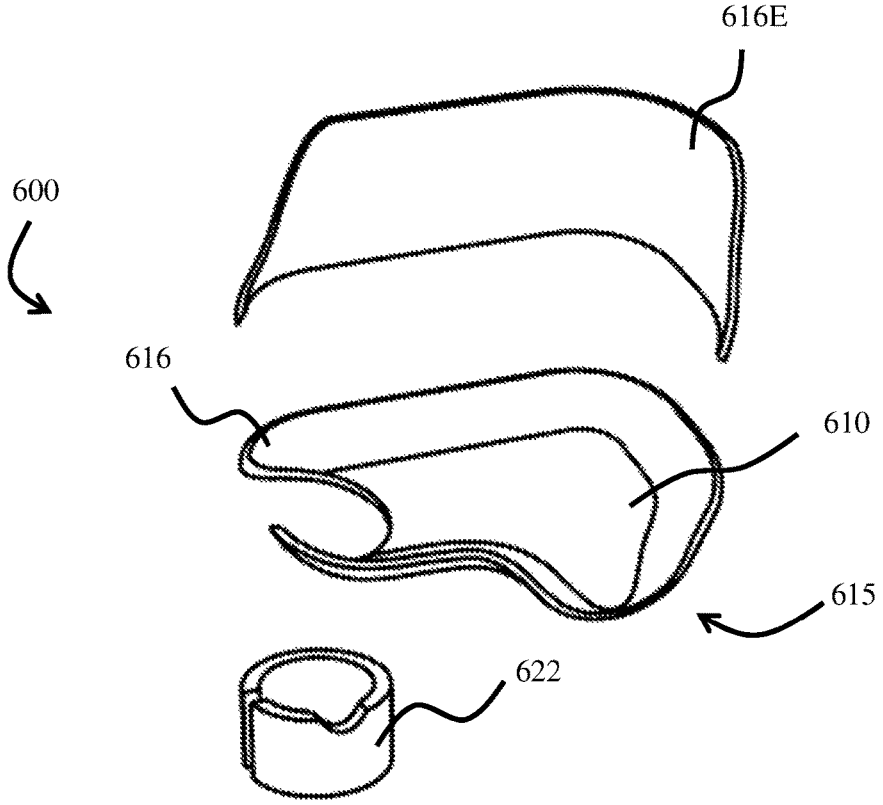
FIG. 6A shows a partially exploded view of an example embodiment of a splash guard.

FIG. 6A illustrates a partially exploded view of an example embodiment of a splash guard 600 showing the guard sheet 610, the collar 622, raised edges 616, extended raised edges 616E and the guard sheet spout shaped portion 615.

Figure 6B:
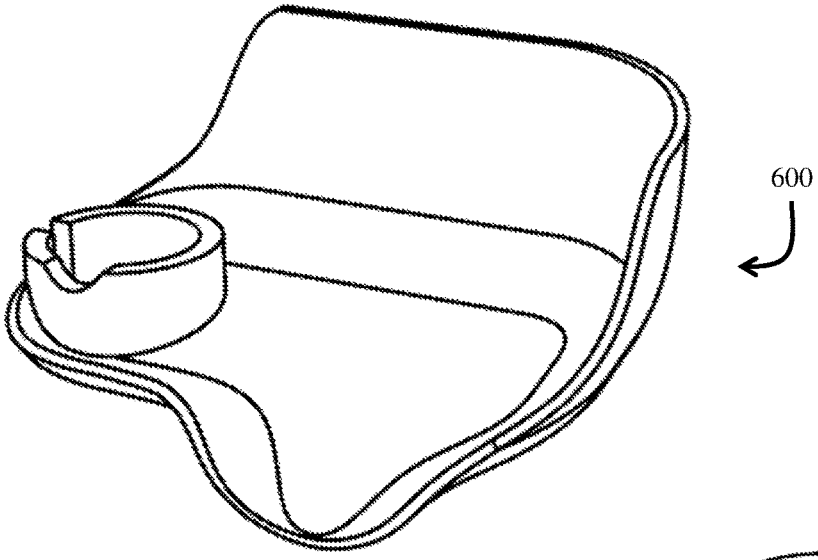
FIGS. 6B-6D show different perspective views of an example embodiment of a splash guard.
Figure 6C:
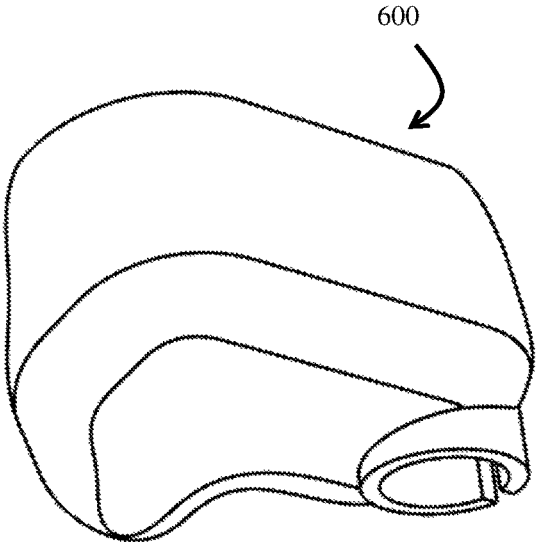
Figure 6D:
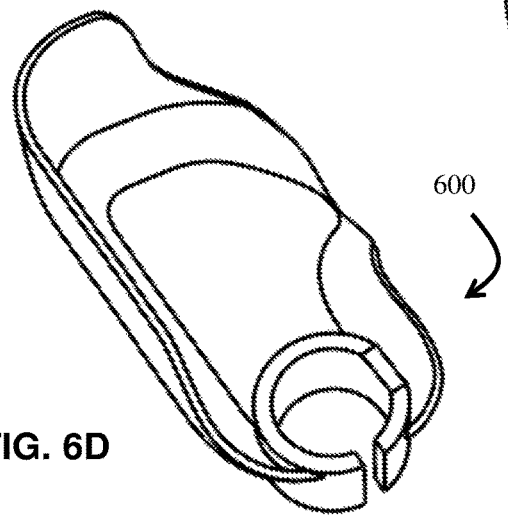

FIGS. 6B-6D show different perspective views of a splash guard 600 consistent with the embodiment shown in FIG. 5.

Figure 7A:
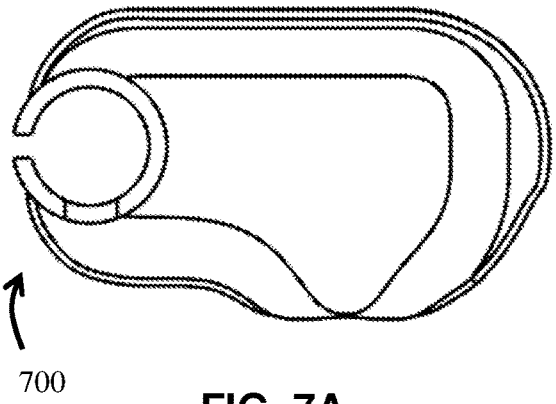
FIGS. 7A-7F show different views of an example embodiment of a splash guard.
Figure 7B:
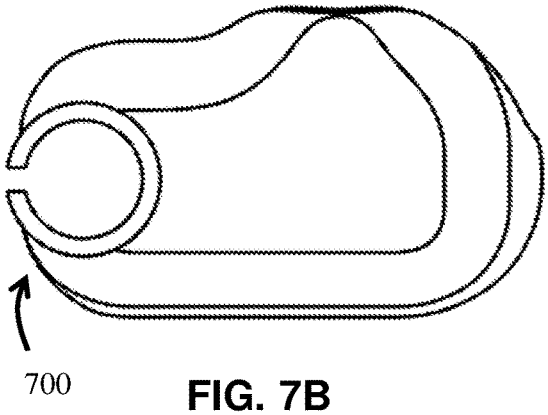
Figure 7C:
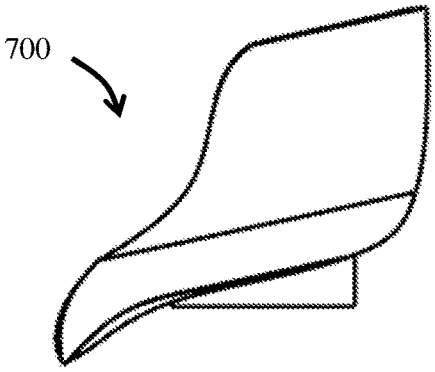
Figure 7D:
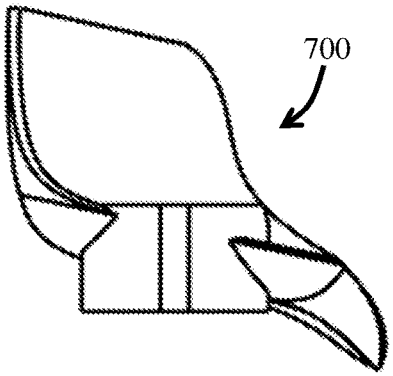
Figure 7E:
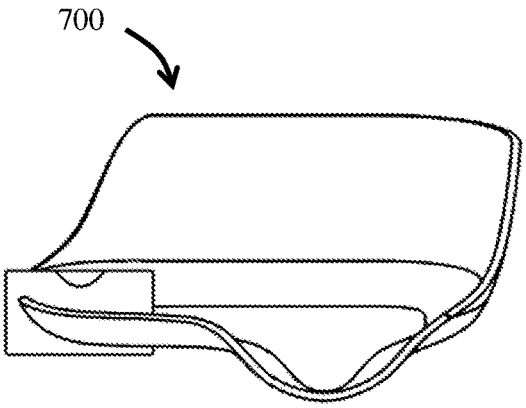
Figure 7F:
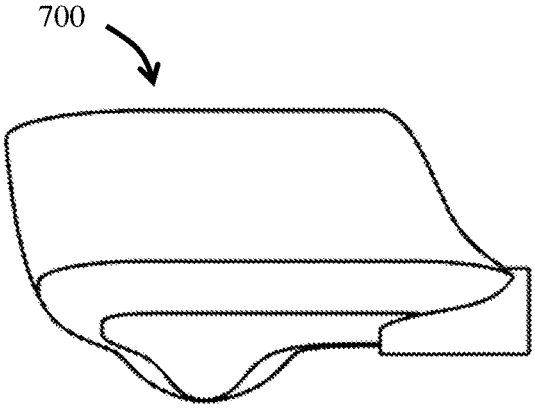
Figure 8A:
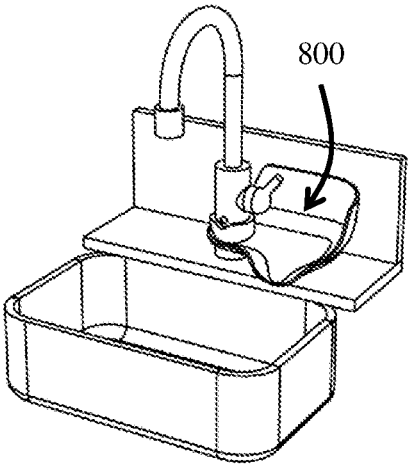
FIGS. 8A-8F show different views of an example embodiment of a splash guard as mounted on a faucet.
Figure 8B:
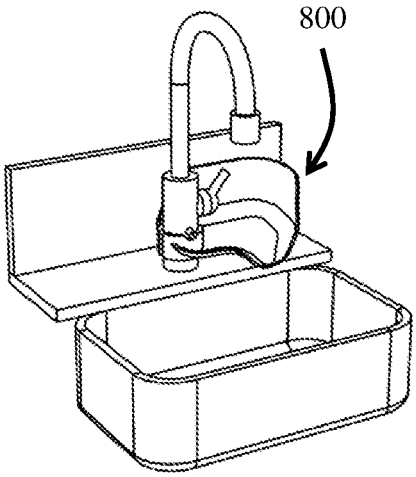
Figure 8C:
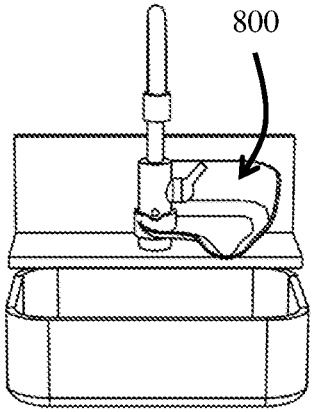
Figure 8D:
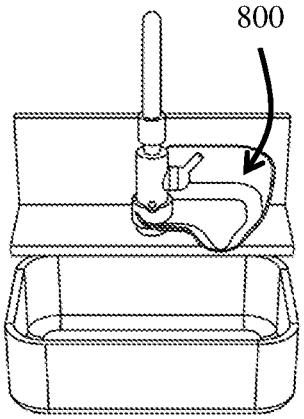
Figure 8E:
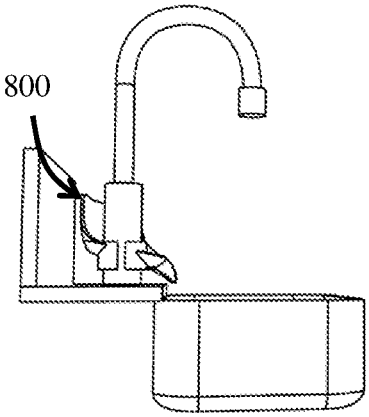
Figure 8F:
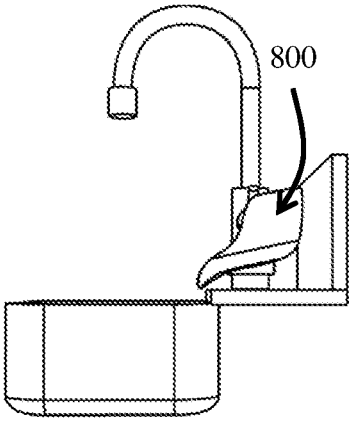

FIGS. 7A-7F show different views of a splash guard 700 consistent with the embodiment shown in FIG. 5 where FIG. 7A is a top view, 7B is a bottom view, 7C is a right side view, 7D is a left side view, 7E is a front view and 7F is a rear view.

FIGS. 8A-8F show different views of a splash guard 800 consistent with the embodiment shown in FIG. 5 as it may be mounted on or coupled to the neck of a faucet.

Figure 9A:
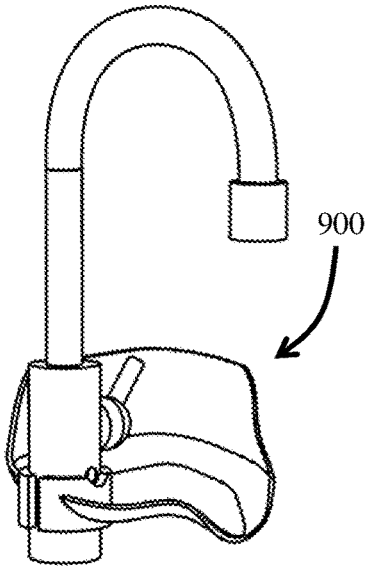
FIGS. 9A-9D show different views of an example embodiment of a splash guard as mounted on a faucet.
Figure 9B:
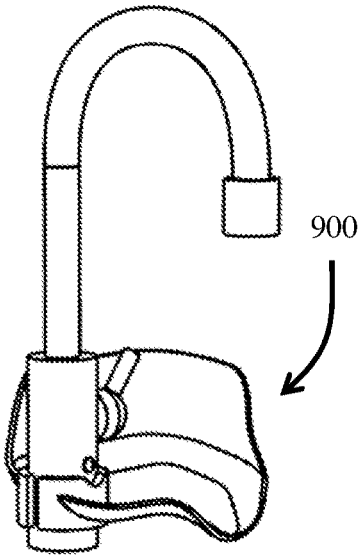
Figure 9C:
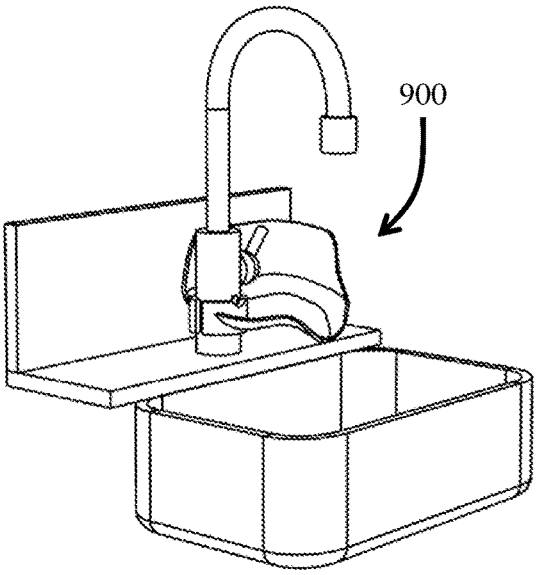
Figure 9D:
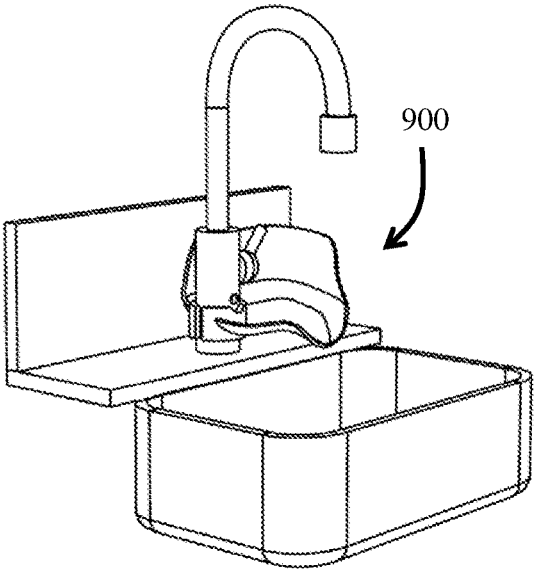

FIGS. 9A-9D show different views of a splash guard 900 consistent with the embodiment shown in FIG. 5 as it may be coupled to the neck of a faucet. FIGS. 9A and 9C show the splash guard 900 coupled higher on the faucet neck and FIGS. 9B and 9D show the splash guard coupled lower on the faucet neck. The lower mounting may be helpful to accommodate faucet features such as motion sensors mounted in lower position of the faucet.

Figure 17A:
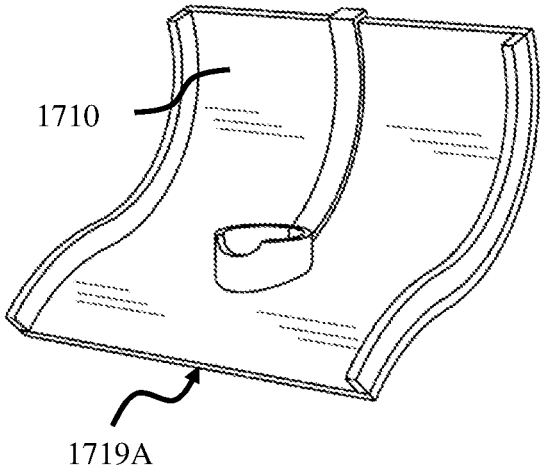
FIGS. 17A-17D show top perspective views of example embodiments of the top side surface of a splash guard with FIG. 17A showing a flat surface below the collar, FIG. 17B showing a arcuate shaped ridge.
Figure 17B:
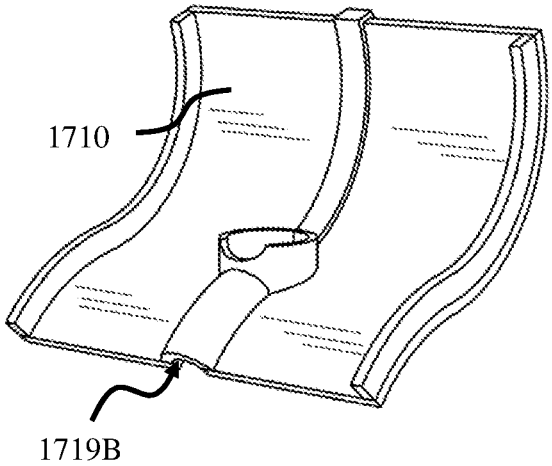
Figure 17C:
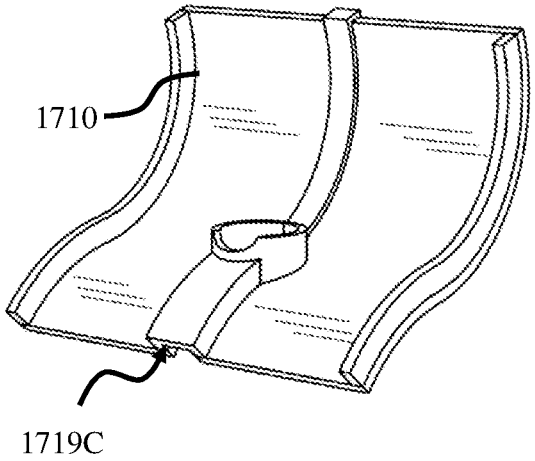
Figure 17D:
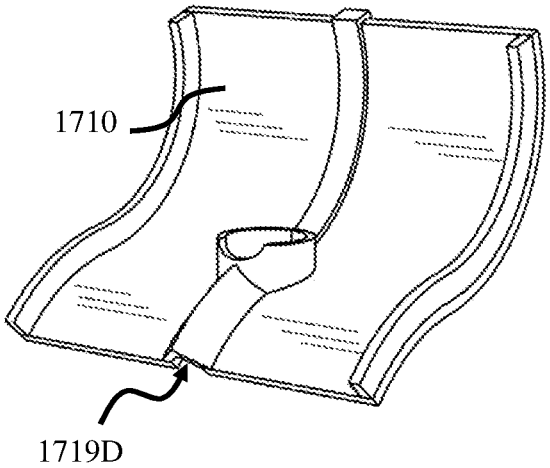

FIGS. 17A-17D show top views of example embodiments of the top side surface of a splash guard 1710. The top side surface may be generally flat with a downward slope as shown in FIG. 17A. The top side surface may also be modified to include shapes that favorably urge liquids in certain directions or shapes that reduce stress forces on splash guard components as they are used. For example, adding a ridge on the guard sheet below the opening provides both of these features. FIG. 17A shows the guard sheet 1710 without a ridge and a straight edge 1719A. FIG. 17B shows the guard sheet 1710 with a ridge having an arcuate shape 1719B. claim calls it arcuate. FIG. 17C shows the guard sheet 1710 with a rectangular shaped ridge 1719C. FIG. 17D shows the guard sheet 1710 with a v-shaped ridge 1719D rising above the flat top side surface of the guard sheet 1710 on the lower portion below the collar and opening. Adding the ridge in this area urges water away from the ridge. The ridge also acts like a spring and reduces stress on the opening of the guard sheet 1710 when the guard sheet is expanded to be secured to the neck of the faucet. The additional flexibility provided to the guard sheet by the ridge, in particular the area around the opening, allows the edges of the opening to fit more flush against the collar of the neck of the faucet which provides a more secure fit on the neck. This additional flexibility has been determined to be helpful when the collar and/or the neck dimensions are larger than that of the opening. The flexibility provided by the ridge helps absorb some of the resulting deformations and reduces the risk of the guard sheet buckling as may occur without the ridge. As shown in FIG. 20B, the ridge may also provide a beneficial shape for double sinks where the ridge can urge water to into the sinks rather than on the center wall or divider of the sink.

Figure 18A:
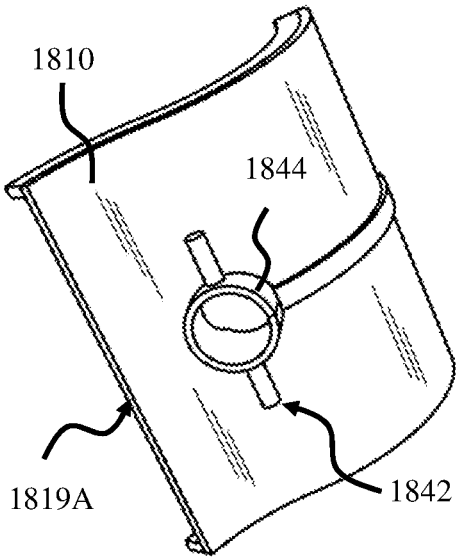
FIGS. 18A-18D show bottom views of example embodiments of a splash guard showing protrusions from the collar under the bottom side surface and FIG. 18A showing a flat surface below the collar, FIG. 18B showing a arcuate shaped ridge.
Figure 18B:
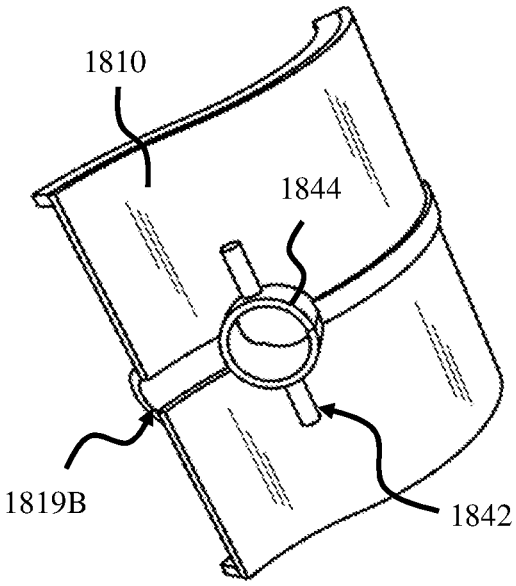
Figure 18C:
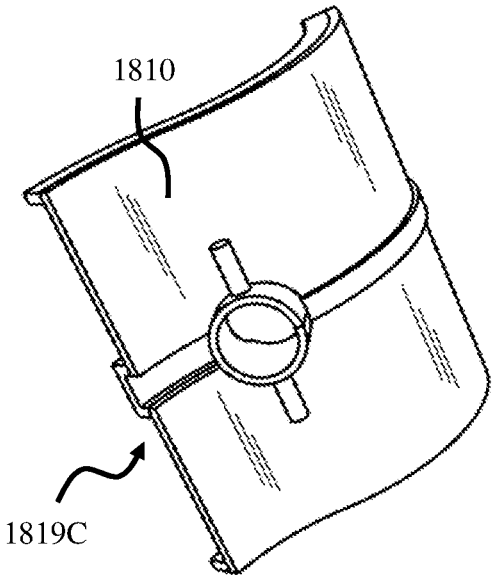
Figure 18D:
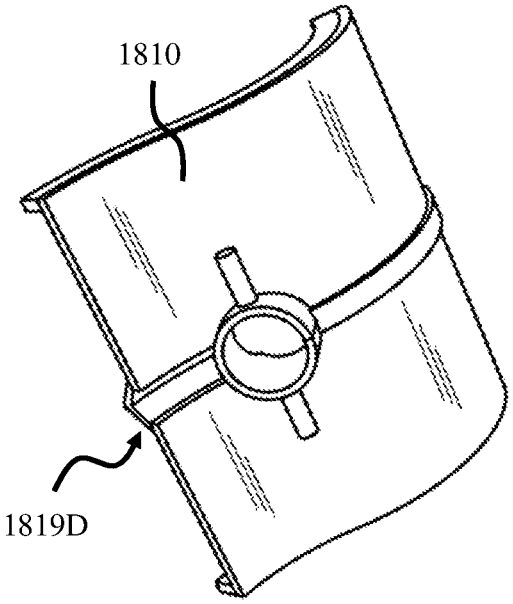

FIGS. 18A-18D show bottom views of example embodiments of a splash guard showing the lower edge 1844 of the collar and protrusions 1842 extending from the collar under the bottom side surface of the guard sheet. FIG. 18A shows a flat end 1891A of the lower portion below the collar and the opening. FIG. 18B shows an arcuate shaped ridge 1819B on the lower portion below the collar and the opening. FIG. 18C shows a rectangular shaped ridge 1819C on the lower portion below the collar and the opening and FIG. 18D shows a v-shaped ridge 1819D on the lower portion below the collar and the opening.

Figure 19A:
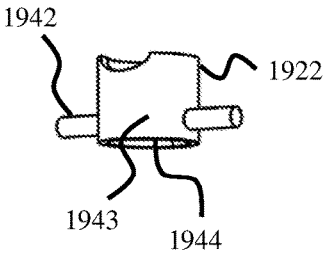
FIGS. 19A-19J show an exploded view of components of a splash guard.
Figure 19B:
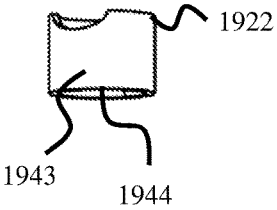
Figure 19C:
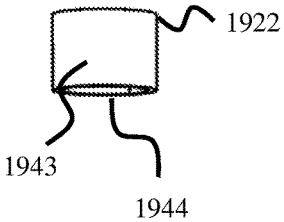
Figure 19D:
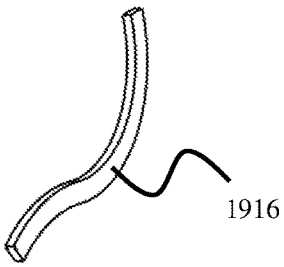
Figure 19E:
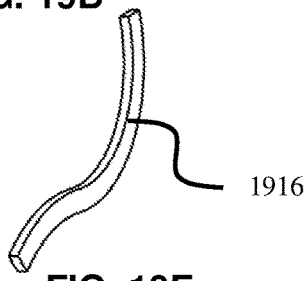
Figure 19F:
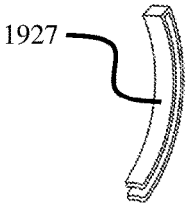
Figure 19G:
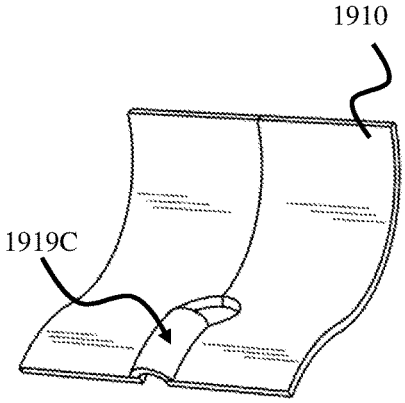
Figure 19H:
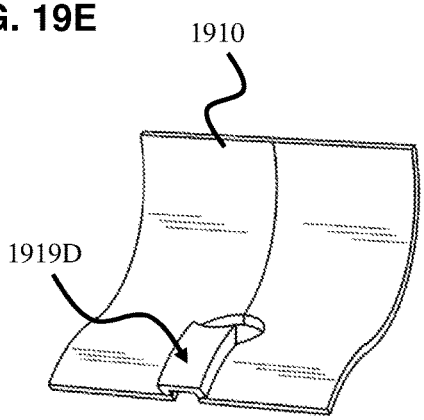
Figure 19I:
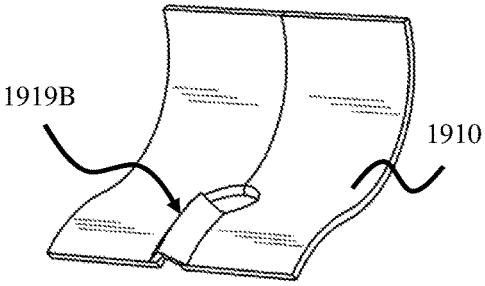
Figure 19J:
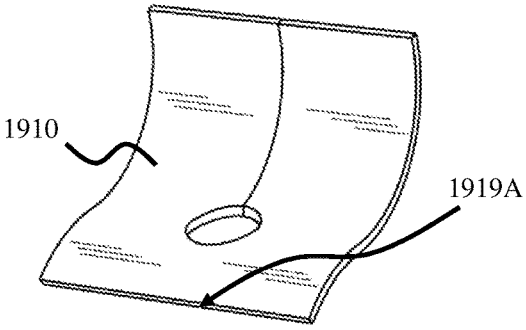

FIGS. 19A-19J shows an exploded view of different components of embodiments of a splash guard. FIGS. 19A-19C illustrated example embodiment of a collar 1943 for use with the splash guard. As shown, the collar 1943 has an upper edge 1922 and a lower edge 1944. The collar 1943 also has protrusions 1942, here guide pins, to help support a guard sheet on a faucet neck. FIGS. 19D and 19E show raised edges 1916 of the guard sheet. FIG. 19F shows an example embodiment of a slit guard 1927 that may act as a slit channel to provide a water repelling cover for the closed slit of a guard sheet. FIGS. 19G-19J show different embodiments of a guard sheet with different lower portions. FIG. 19G shows a guard sheet 1910 having a ridge 1919C with an arcuate cross-sectional profile. FIG. 19H shows a guard sheet 1910 having a ridge 1919D with a rectangular cross-sectional profile. FIG. 19I shows a guard sheet 1910 having a ridge 1919B with a v-shaped cross-sectional profile. FIG. 19J shows a guard sheet 1910 without a ridge but a flat cross-sectional profile 1919A.

Although FIGS. 19A-19J show the components exploded, it is understood that the components may be manufactured separately and coupled to create the splash guard or certain components may be combined and manufactured as a unitary components to be coupled to other components to create the splash guard. It is also understood that the components may be made from similar or different materials to enhance the function of the splash guard.

Figure 20A:
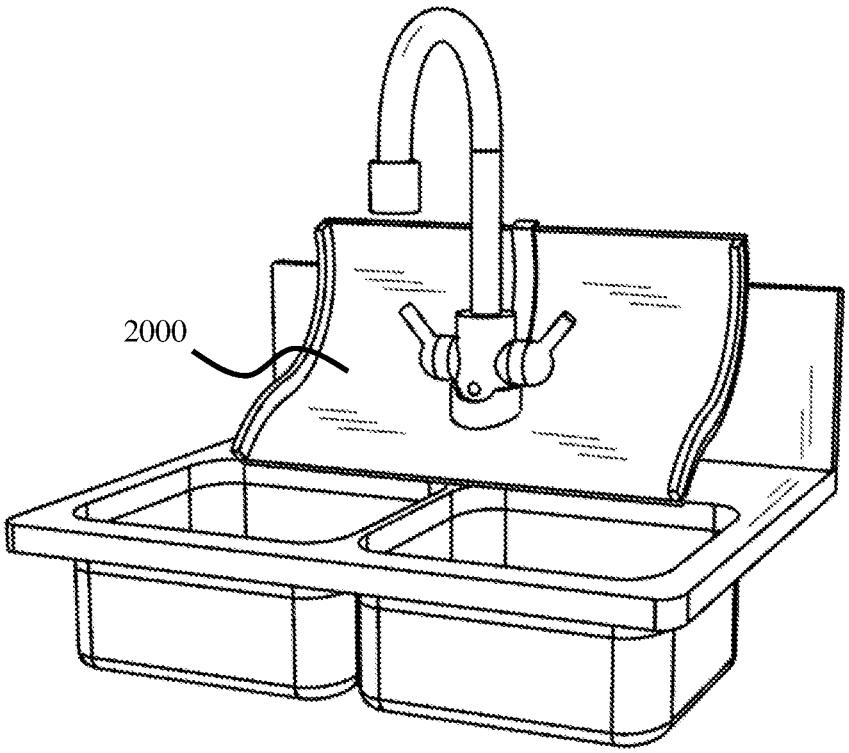
FIGS. 20A and 20B show example embodiments of the splash guard secured to the neck of a faucet.
Figure 20B:
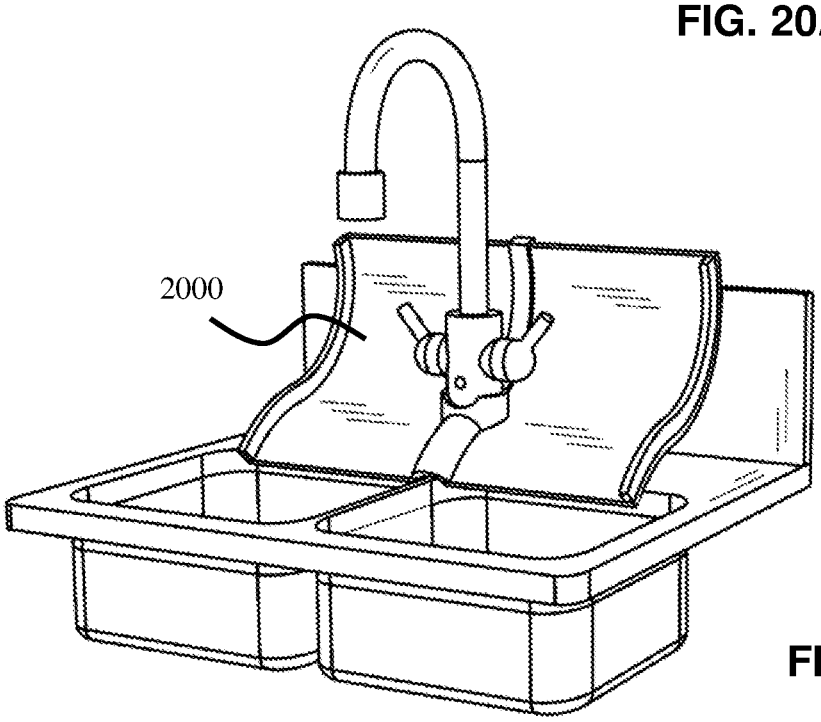

FIGS. 20A and 20B show example embodiments of the splash guard secured to the neck of a double faucet. Embodiments with ridges in the lower portion may be better for double sinks where the ridge can fit around the sink divider. It is understood that the slit can be widened to accommodate longer or double sinks.

Figure 21A:
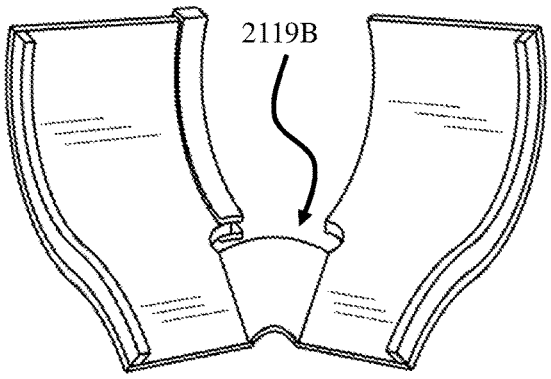
FIGS. 21A-21C show example embodiment of the splash guard with ridges having different cross-sectional profiles.
Figure 21B:
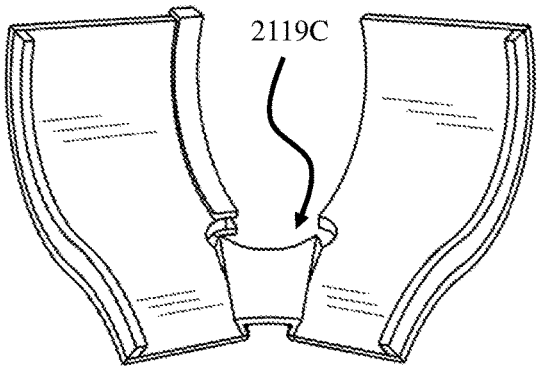
Figure 21C:
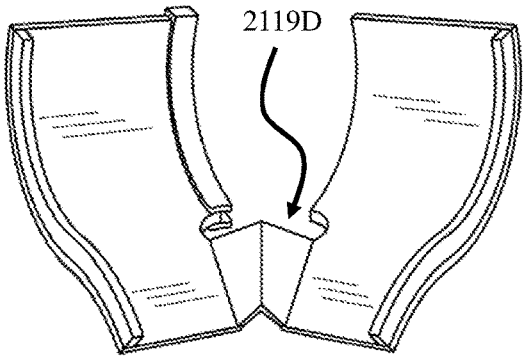
Figure 21D:
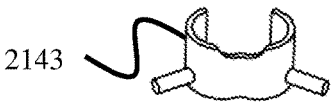
FIG. 21D shows and example embodiment of a collar.

FIGS. 21A-21C illustrate example embodiments of splash guards with ridges having different profile shapes. FIG. 21A shows a ridge with an arcuate shaped cross-sectional profile 2119B, FIG. 21B shows a ridge with a rectangular shaped cross-sectional profile 2119C and FIG. 21C shows a ridge with a v-shaped shaped cross-sectional profile 2119D. FIG. 21D shows an example collar 2143 that may be used with these splash guards.

Figure 22A:
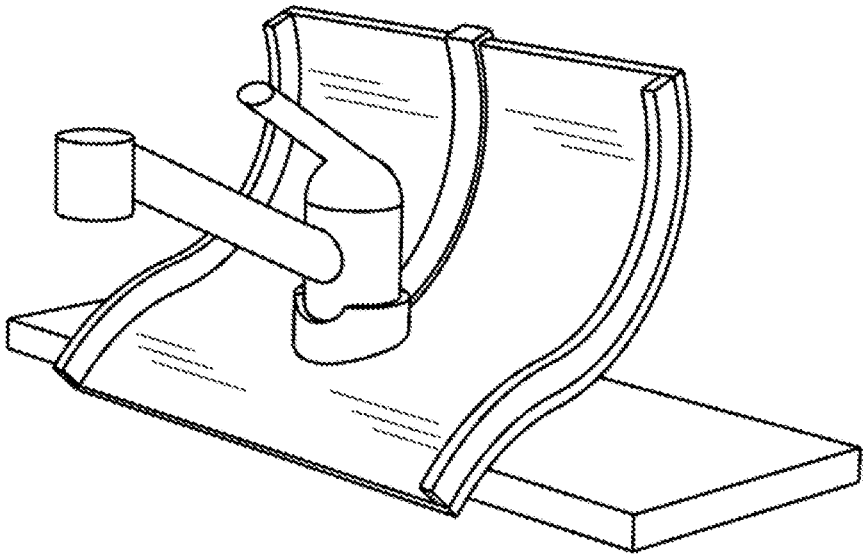
FIGS. 22A and 22B show splash guard for faucet with top control handle.
Figure 22B:
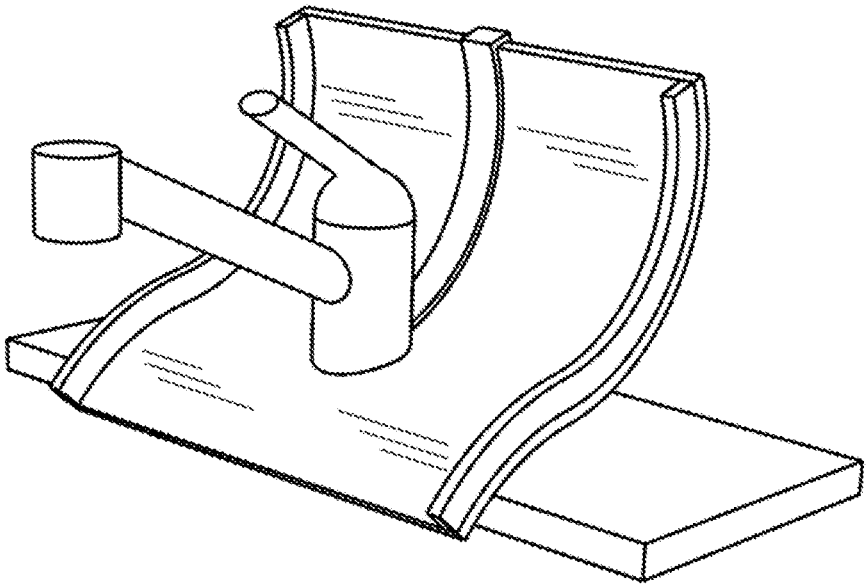

FIGS. 22A and 22B show splash guard for faucet with top control handle. FIG. 22A shows an embodiment that uses a collar and FIG. 22B shows an embodiment that does not use a collar.

Figure 23A:
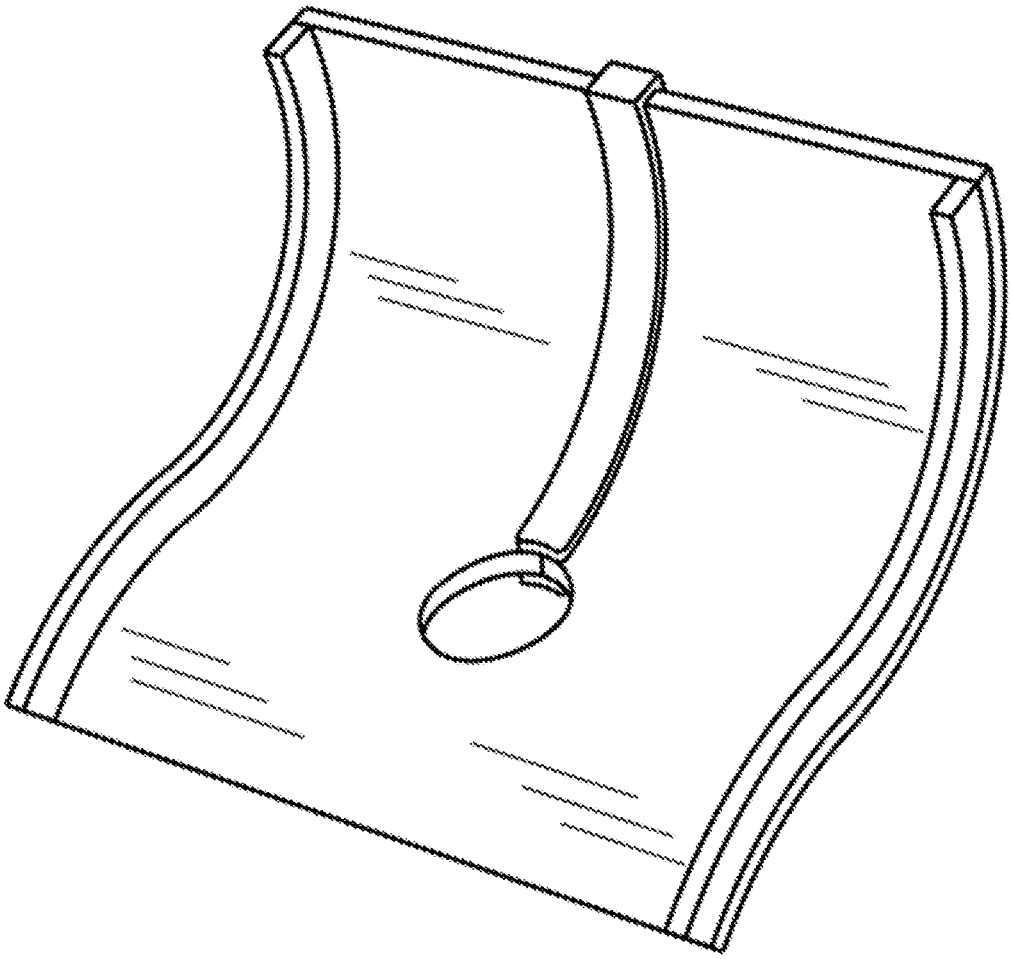
FIGS. 23A-23H show the aesthetic design of an example embodiment of a splash guard with FIG. 23A showing a top perspective view thereof.
Figure 23B:
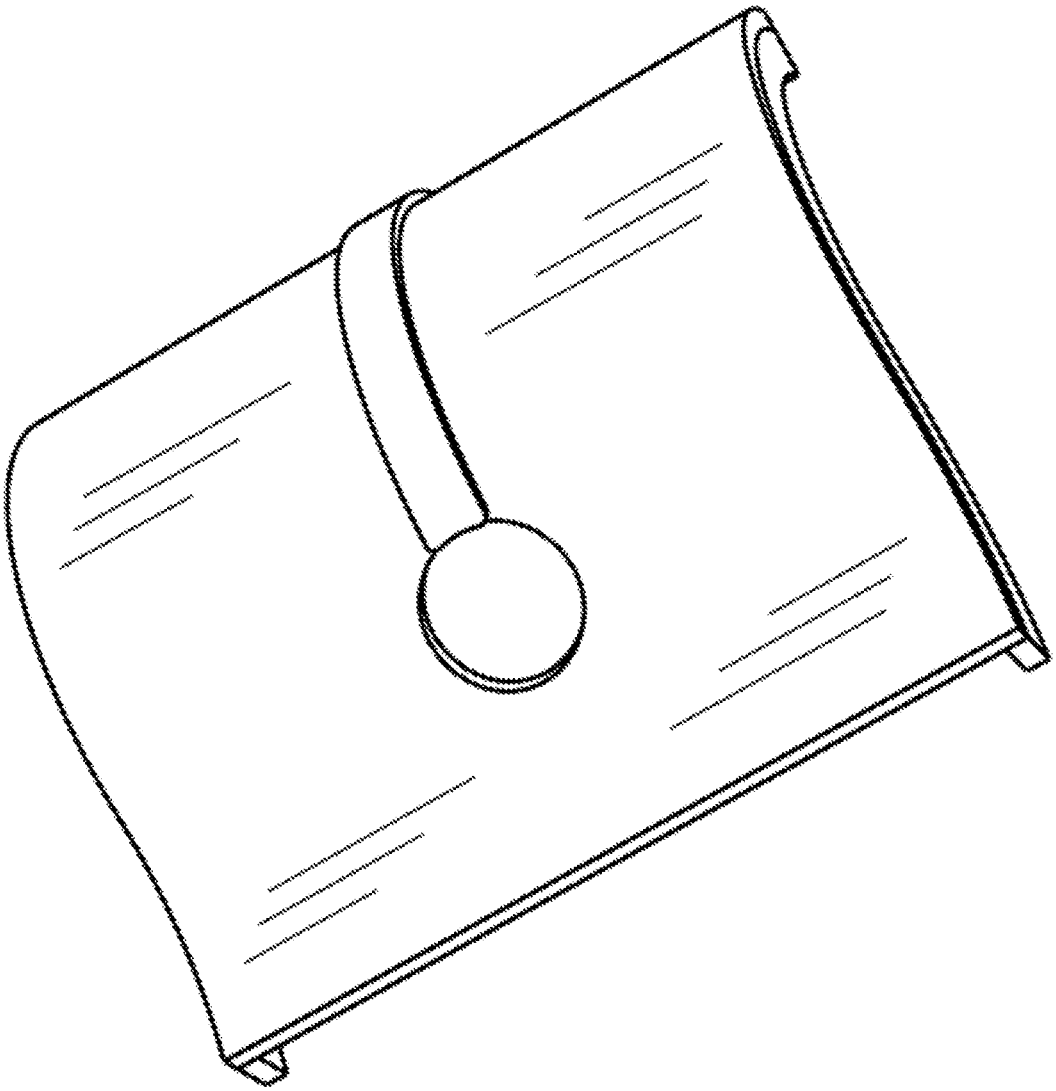
Figure 23C:
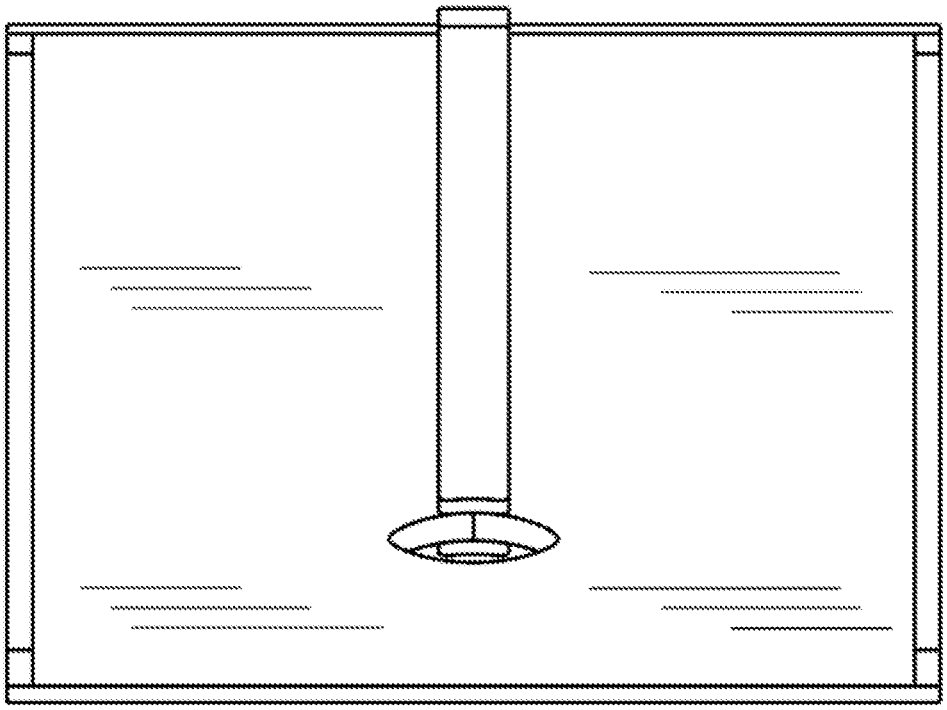
Figure 23D:
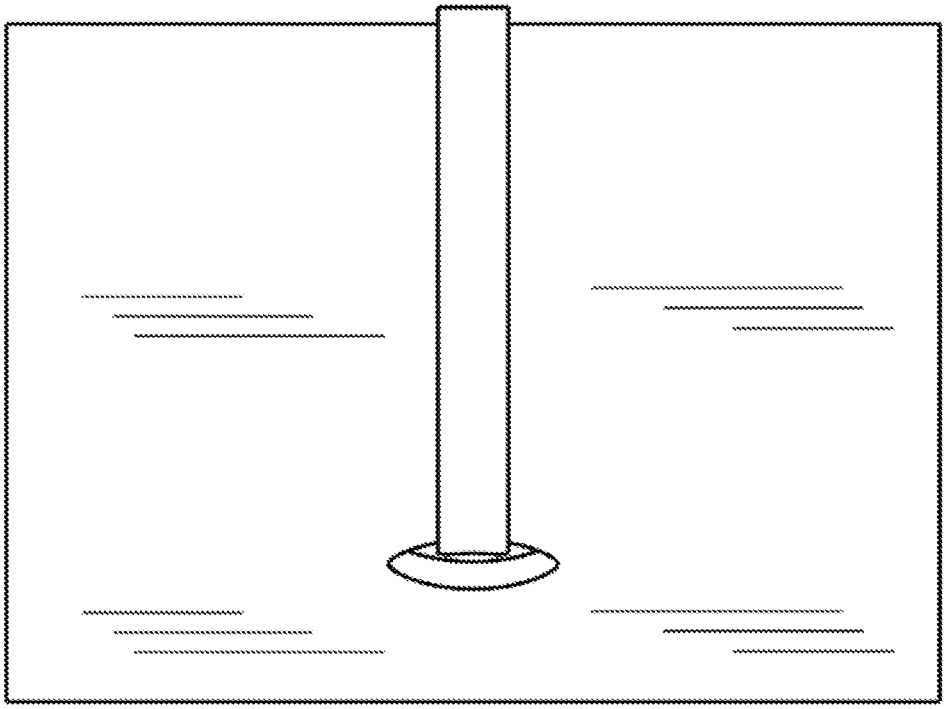
Figure 23E:
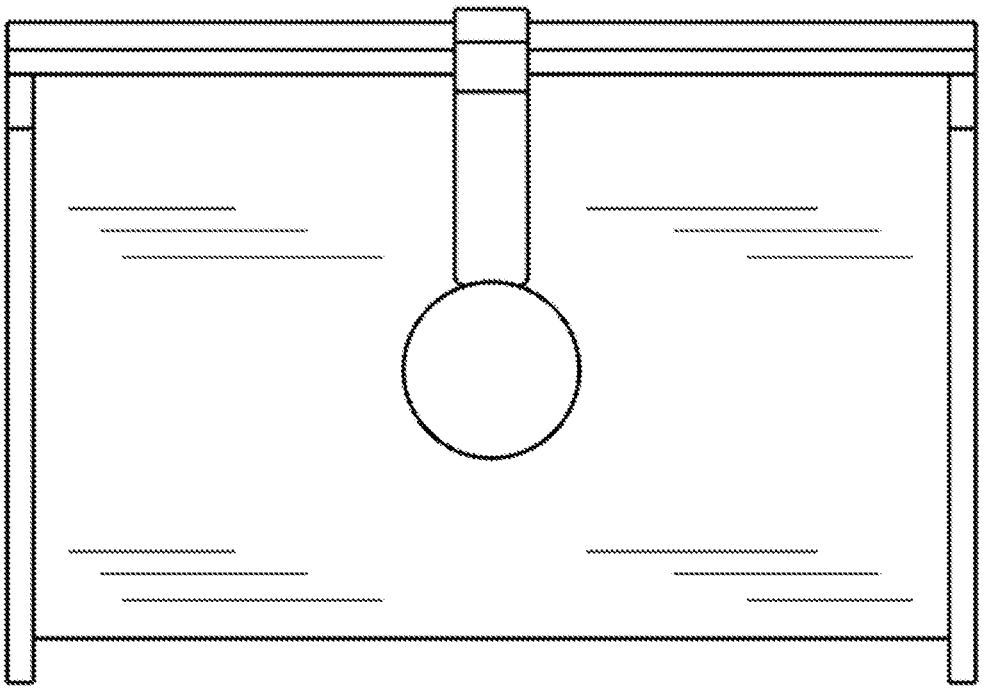
Figure 23F:
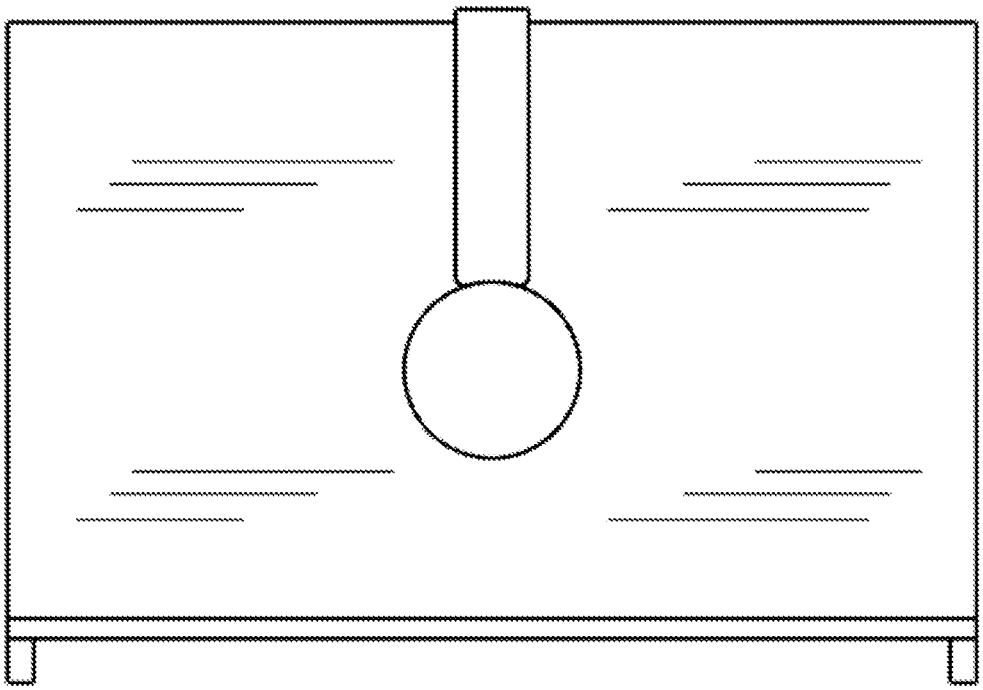
Figure 23G:
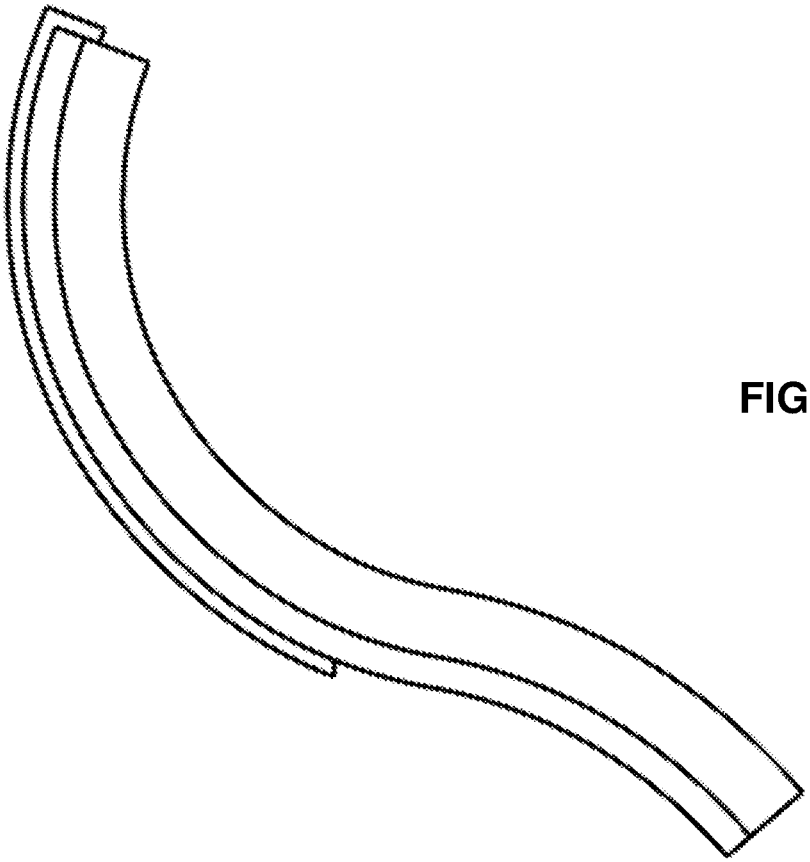
Figure 23H:
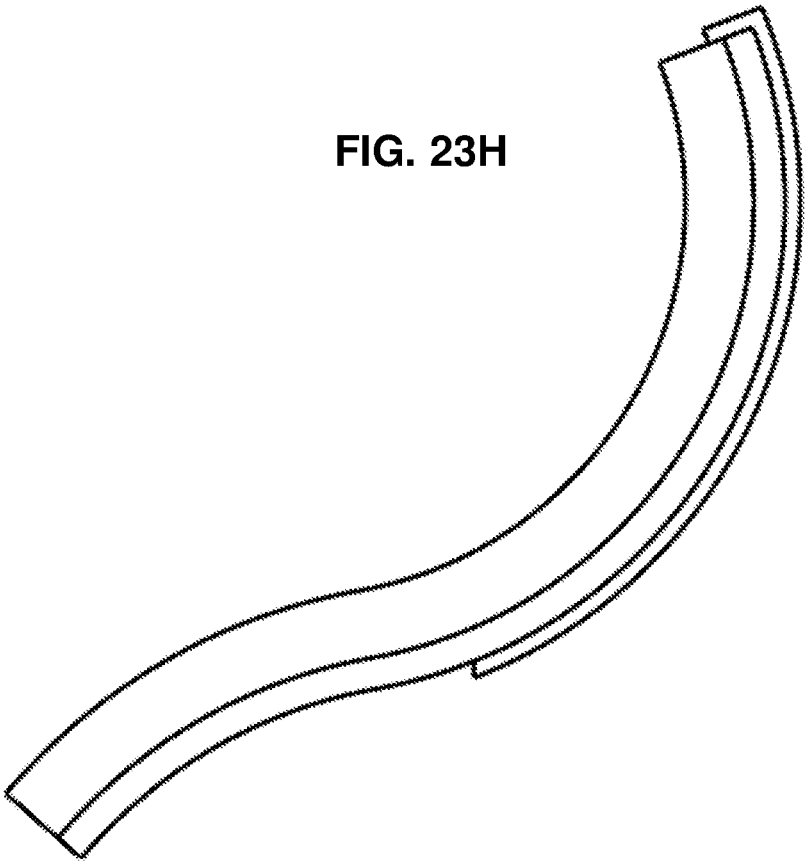

FIGS. 23A-23H show the aesthetic design of an example embodiment of a splash guard with FIG. 23A showing a top perspective view thereof; FIG. 23B showing a bottom perspective view thereof; FIG. 23C showing a front view thereof; FIG. 23D showing a back view thereof; FIG. 23E showing a top plan view thereof; FIG. 23F showing a bottom plan view thereof; FIG. 23G showing a left view thereof; and FIG. 23H showing a right view thereof.

Figure 24A:
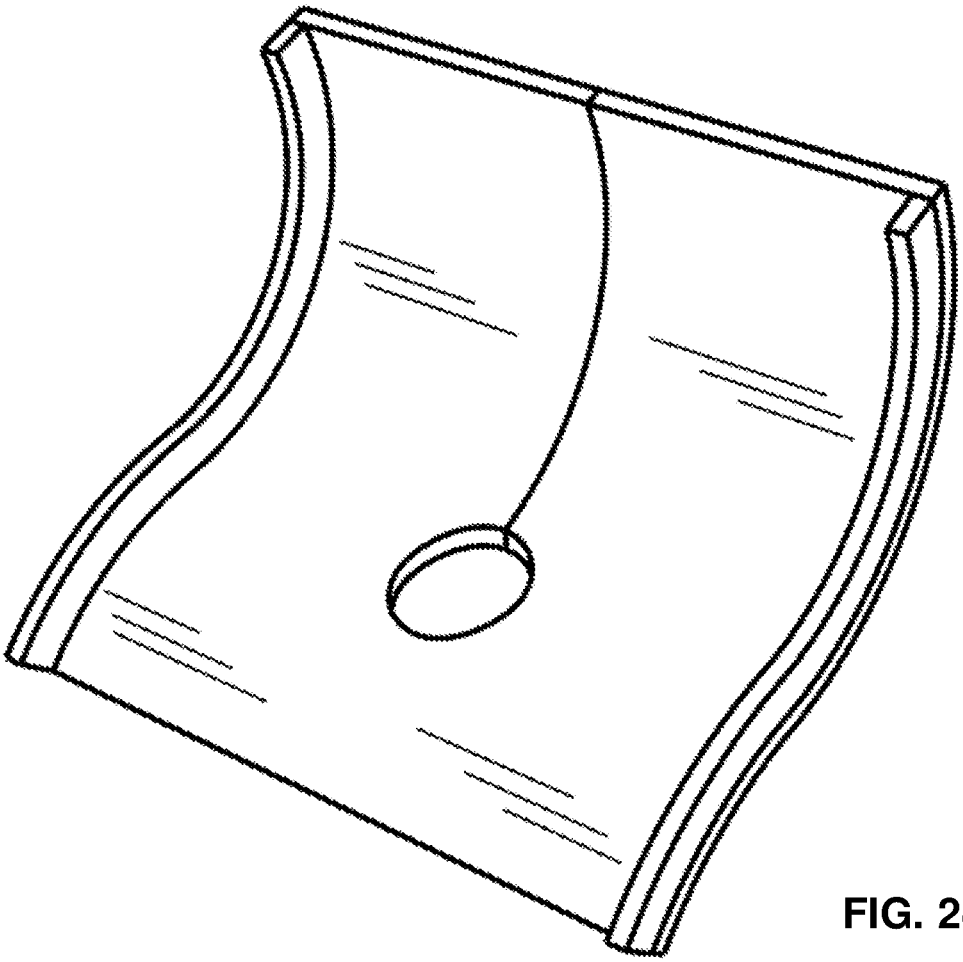
FIGS. 24A-24H show the aesthetic design of an example embodiment of a splash guard with FIG. 24A showing a top perspective view thereof.
Figure 24B:
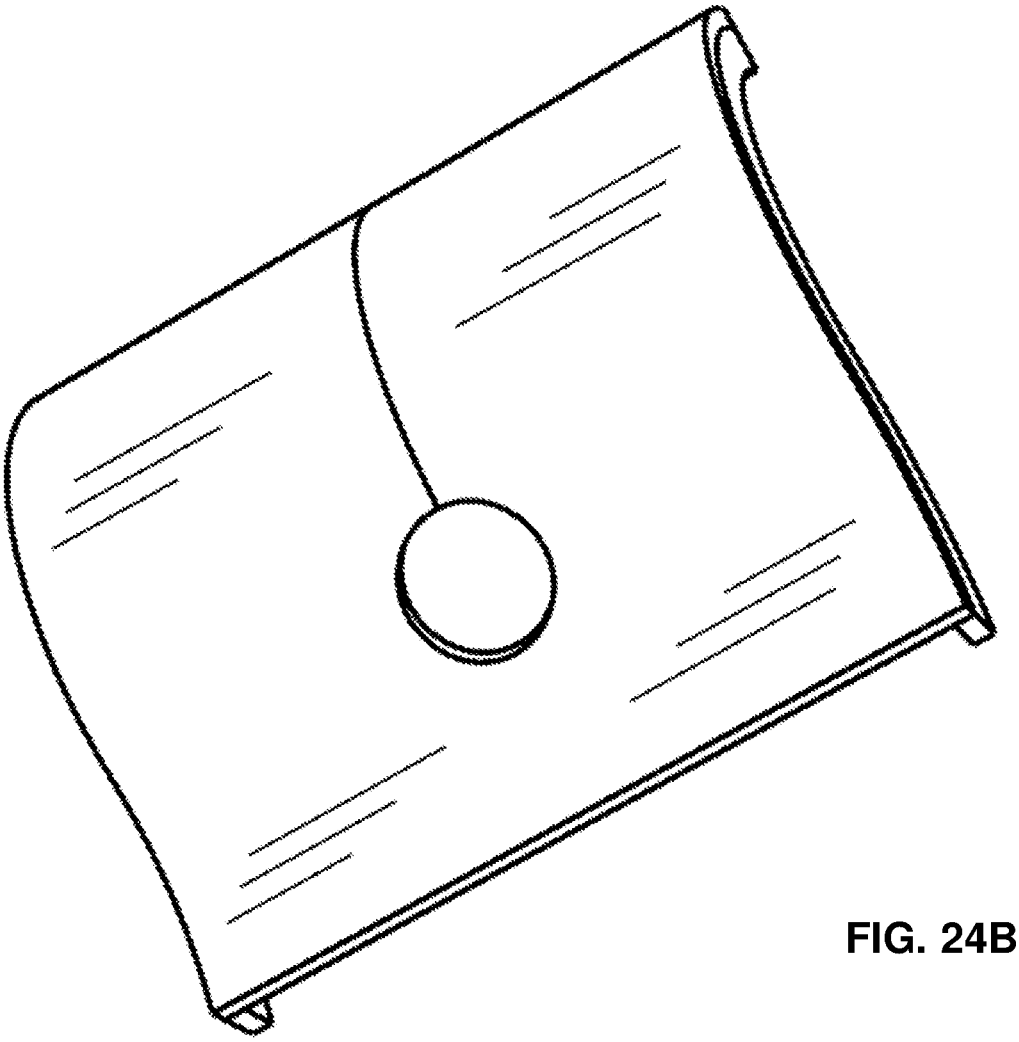
Figure 24C:
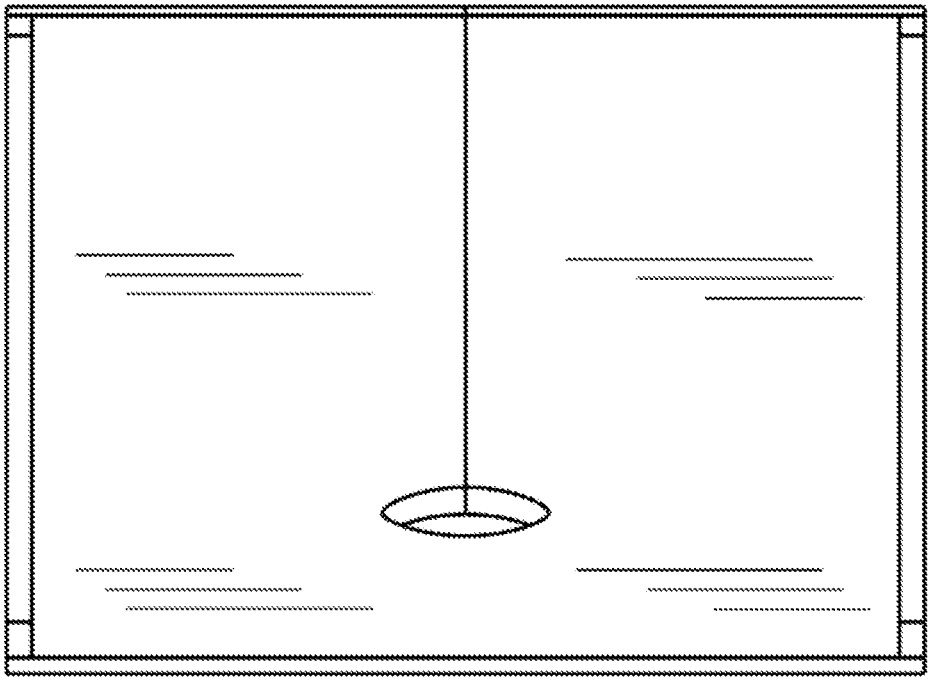
Figure 24D:
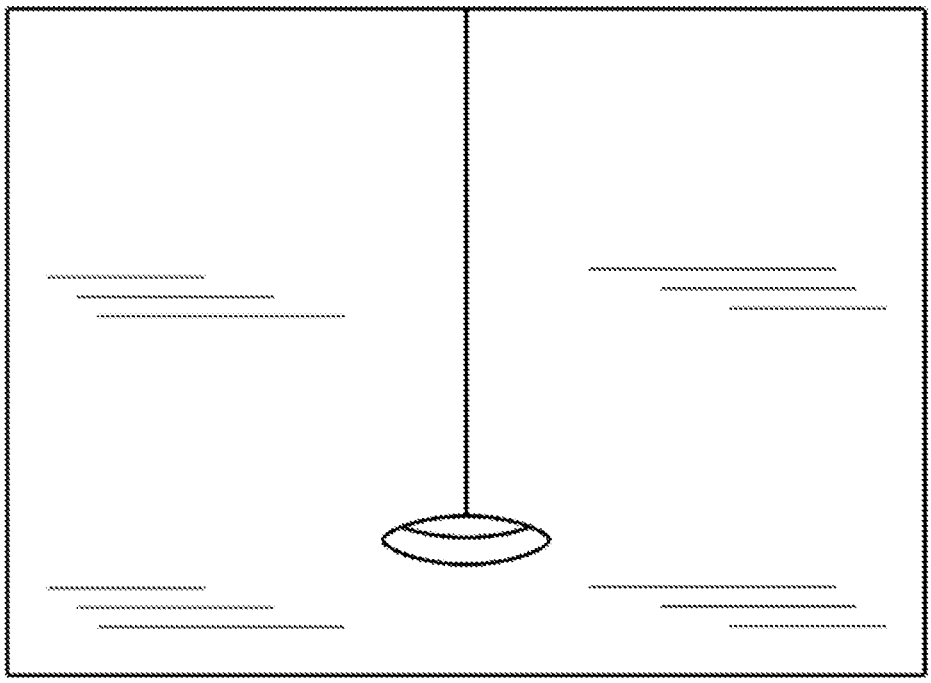
Figure 24E:
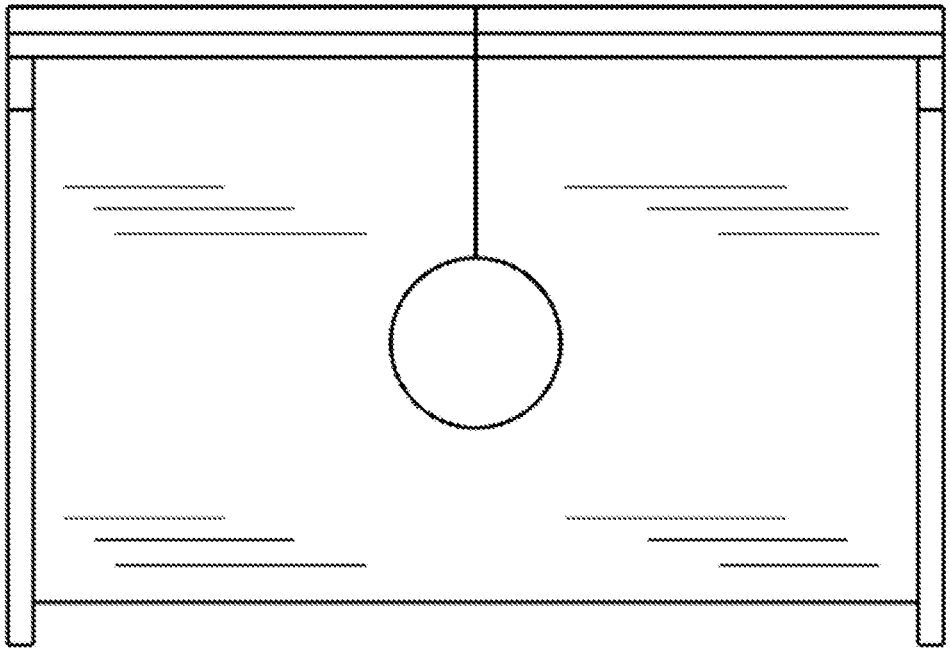
Figure 24F:
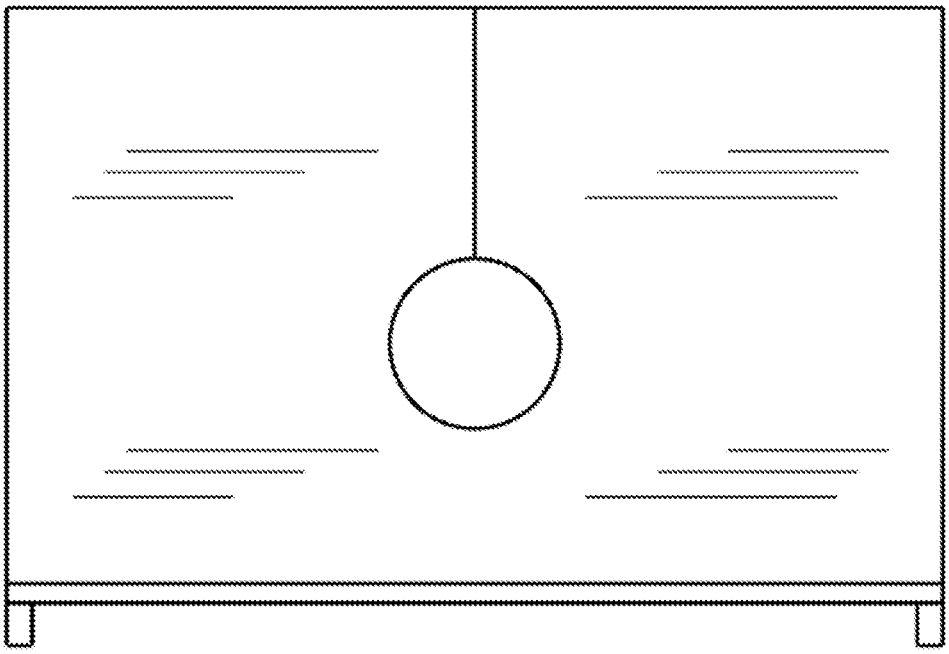
Figure 24G:
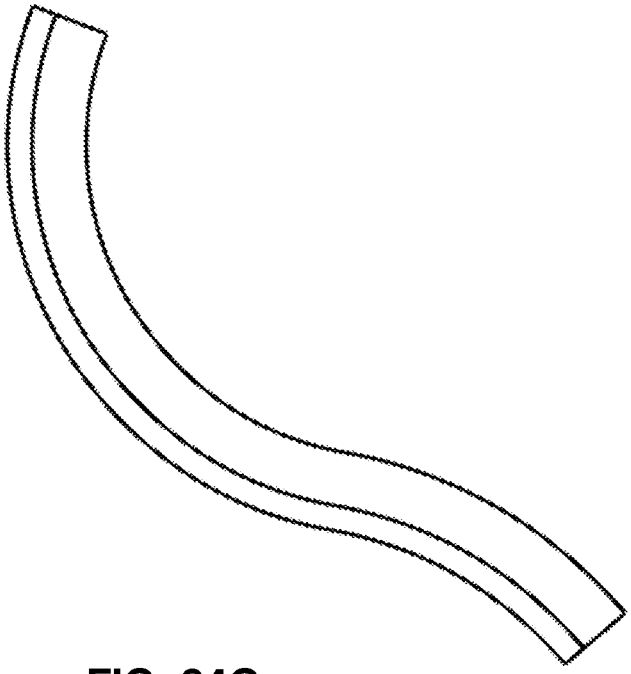
Figure 24H:
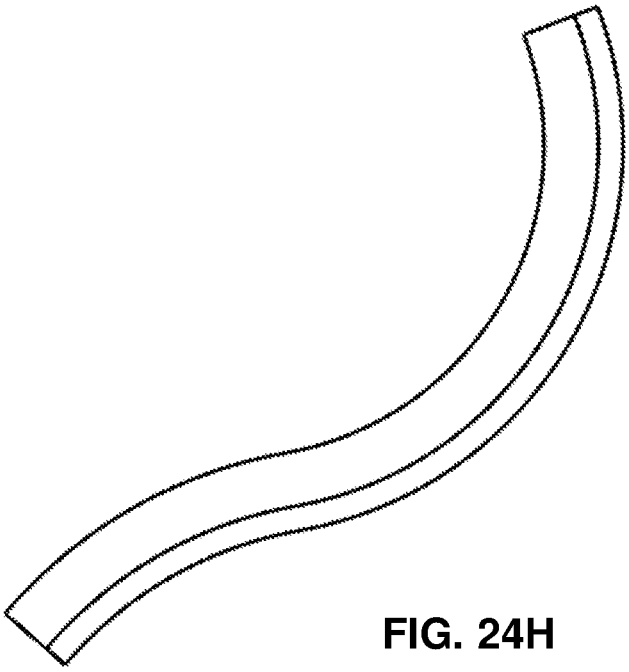

FIGS. 24A-24H show the aesthetic design of an example embodiment of a splash guard with FIG. 24A showing a top perspective view thereof; FIG. 24B showing a bottom perspective view thereof; FIG. 24C showing a front view thereof; FIG. 24D showing a back view thereof; FIG. 24E showing a top plan view thereof; FIG. 24F showing a bottom plan view thereof; FIG. 24G showing a left view thereof; and FIG. 24H showing a right view thereof.

Figure 25A:
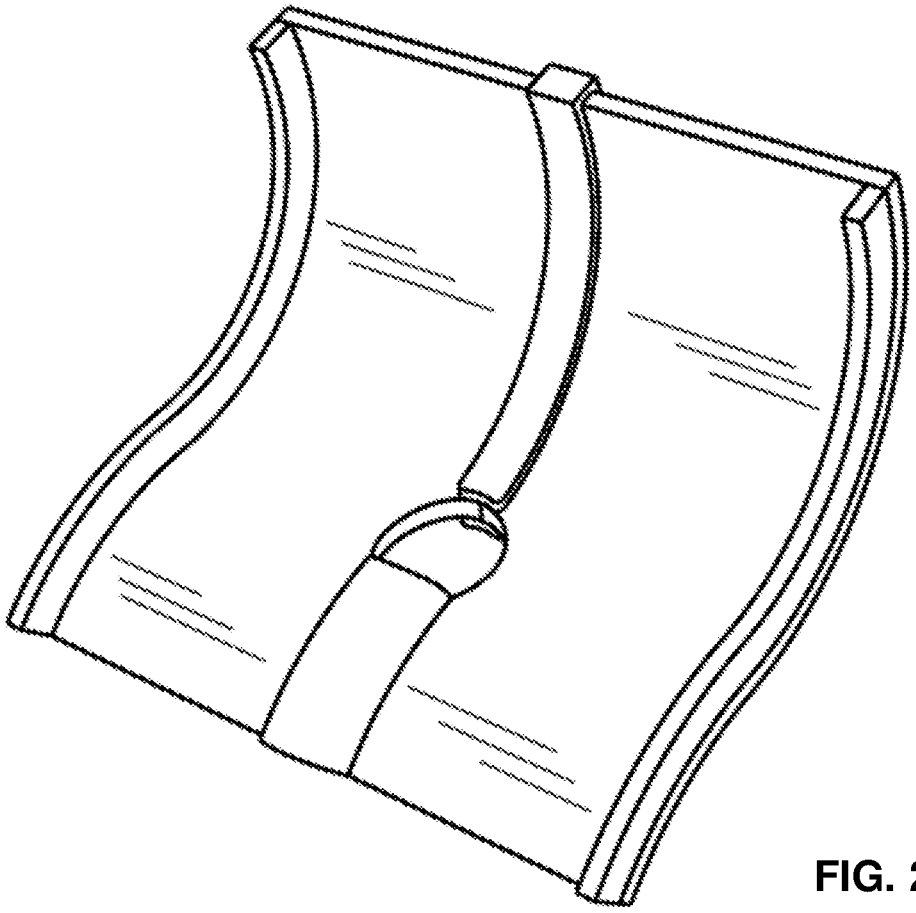
FIGS. 25A-25H show the aesthetic design of an example embodiment of a splash guard with FIG. 25A showing a top perspective view thereof.
Figure 25B:
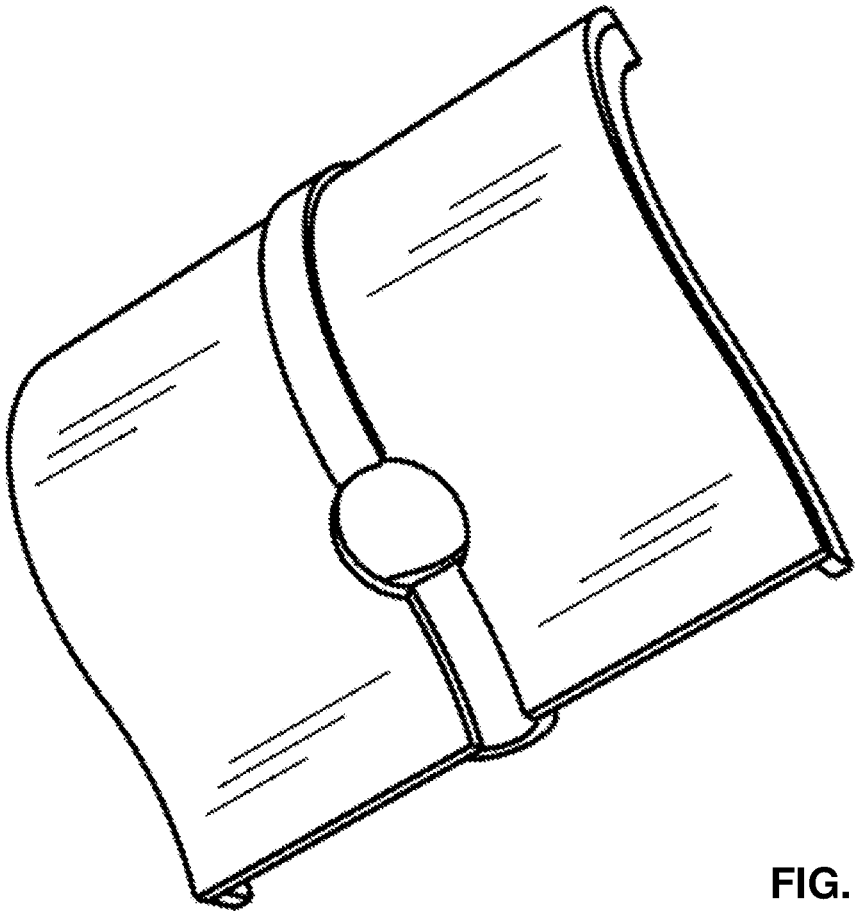
Figure 25C:
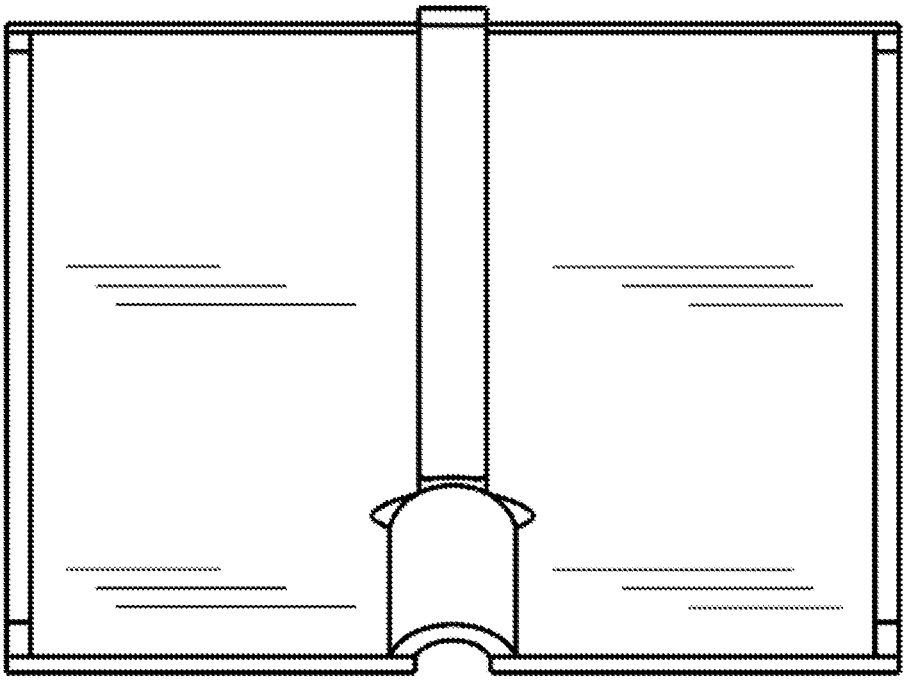
Figure 25D:
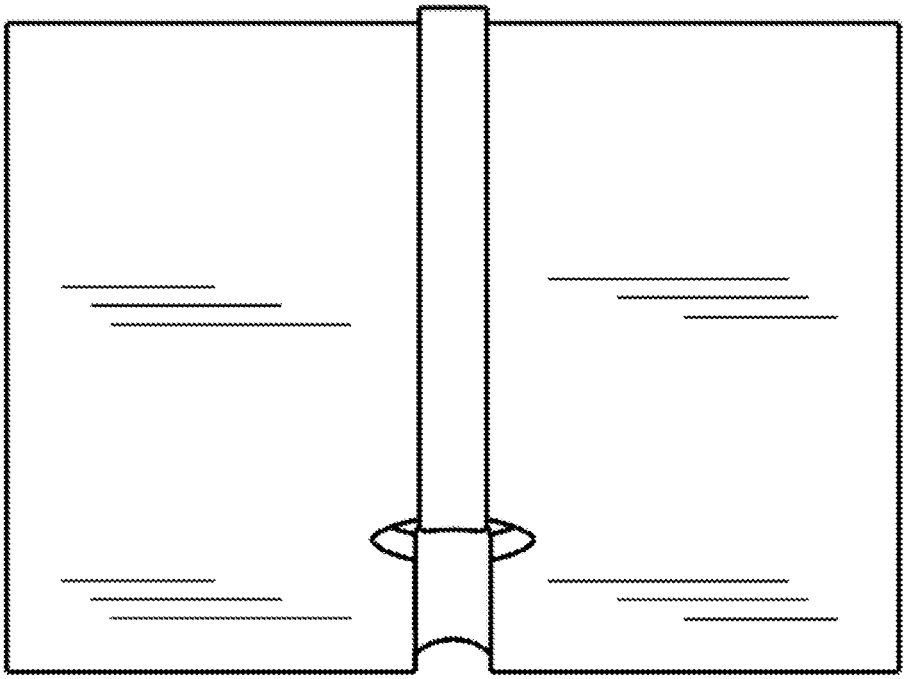
Figure 25E:
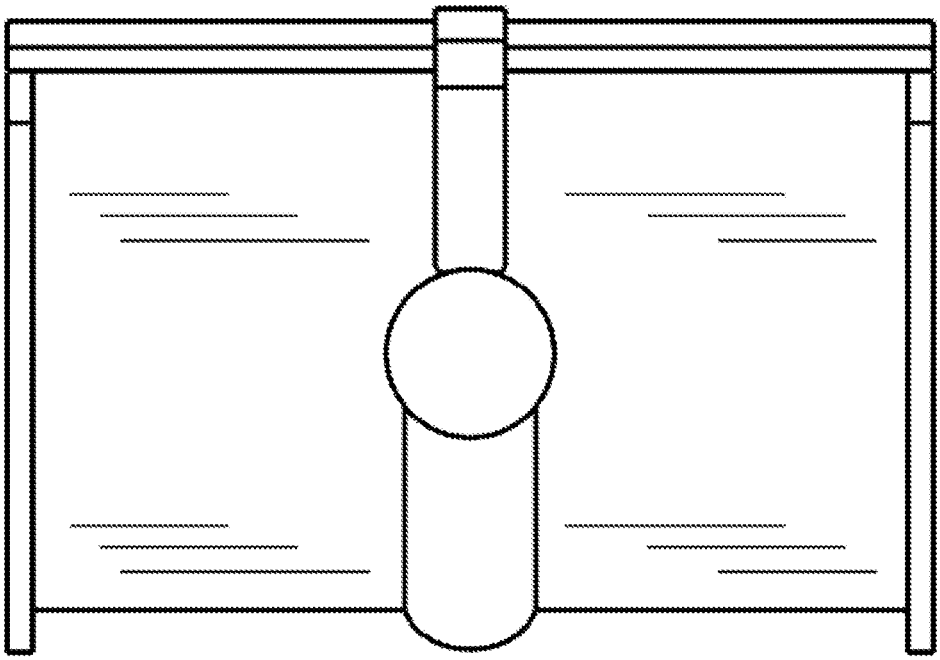
Figure 25F:
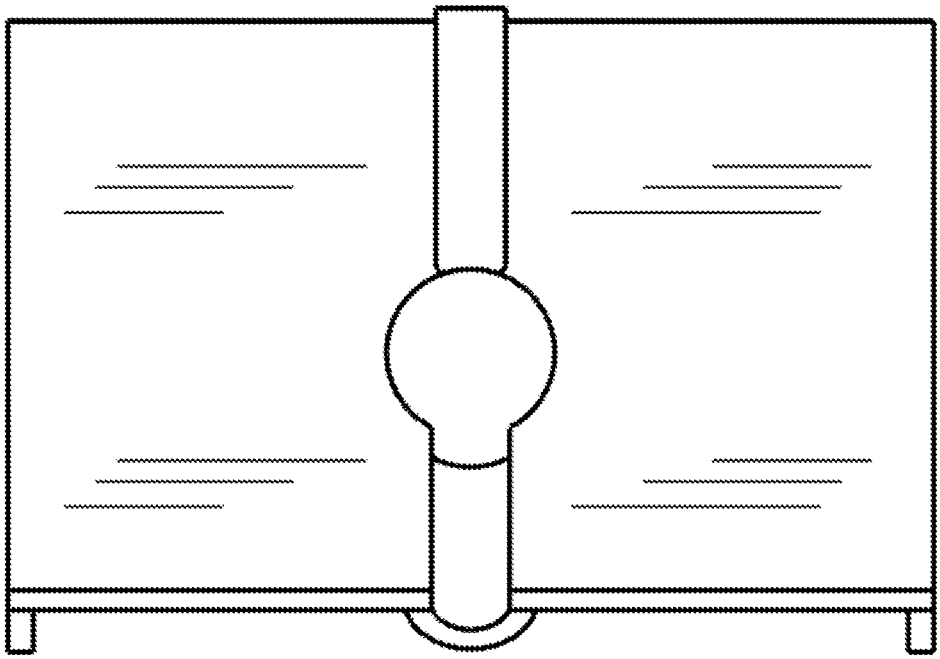
Figure 25G:
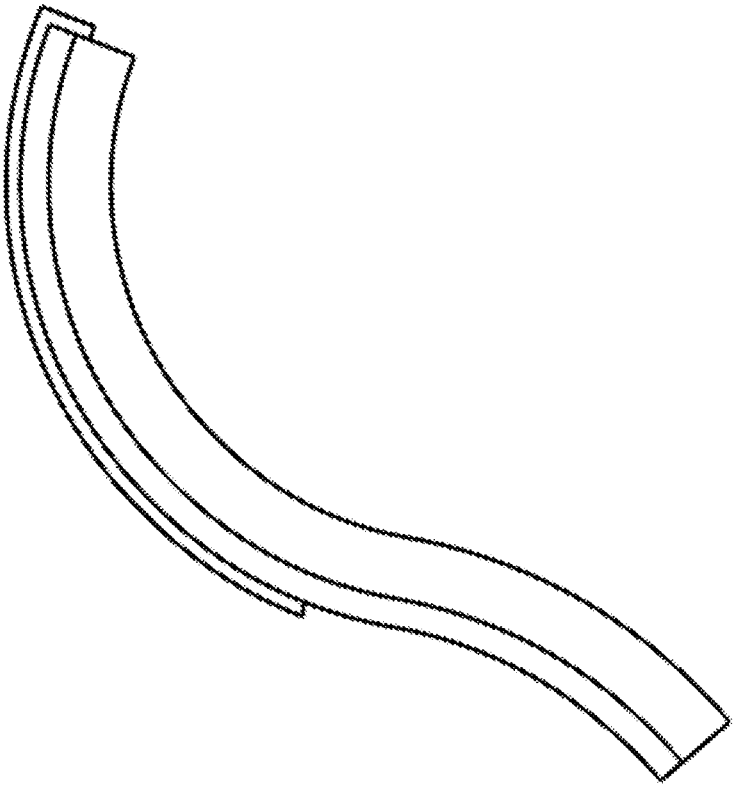
Figure 25H:
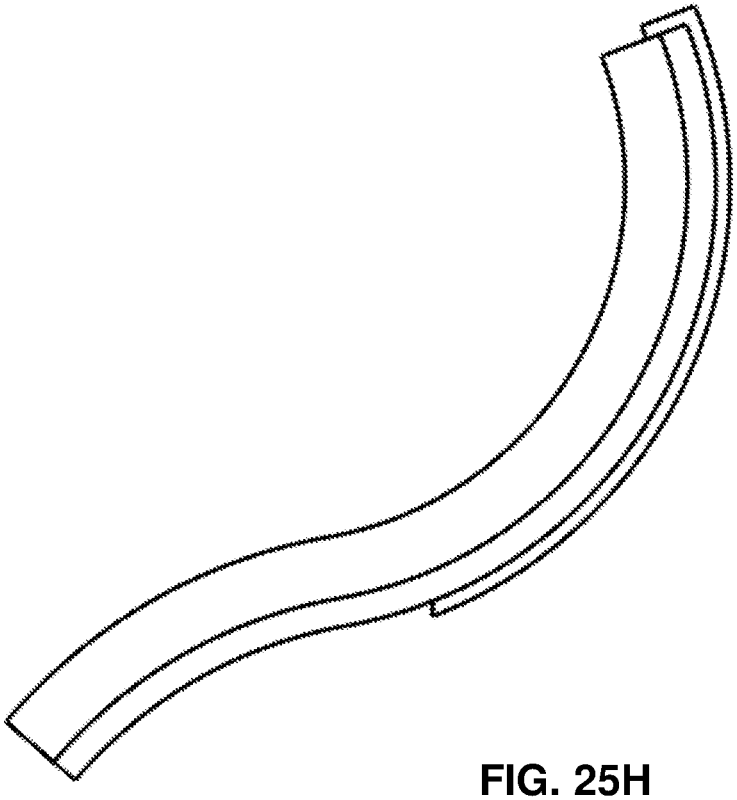

FIGS. 25A-25H show the aesthetic design of an example embodiment of a splash guard with FIG. 25A showing a top perspective view thereof; FIG. 25B showing a bottom perspective view thereof; FIG. 25C showing a front view thereof; FIG. 25D showing a back view thereof; FIG. 25E showing a top plan view thereof; FIG. 25F showing a bottom plan view thereof; FIG. 25G showing a left view thereof; and FIG. 25H showing a right view thereof.

Figure 26A:
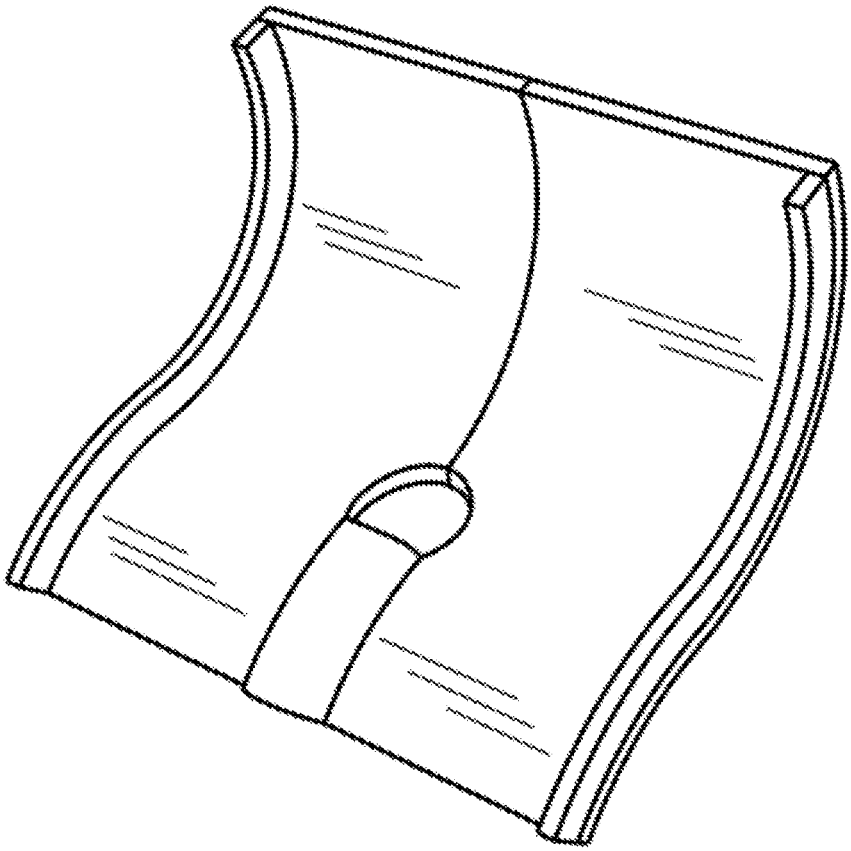
FIGS. 26A-26H show the aesthetic design of an example embodiment of a splash guard with FIG. 26A showing a top perspective view thereof.
Figure 26B:
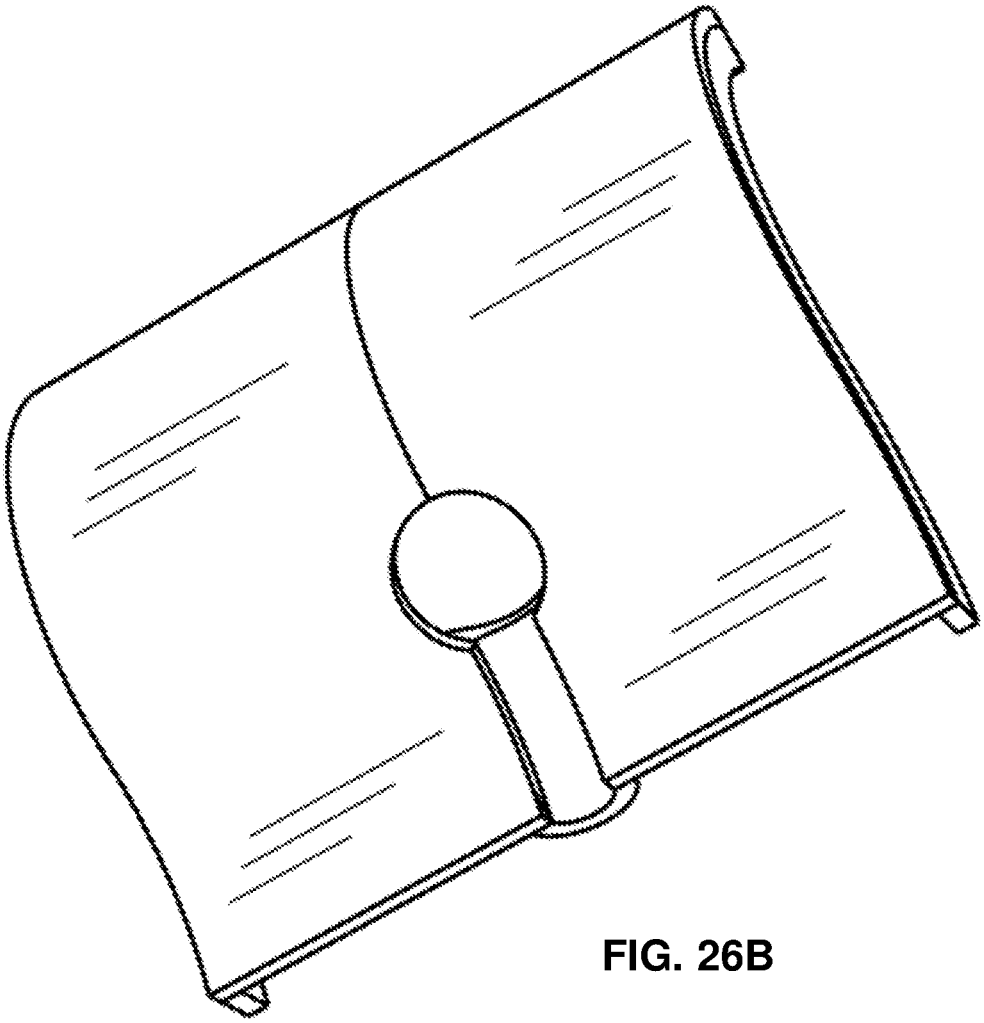
Figure 26C:
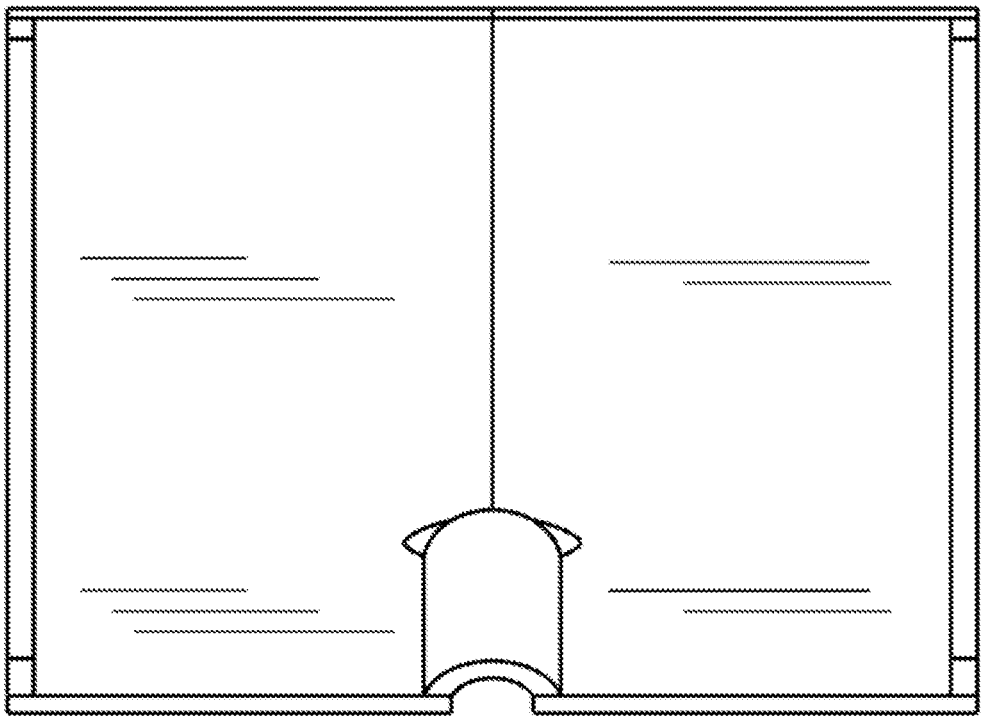
Figure 26D:
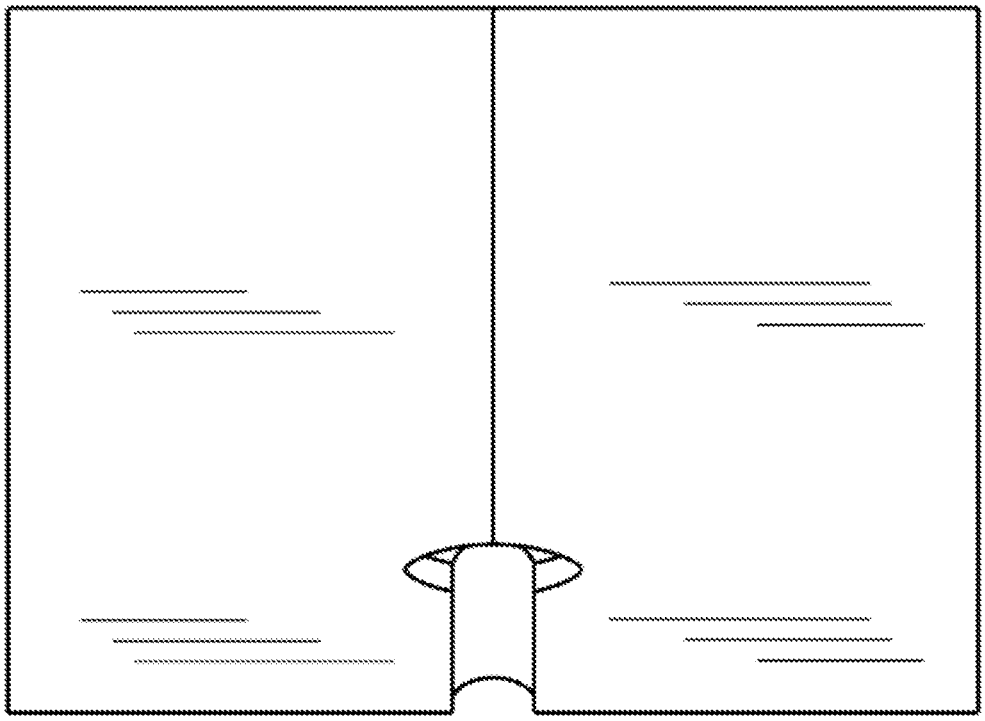
Figure 26E:
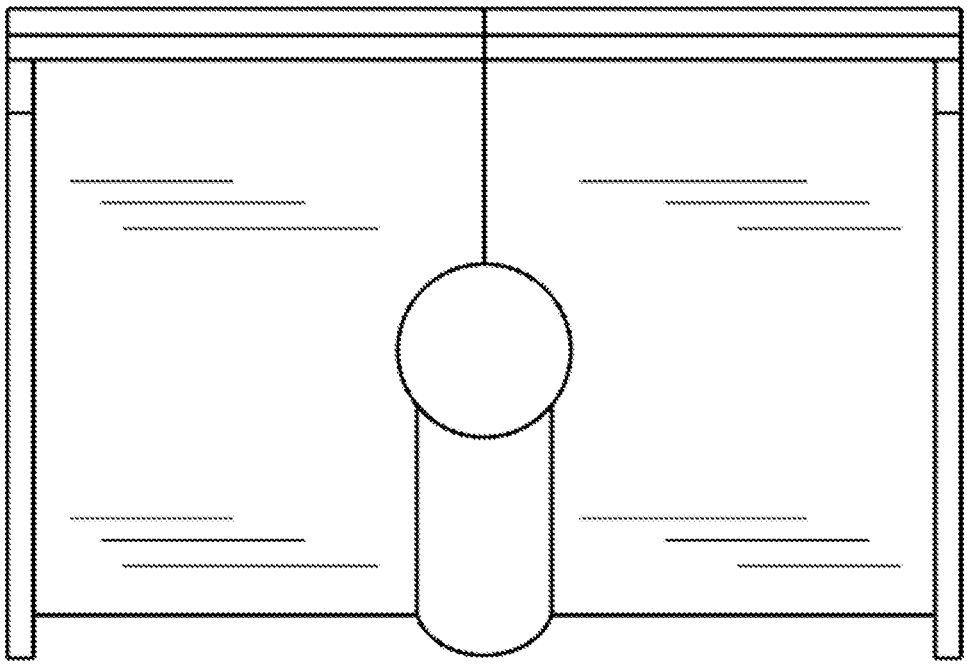
Figure 26F:
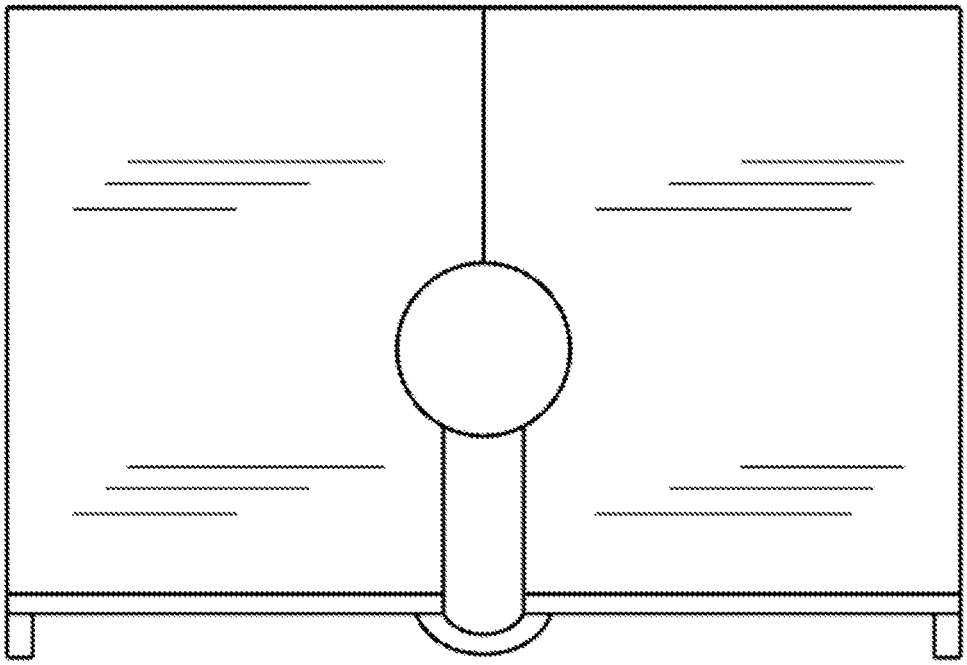
Figure 26G:
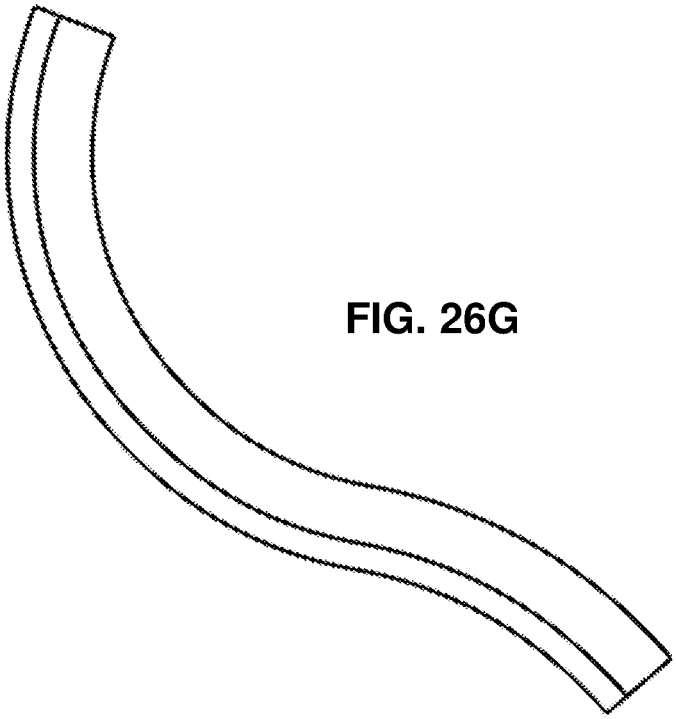
Figure 26H:
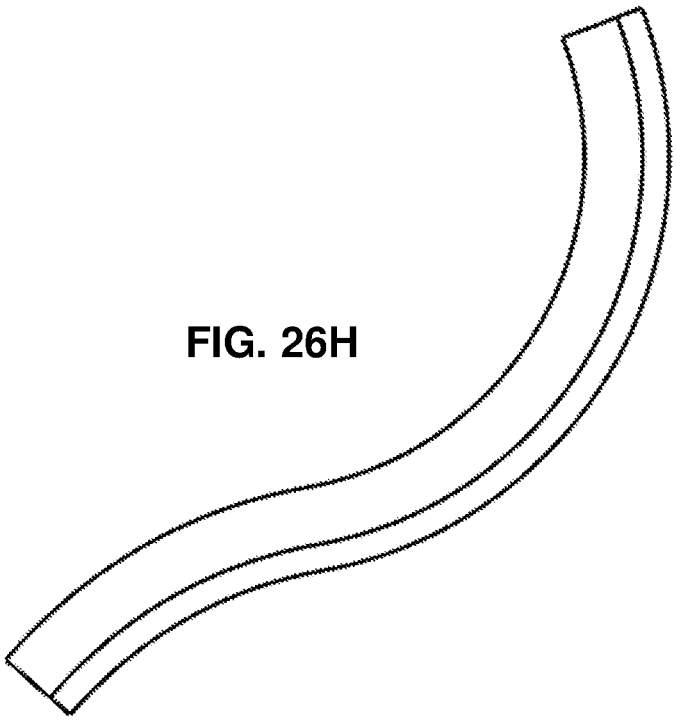

FIGS. 26A-26H show the aesthetic design of an example embodiment of a splash guard with FIG. 26A showing a top perspective view thereof; FIG. 26B showing a bottom perspective view thereof; FIG. 26C showing a front view thereof; FIG. 26D showing a back view thereof; FIG. 26E showing a top plan view thereof; FIG. 26F showing a bottom plan view thereof; FIG. 26G showing a left view thereof; and FIG. 26H showing a right view thereof.

Figure 27A:
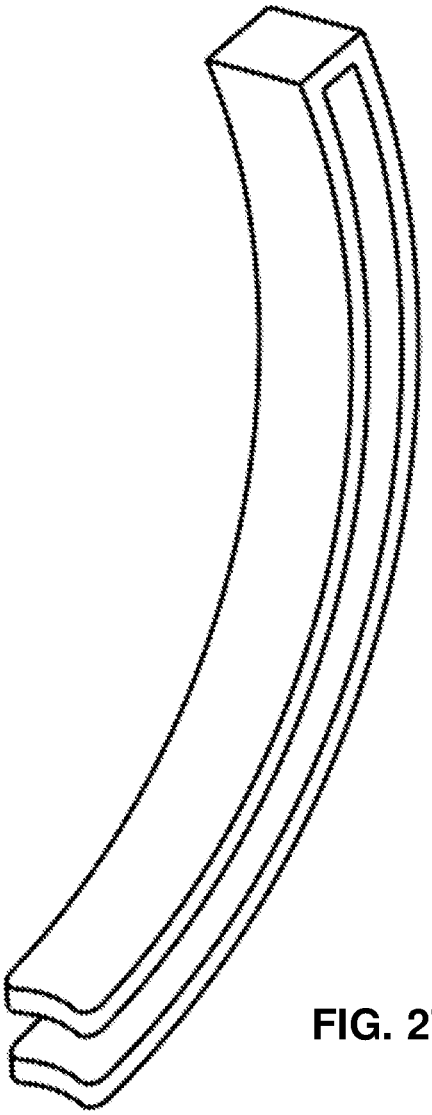
FIGS. 27A-27H show the aesthetic design of an example embodiment of a slit guard with FIG. 27A showing a top perspective view thereof.
Figure 27B:
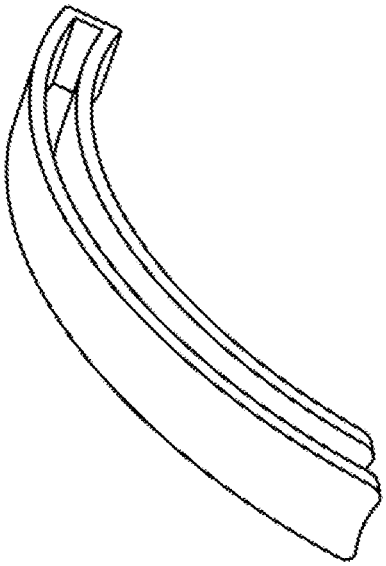
Figure 27C:
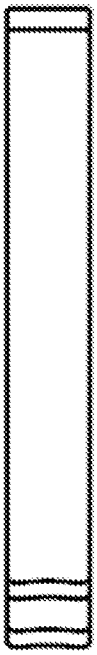
Figure 27D:
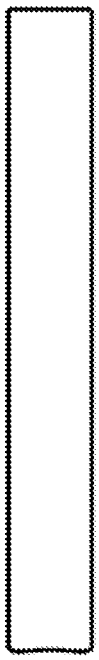
Figure 27E:
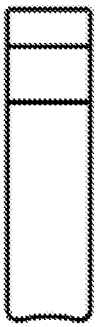
Figure 27F:
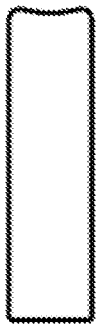
Figure 27G:
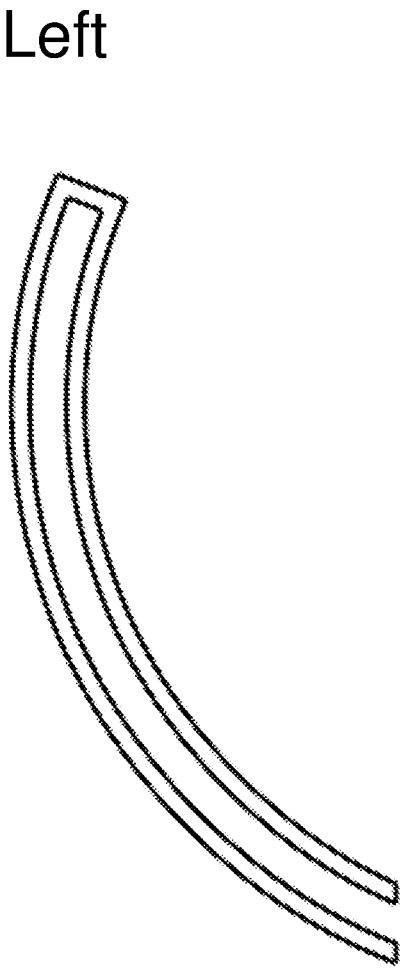
Figure 27H:
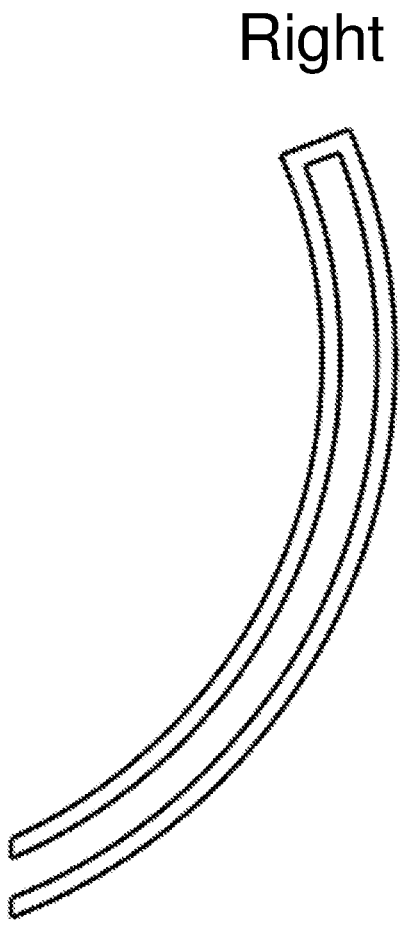

FIGS. 27A-27H show the aesthetic design of an example embodiment of a slit guard with FIG. 27A showing a top perspective view thereof; FIG. 27B showing a bottom perspective view thereof; FIG. 27C showing a front view thereof; FIG. 27D showing a back view thereof; FIG. 27E showing a top plan view thereof; FIG. 27F showing a bottom plan view thereof; FIG. 27G showing a left view thereof; and FIG. 27H showing a right view thereof.

Figure 28A:
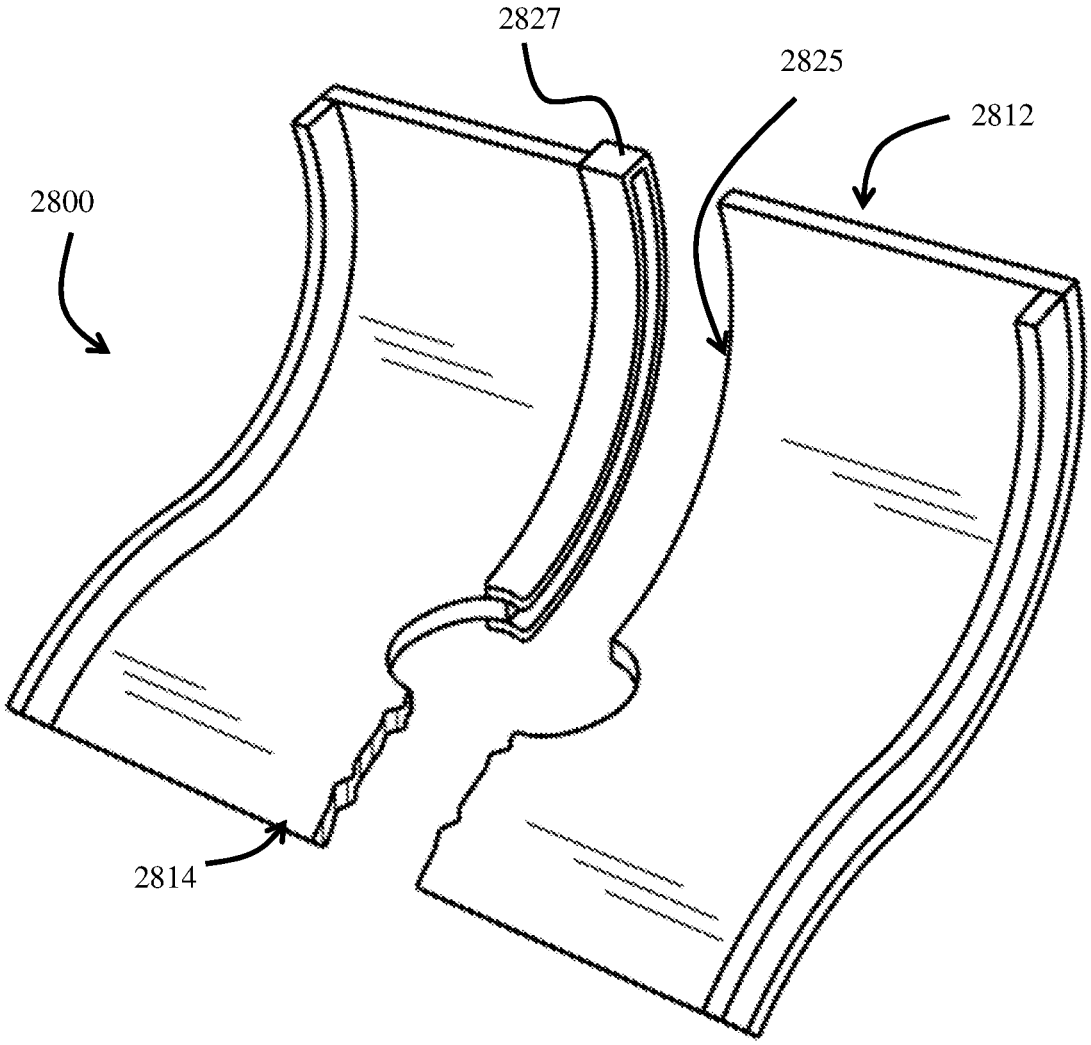
FIGS. 28A-28C show views of example embodiments of the splash guard illustrating how the lower portion of the splash guard towards the drip end is rigidly connected and the upper end is not connected at the slit.
Figure 28B:
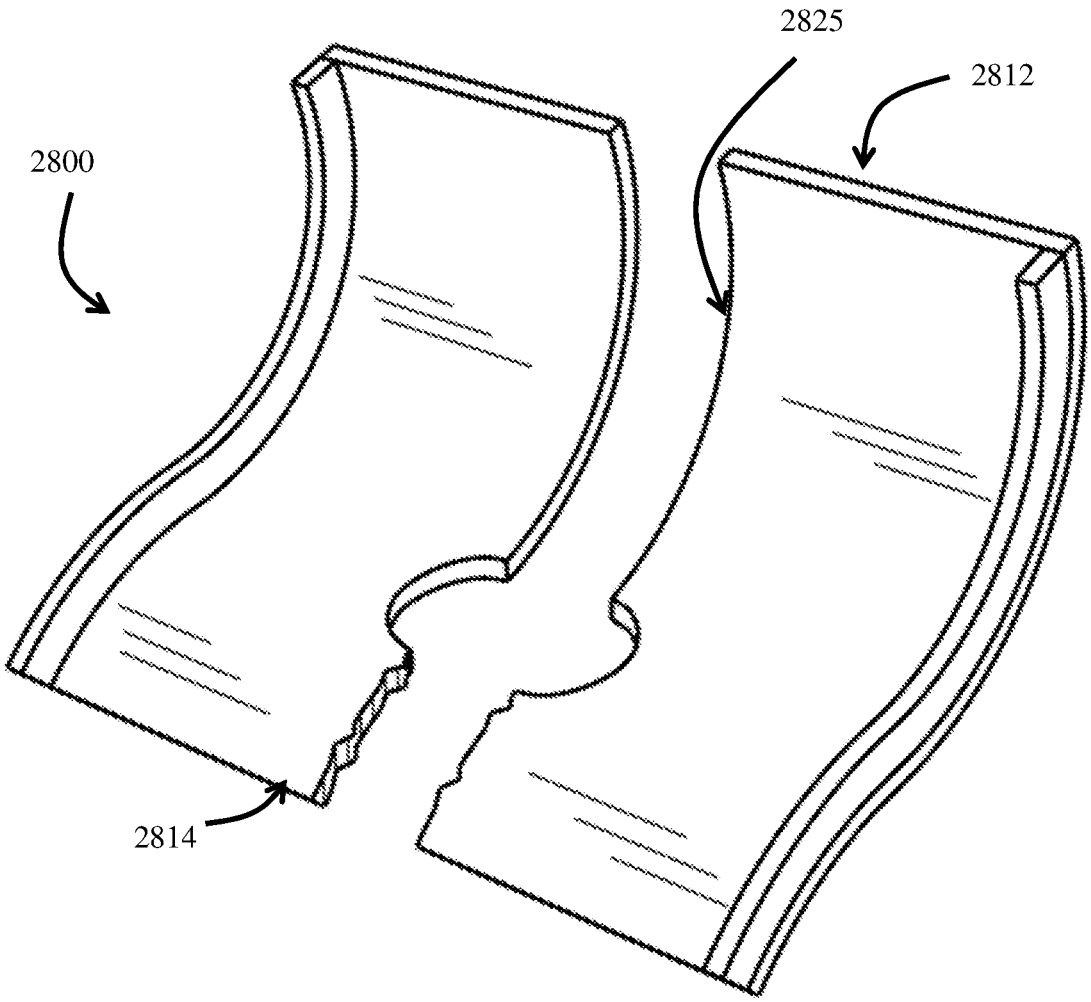
Figure 28C:
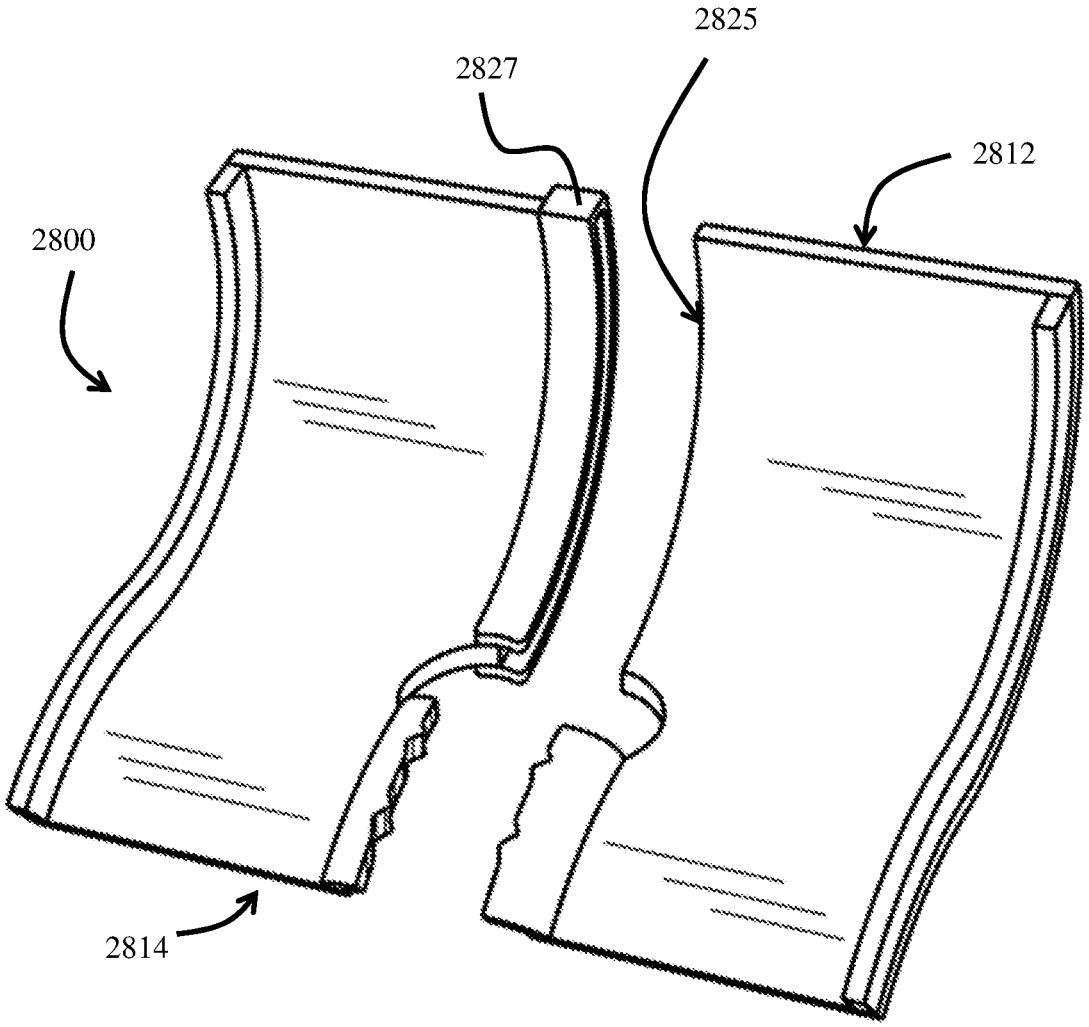

FIGS. 28A-28C show views of example embodiments of the splash guard 2800 illustrating how the lower portion of the splash guard towards the drip end 2814 is connected (separated here for illustration purposes only) and the upper end 2812 is not connected at the slit 2825. FIG. 28A shows how the upper end 2812 is configured to be coupled with the slit guard 2827 to form a water repellent seal. FIG. 28B shows how the upper end 2812 is configured to be coupled along the split. FIG. 28C shows how the upper end 2812 is configured to be coupled with the slit guard 2827.

Figure 29A:
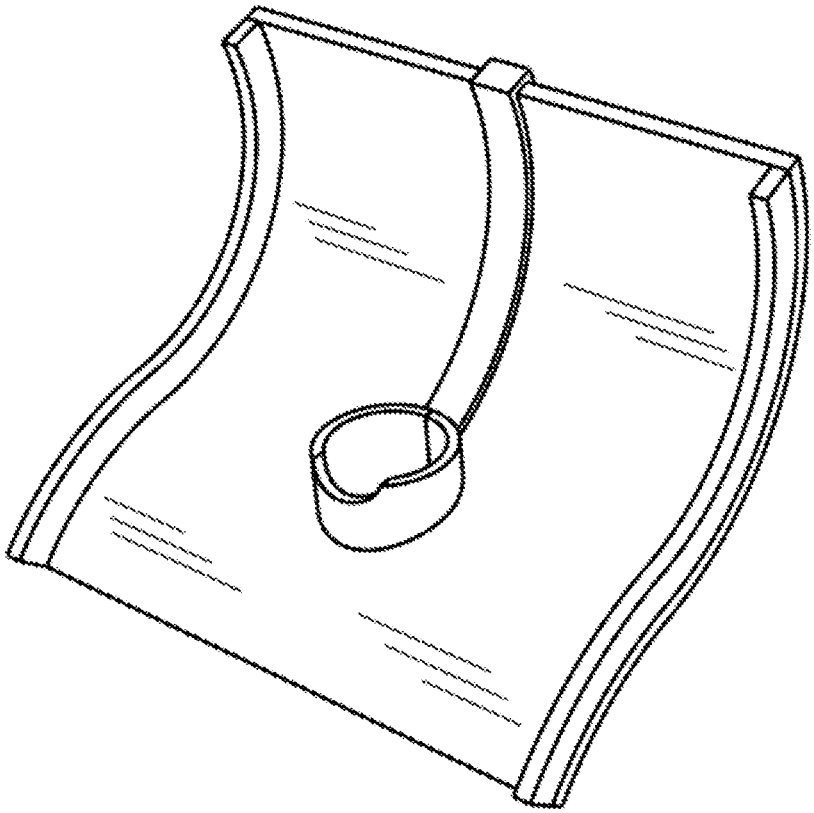
FIGS. 29A-29H show the aesthetic design of an example embodiment of a splash guard with a slit guard and a collar having protrusions (here guide pins) with FIG. 29A showing a top perspective view thereof.
Figure 29B:
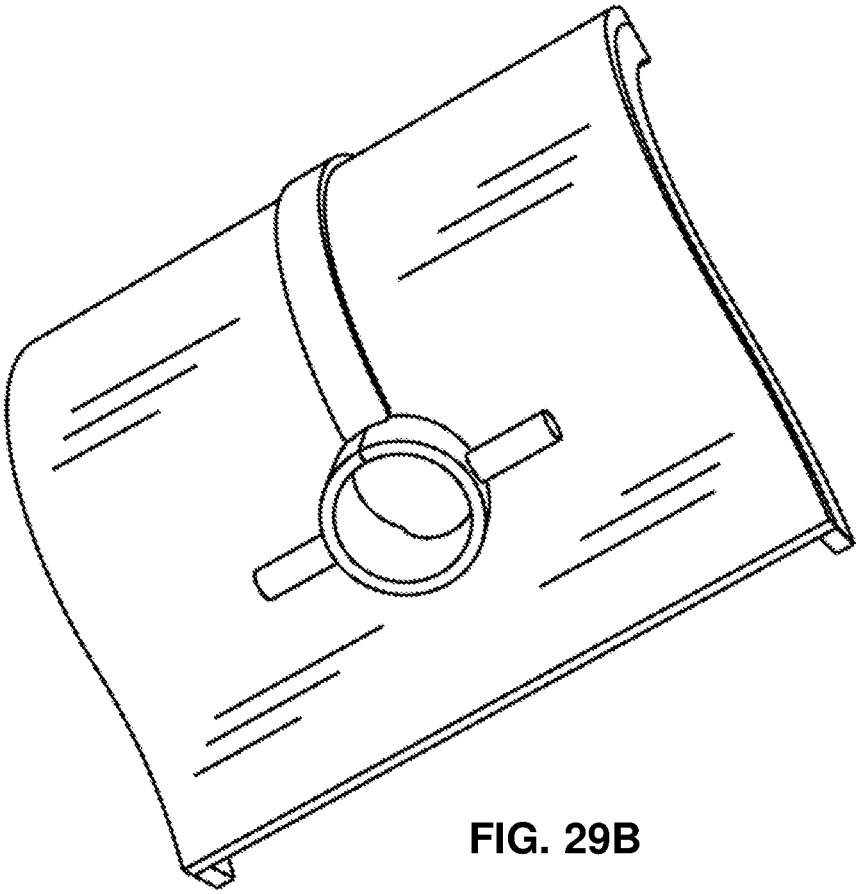
Figure 29C:
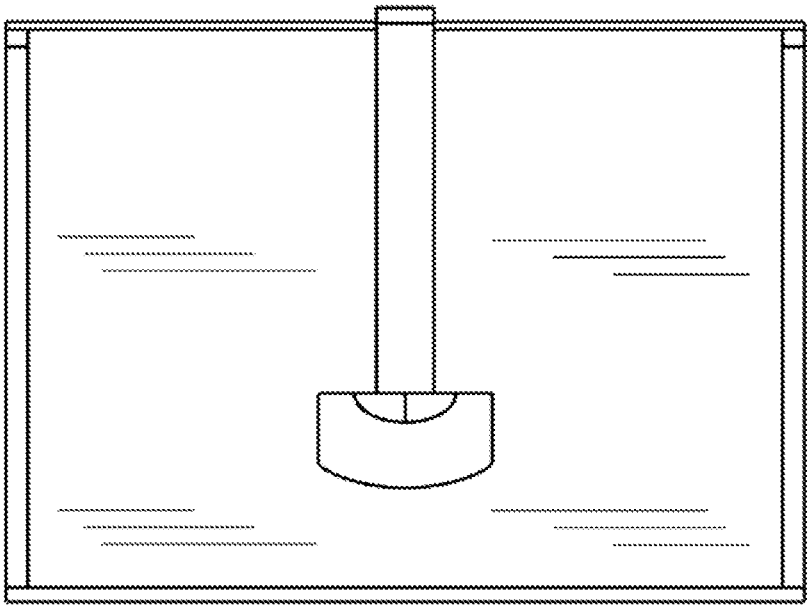
Figure 29D:
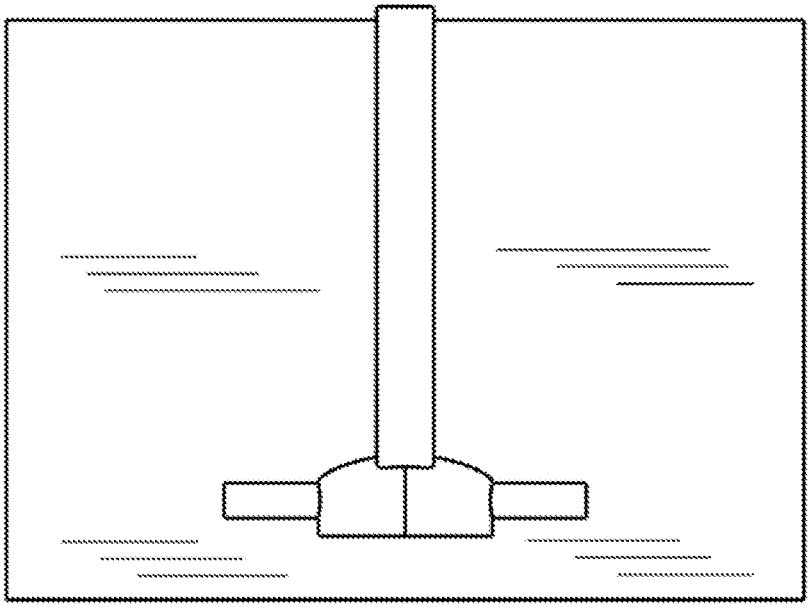
Figure 29E:
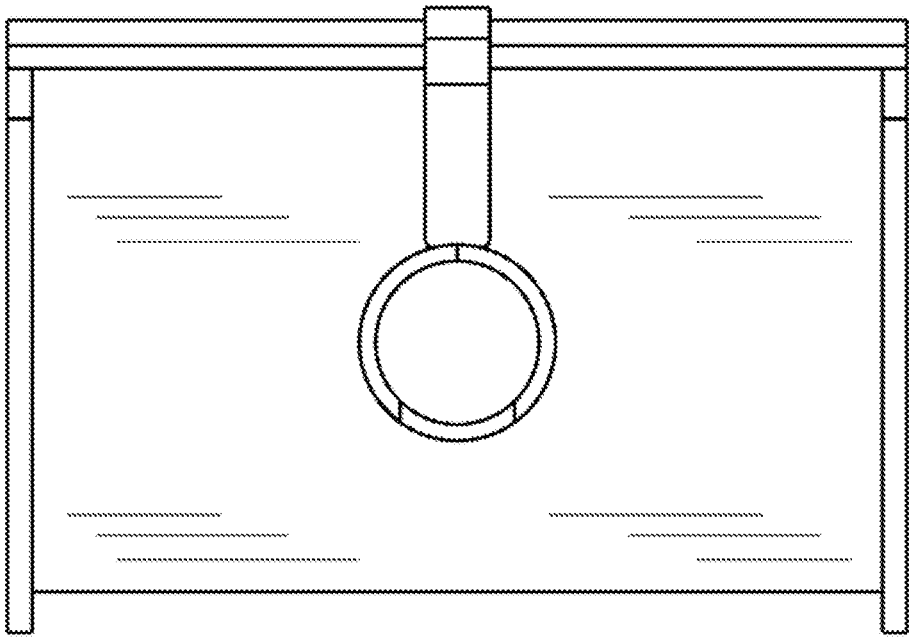
Figure 29F:
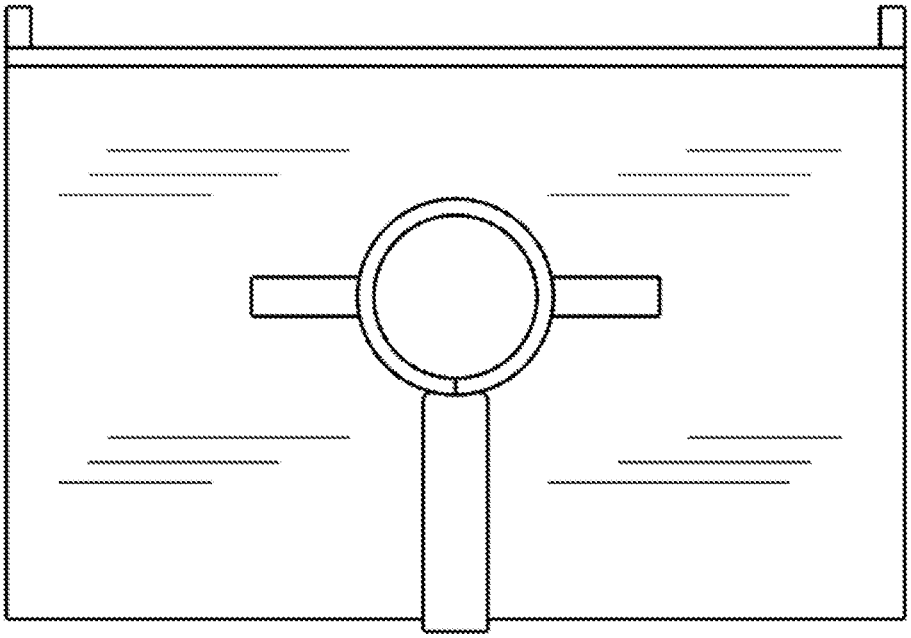
Figure 29G:
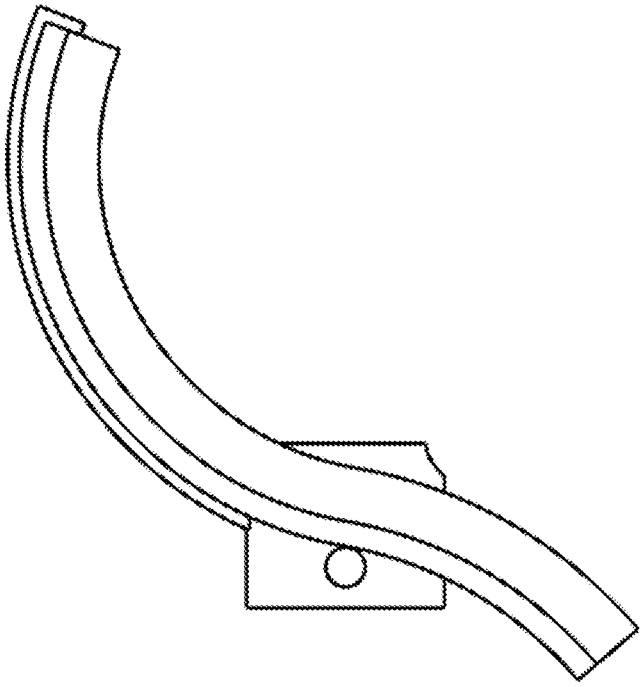
Figure 29H:
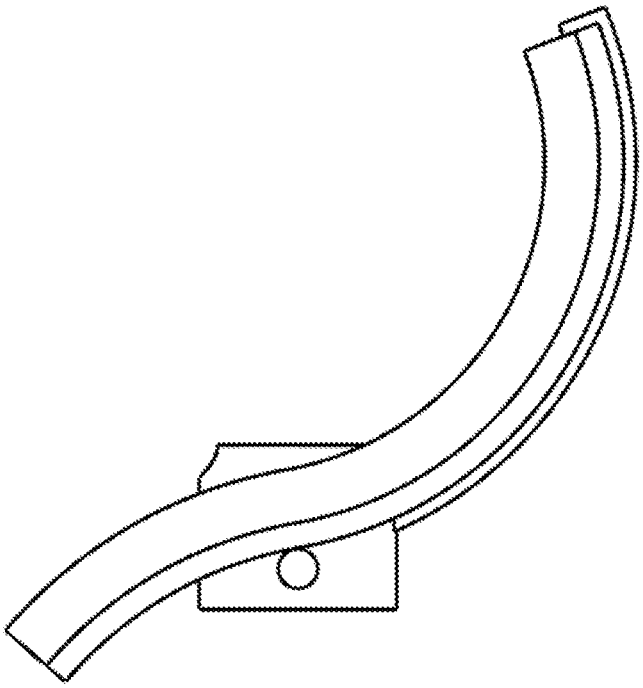

FIGS. 29A-29H show the aesthetic design of an example embodiment of a splash guard with a slit guard and a collar having protrusions (here guide pins) with FIG. 29A showing a top perspective view thereof; FIG. 29B showing a bottom perspective view thereof; FIG. 29C showing a front view thereof; FIG. 29D showing a back view thereof; FIG. 29E showing a top plan view thereof; FIG. 29F showing a bottom plan view thereof; FIG. 29G showing a left view thereof; and FIG. 29H showing a right view thereof.

Figure 30A:
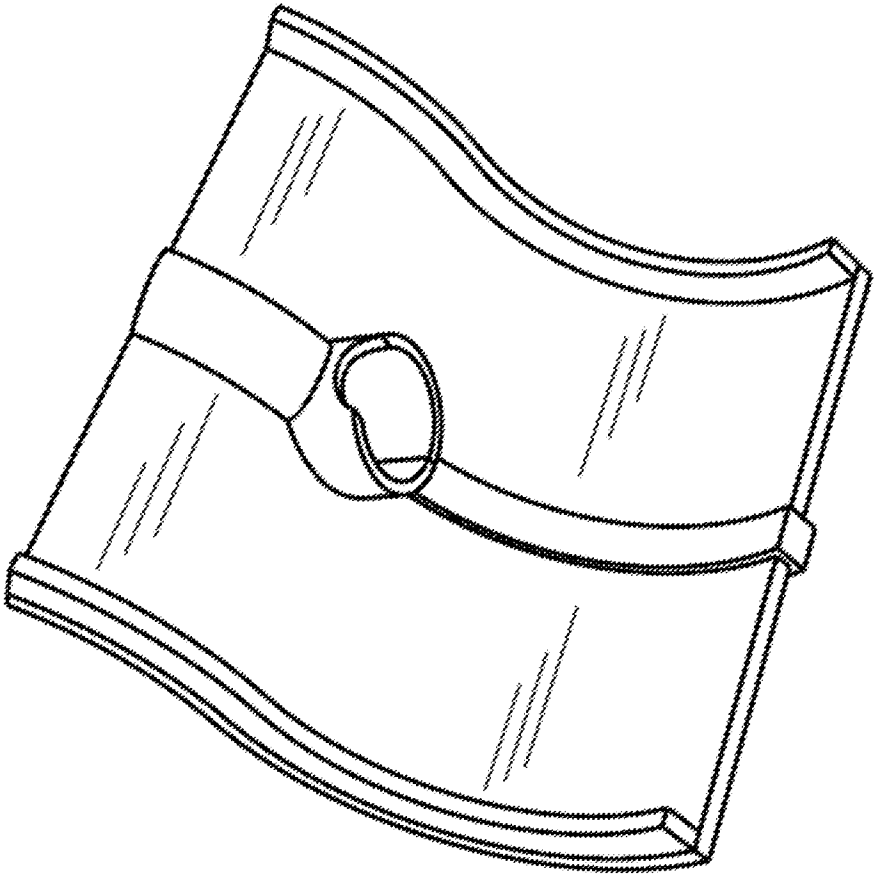
FIGS. 30A-30H show the aesthetic design of an example embodiment of a splash guard with an arcuate ridge, a slit guard and a collar having protrusions with FIG. 30A showing a top perspective view thereof.
Figure 30B:
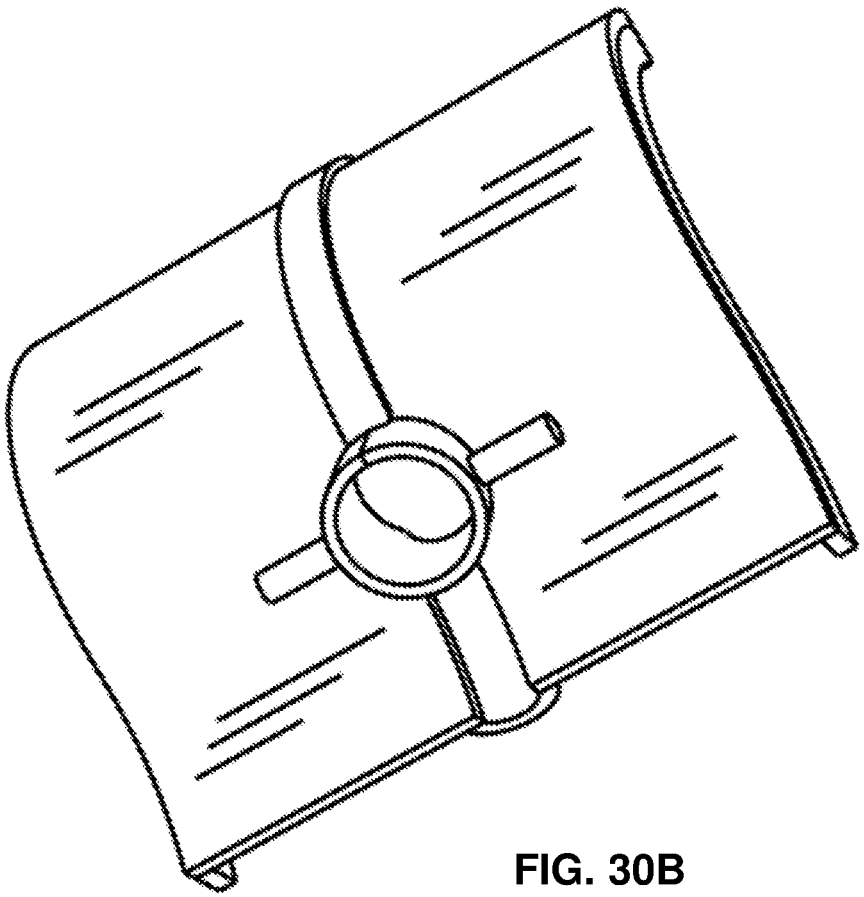
Figure 30C:
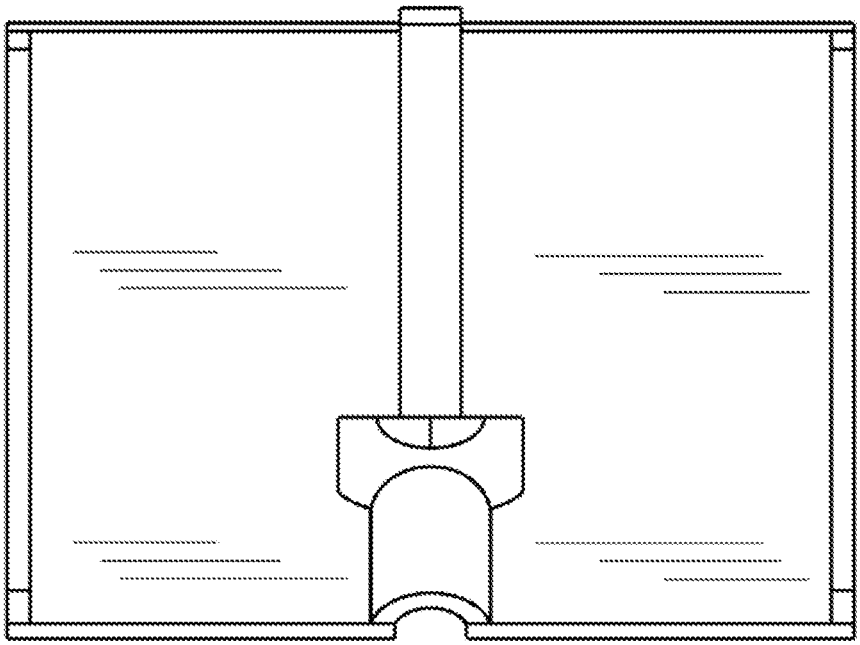
Figure 30D:
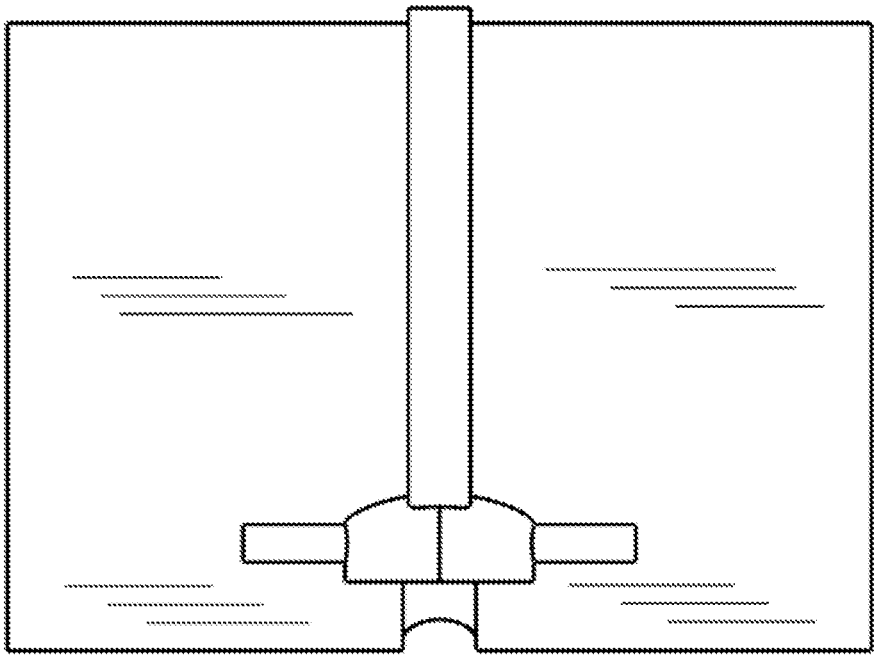
Figure 30E:
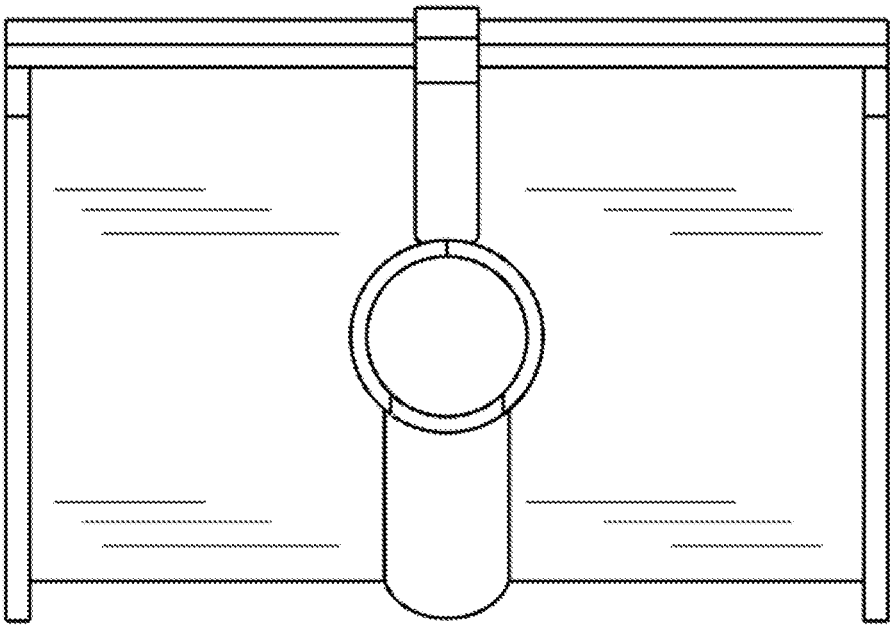
Figure 30F:
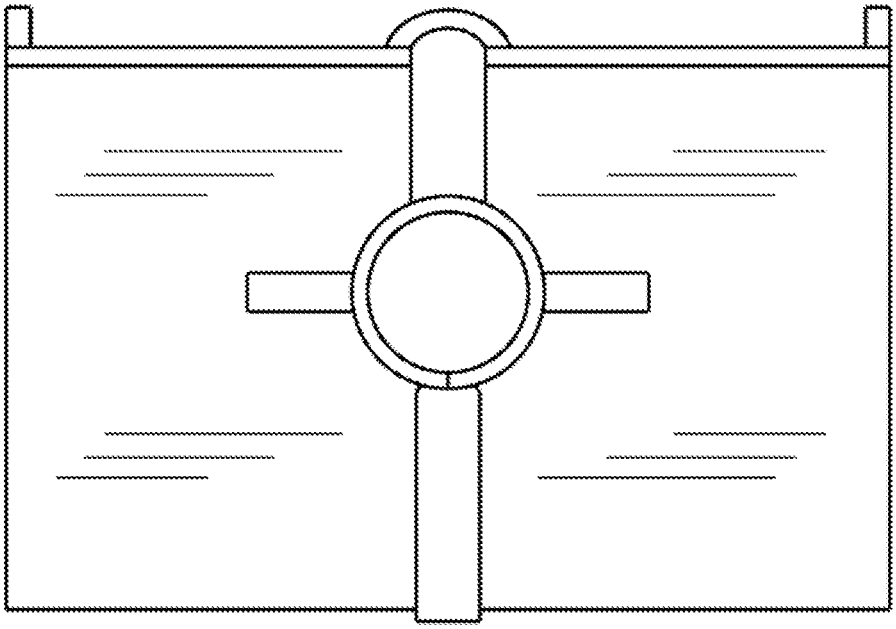
Figure 30G:
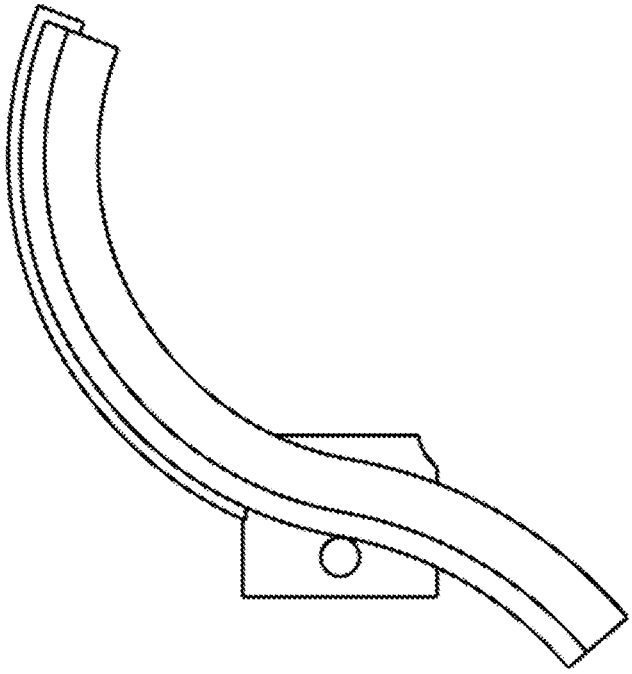
Figure 30H:
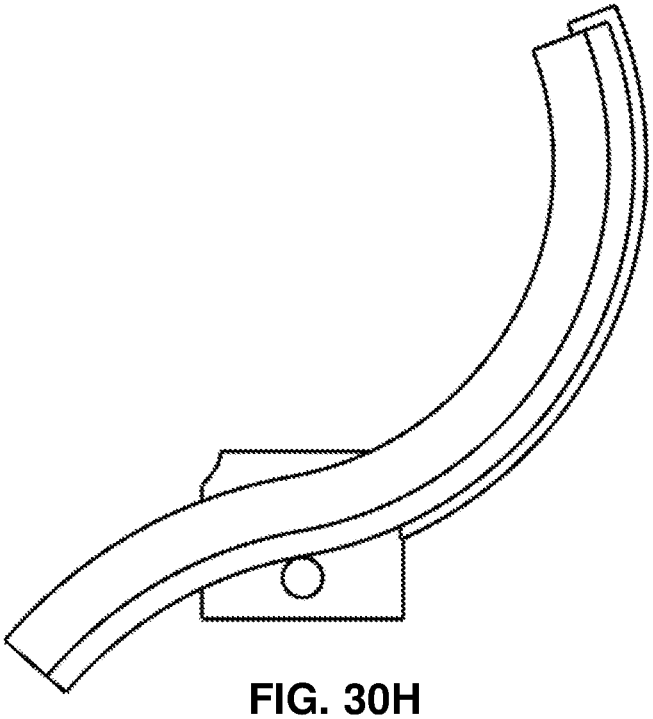

FIGS. 30A-30H show the aesthetic design of an example embodiment of a splash guard with an arcuate ridge, a slit guard and a collar having protrusions (here guide pins) with FIG. 30A showing a top perspective view thereof; FIG. 30B showing a bottom perspective view thereof; FIG. 30C showing a front view thereof; FIG. 30D showing a back view thereof; FIG. 30E showing a top plan view thereof; FIG. 30F showing a bottom plan view thereof; FIG. 30G showing a left view thereof; and FIG. 30H showing a right view thereof.

Figure 31A:
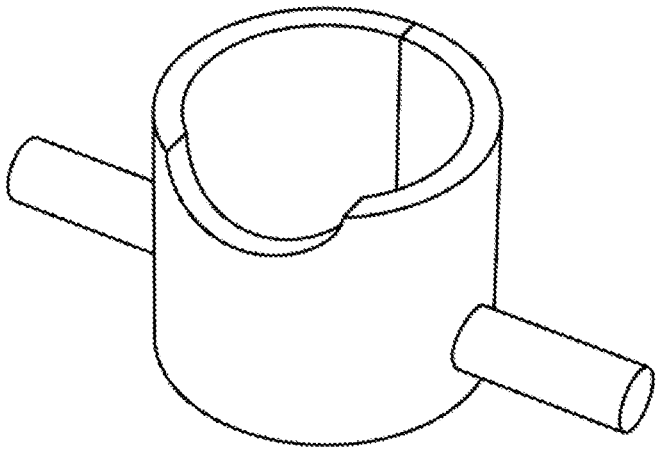
FIGS. 31A-31H show the aesthetic design of an example embodiment of a collar having protrusions (here guide pins), a slit and a notch with FIG. 31A showing a top perspective view thereof.
Figure 31B:
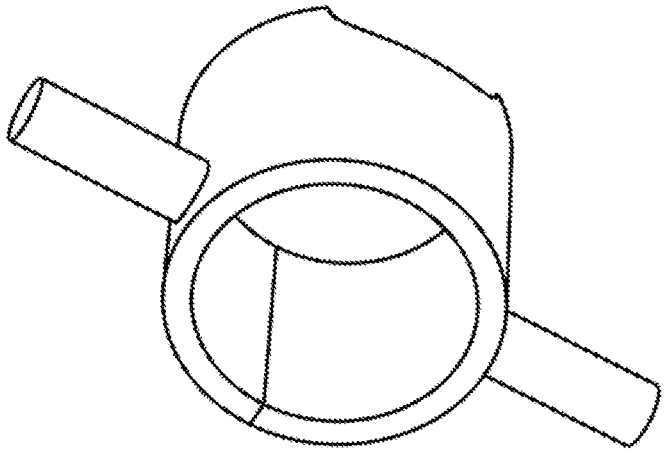
Figure 31C:
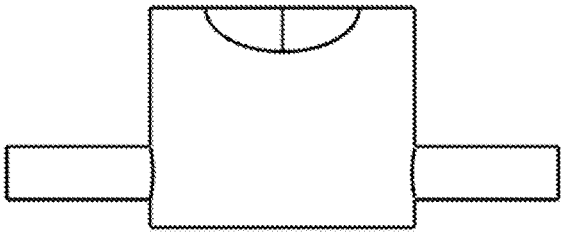
Figure 31D:
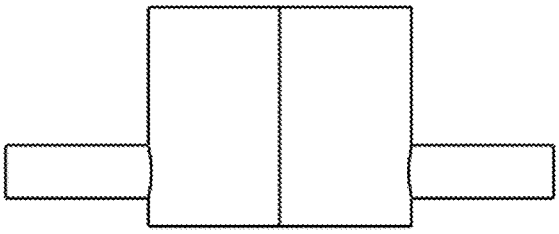
Figure 31E:
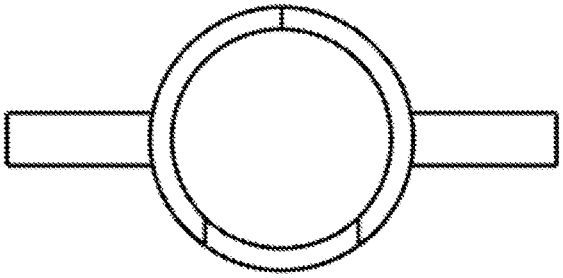
Figure 31F:
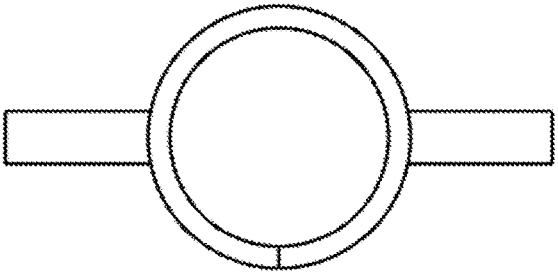
Figure 31G:
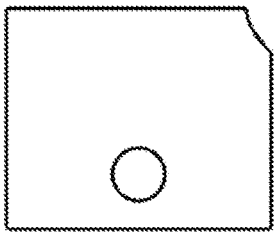
Figure 31H:
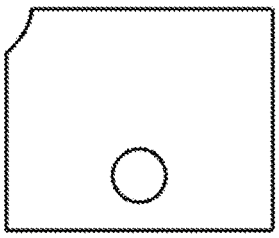

FIGS. 31A-31H show the aesthetic design of an example embodiment of a collar having protrusions (here guide pins), a slit and a notch with FIG. 31A showing a top perspective view thereof; FIG. 31B showing a bottom perspective view thereof; FIG. 31C showing a front view thereof; FIG. 31D showing a back view thereof; FIG. 31E showing a top plan view thereof; FIG. 31F showing a bottom plan view thereof; FIG. 31G showing a left view thereof; and FIG. 31H showing a right view thereof.

Figure 32A:
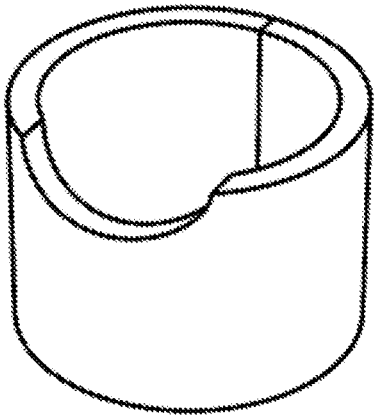
FIGS. 32A-32H show the aesthetic design of an example embodiment of a collar having a slit and a notch with FIG. 32A showing a top perspective view thereof.
Figure 32B:
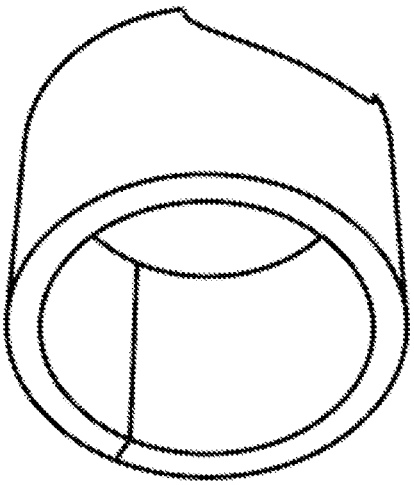
Figure 32C:
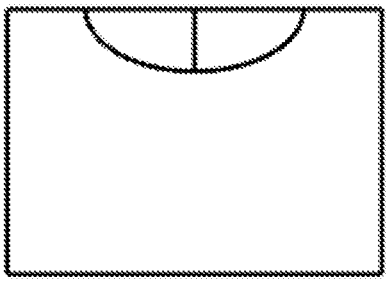
Figure 32D:
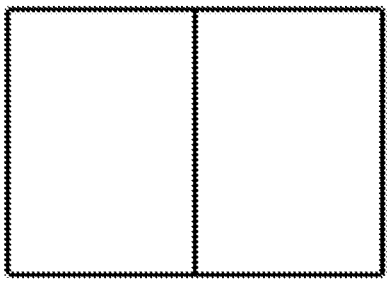
Figure 32E:
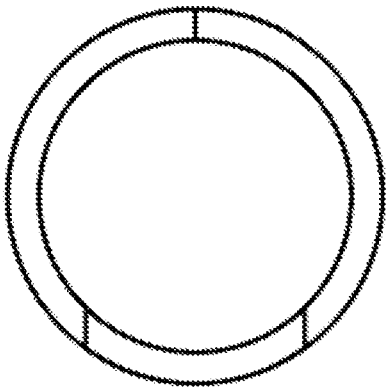
Figure 32F:
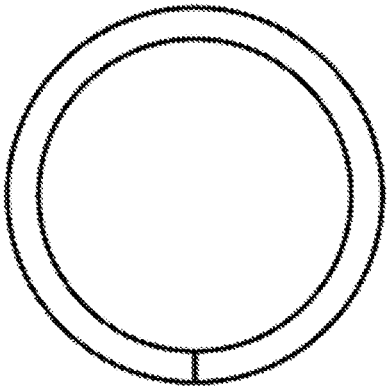
Figure 32G:
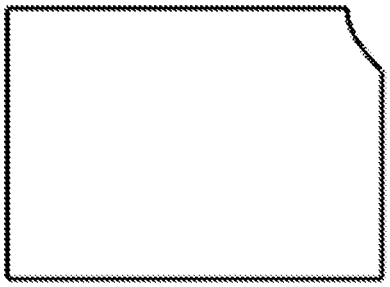
Figure 32H:
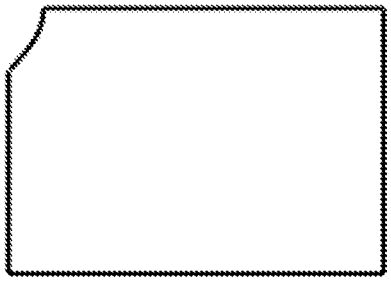

FIGS. 32A-32H show the aesthetic design of an example embodiment of a collar having a slit and a notch with FIG. 32A showing a top perspective view thereof; FIG. 32B showing a bottom perspective view thereof; FIG. 32C showing a front view thereof; FIG. 32D showing a back view thereof; FIG. 32E showing a top plan view thereof; FIG. 32F showing a bottom plan view thereof; FIG. 32G showing a left view thereof; and FIG. 32H showing a right view thereof.

Figure 33A:
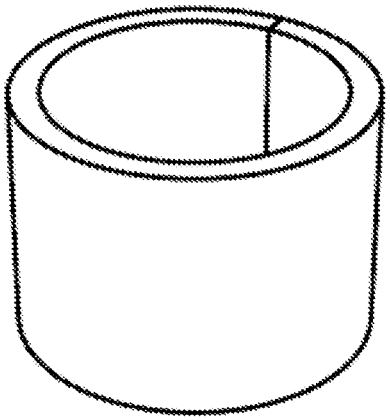
FIGS. 33A-33H show the aesthetic design of an example embodiment of a collar having a slit and a notch with FIG. 33A showing a top perspective view thereof.
Figure 33B:
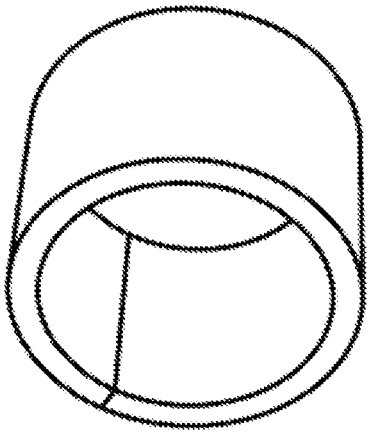
Figure 33C:
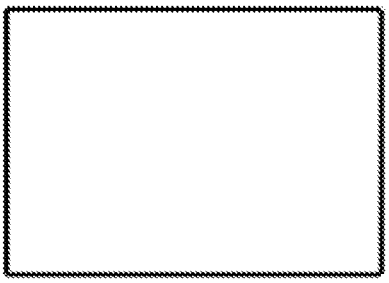
Figure 33D:
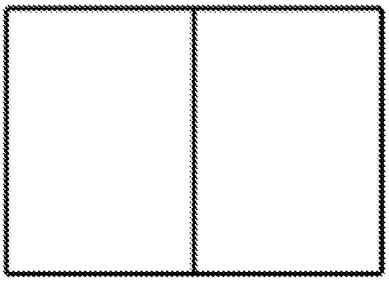
Figure 33E:
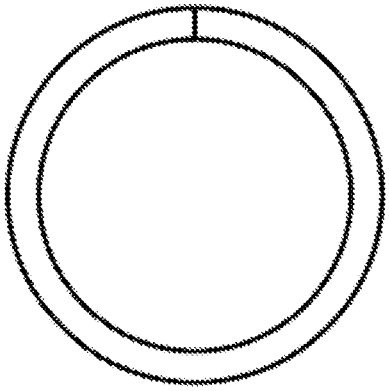
Figure 33F:
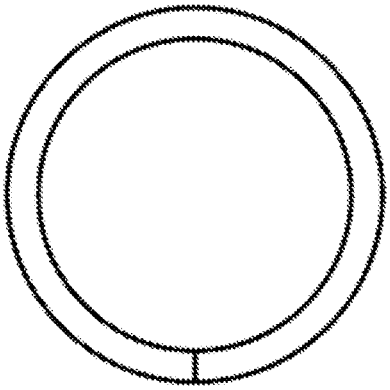
Figure 33G:
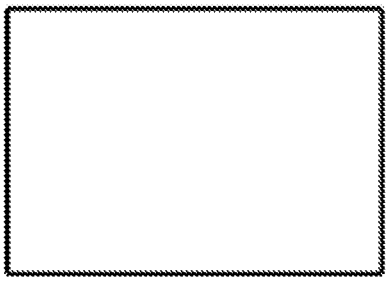
Figure 33H:
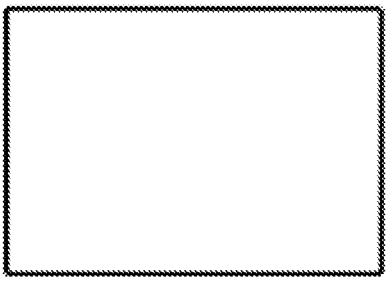

FIGS. 33A-33H show the aesthetic design of an example embodiment of a collar having a slit and a notch with FIG. 33A showing a top perspective view thereof; FIG. 33B showing a bottom perspective view thereof; FIG. 33C showing a front view thereof; FIG. 33D showing a back view thereof; FIG. 33E showing a top plan view thereof; FIG. 33F showing a bottom plan view thereof; FIG. 33G showing a left view thereof; and FIG. 33H showing a right view thereof.

FIG. 34 shows an example embodiment of a splash guard coupled to another object, here a cart, and used to deflect objects such as blocks into the cart.

It is understood that embodiments of the splash guard may be manufactured as a single item with the different elements integrated. In addition, the splash guard may be manufactured from separate elements having different material properties and these separate elements may be coupled or integrated to create the splash guard. Referring to FIG. 6A for example, and not for limitation, the collar 622 may be made from a material with elastic and frictional properties that allow it to more easily deform around and frictionally engage the faucet neck while the guard sheet 610 and edges 616 may be made from a different, more rigid material. The collar 622 and the guard sheet 610 may then be coupled or otherwise integrated to form the splash guard.

Although example embodiments of the splash guard are described herein as being frictionally engaged to the faucet neck by the surface sides of the opening, it is also understood that embodiments of the splash guard may be mounted onto the faucet neck by other methods such as but not limited to a rigid attachment by a screw, by adhesives or by supporting the guard sheet from other elements such as the base of the faucet, from the faucet base mounting plate or from the countertop.

One Example Embodiment of the Splash Guard in Operation:

For purposes of illustrating the operation of one embodiment of a splash guard, and not for limitation, the operation of a splash guard consistent with those shown in FIGS. 10A-10G will be summarized below.

Figure 11:
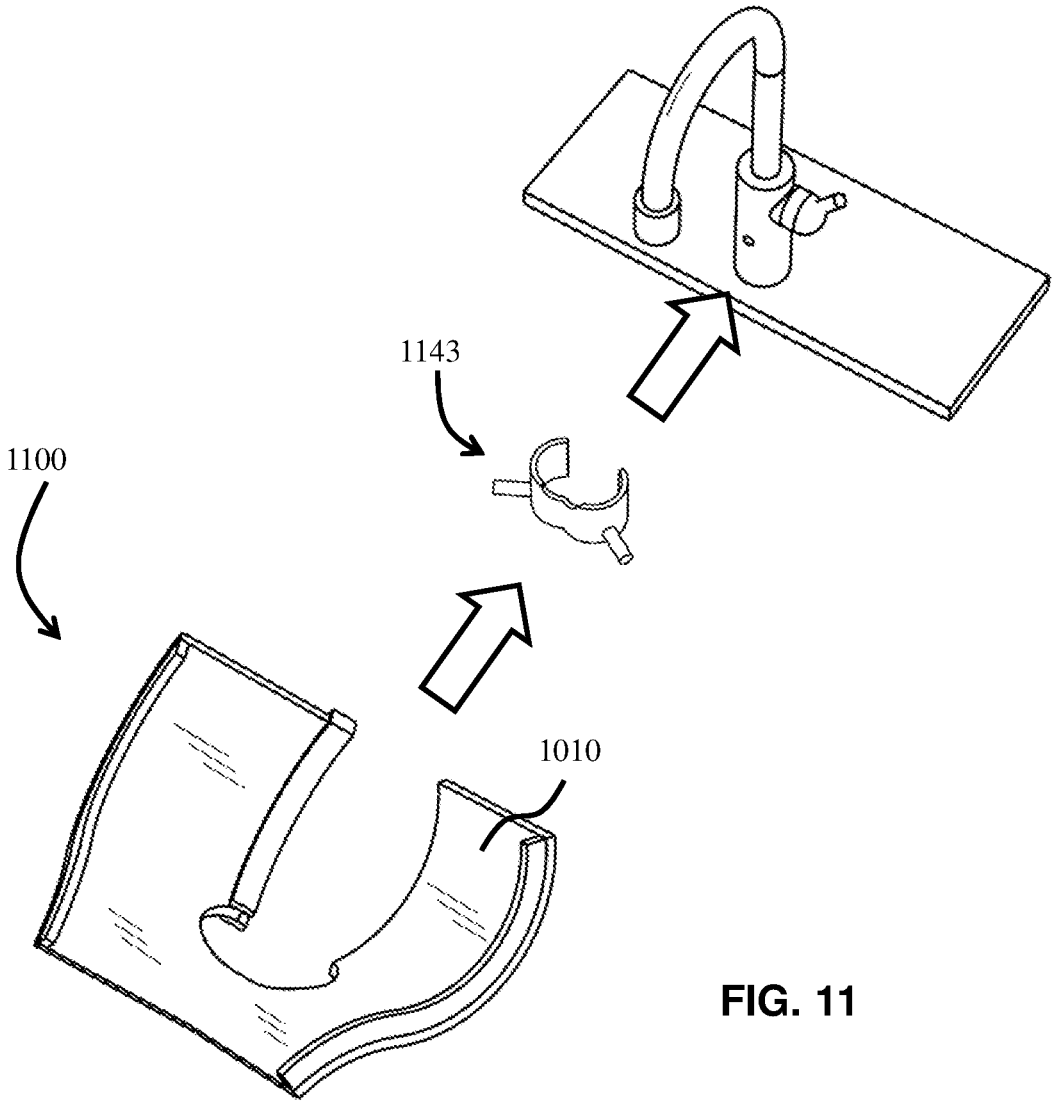
FIG. 11 shows an example embodiment of a splash guard and collar being deformed so that they can be positioned around the neck of a faucet.
Figure 12A:
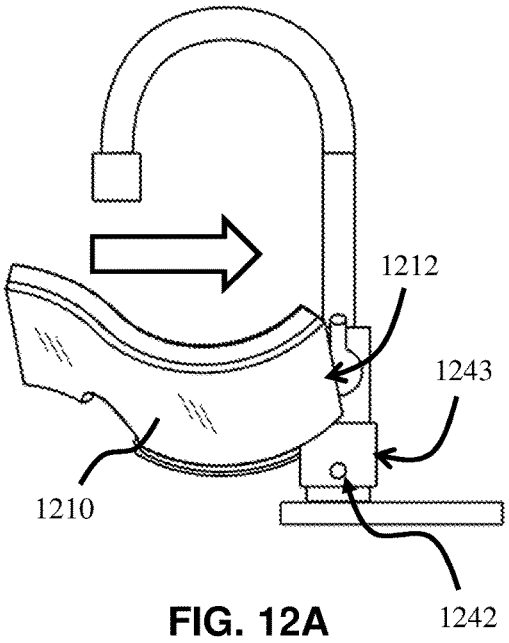
FIGS. 12A-12D show different views of an example embodiment of a splash guard being positioned around the neck of a faucet with the collar already secured to the neck.
Figure 12B:
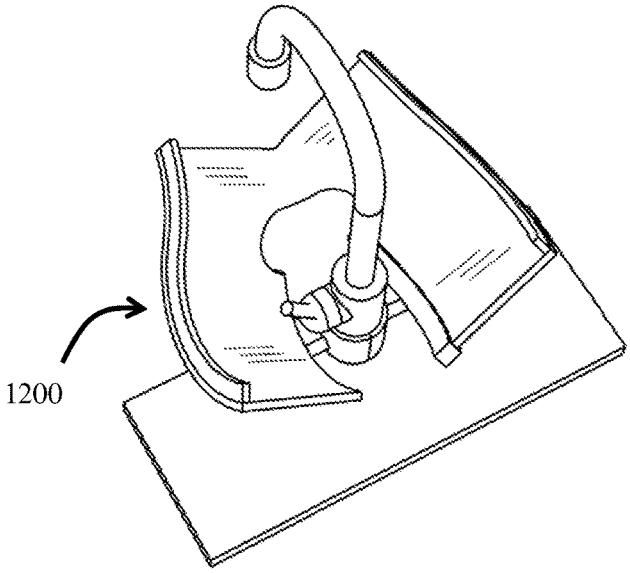
Figure 12C:
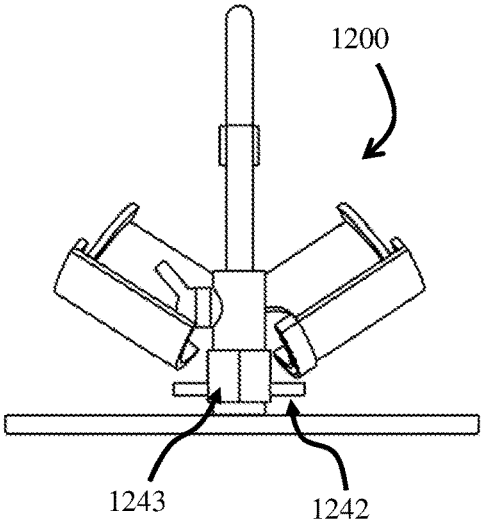
Figure 12D:
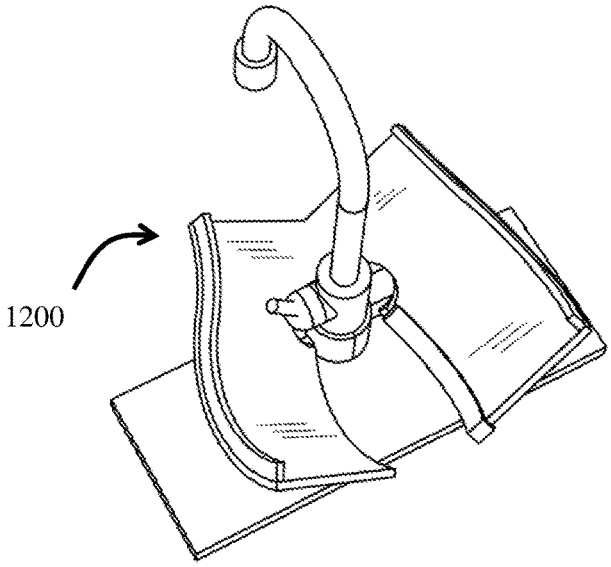

Referring to FIG. 11, operation of one example embodiment of the splash guard 1100 generally starts by deforming, bending or flexing the separate collar 1143 about its slit so that it can be opened and secured around the neck of the faucet. Then, the guard sheet 1010 is also deformed, bent or flexed to separate the sides of the splash guard slit and create the necessary opening to secure the guard sheet to the collar 1143. The opening of the collar 1143 should be configured to be large enough to accommodate the faucet neck cross-section and the opening of the guard sheet 1010 should be configured to be large enough to accommodate the faucet neck and collar 1143.

Referring to FIG. 12A-12D, with the collar around the neck of the faucet below the control handle, the upper end 1212 of the guard sheet 1210 is then positioned around the collar 1243. The slit of the guard sheet 1210 is opened by deforming the guard sheet and the splash guard 1200 is slid horizontally toward to center of the faucet neck as shown and positioned so that the slit will be between the handle and counter top board and the collar surrounds the faucet neck. As shown, protrusions 1242 extending from the outer surface of the collar 1243 act as guide pins to guide the positioning of the guard sheet 1210 and the help support the guard sheet 1210 in operation.

Figure 13A:
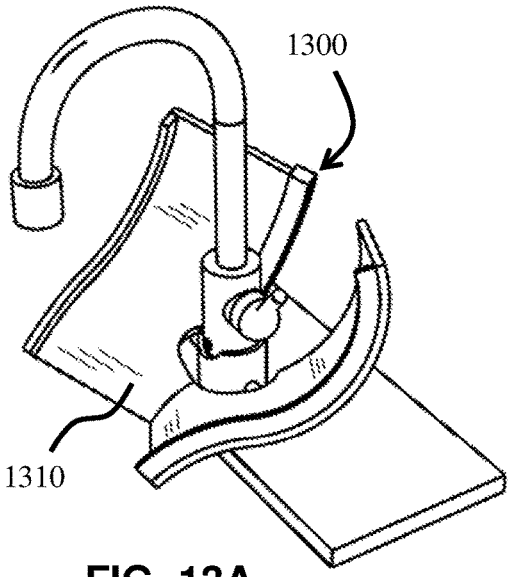
FIGS. 13A-13C show different views of an example embodiment of a splash guard being mounted on a neck of a faucet with a collar already secured to the neck.
Figure 13B:
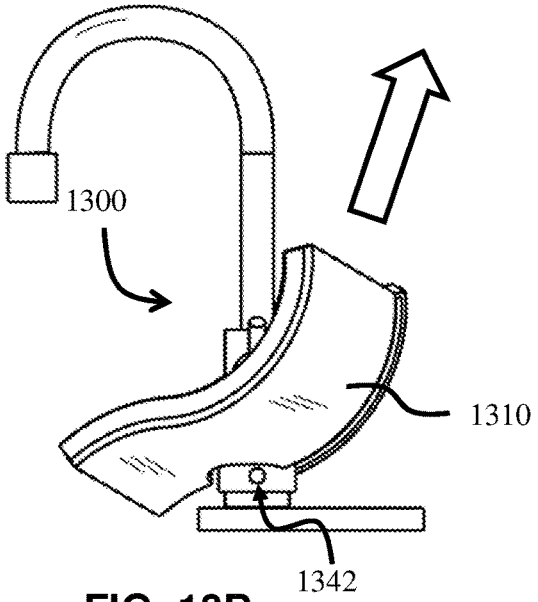
Figure 13C:
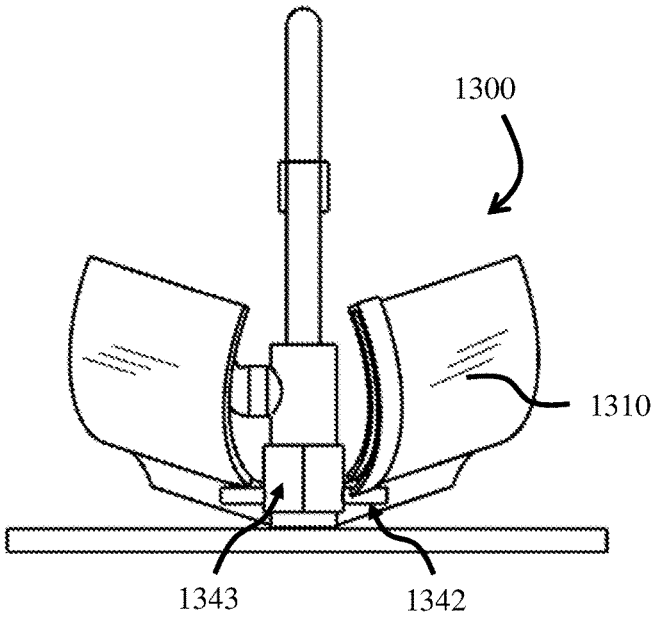

Referring to FIGS. 13A-13C, as the faucet neck is moved into the splash guard opening, the splash guard 1300 is tilted upward (see arrow in FIG. 13B) perpendicular to the countertop to align the collar so that it surrounds and frictionally engages the faucet neck. As shown, protrusions 1342, such as guide pins, extending from the collar 1343, help position the guard sheet 1310 and support it in operation.

Figure 14A:
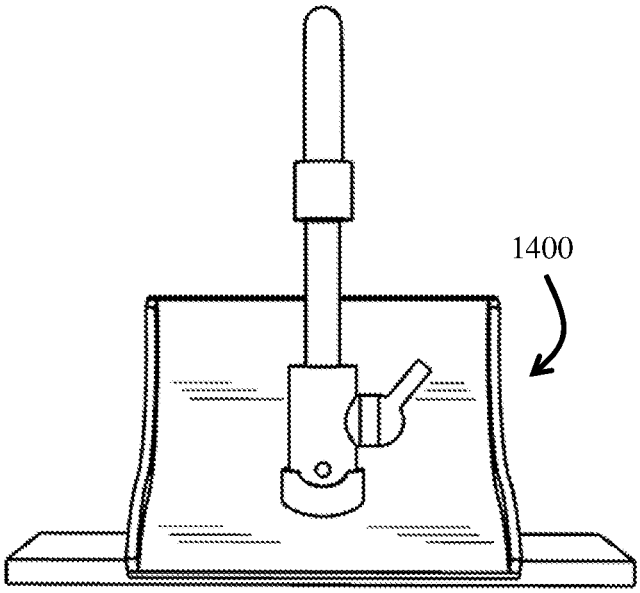
FIGS. 14A and 14B show different views of an example embodiment of a splash guard after being mounted on a faucet.
Figure 14B:
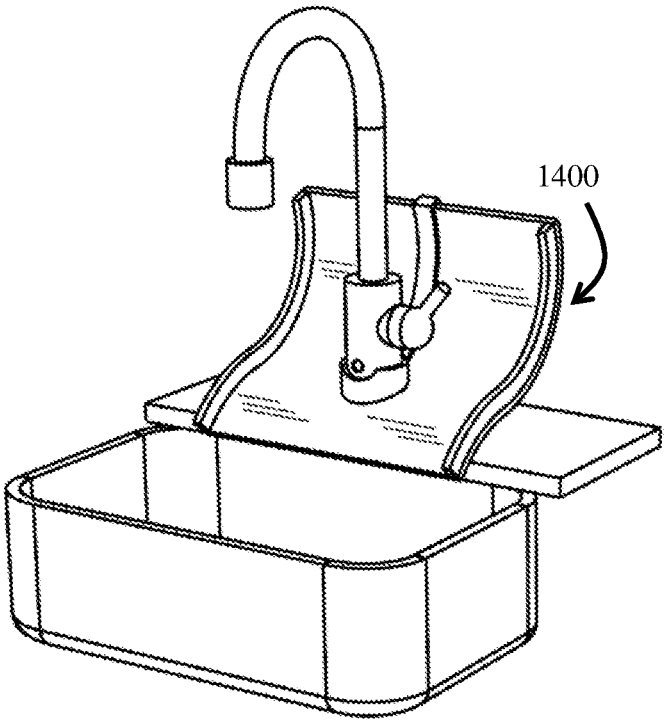

Referring to FIGS. 14A-14B, once the opening of splash guard 1400 is around the faucet neck, the slit is allowed to elastically return back to its original shape and the splash guard should be frictionally engaged around the surface of the faucet neck. In the embodiment shown, one edge of the slit will fit into the slit channel and this will form a water-resistant or water-tight seal. The drip edge of the splash guard should be positioned over the countertop and the sink bowl so that water dripping off the drip edge will go into the sink bowl. As needed, the splash guard may be adjusted up or down. If a motion sensor is used on the faucet, the splash guard may be moved to avoid blocking the motion sensor.

In the final position on the neck of the faucet shown in FIG. 14B, water and other fluids that may drip or splash around the faucet and faucet handle will fall onto the top side surface of the guard sheet and with the downward slope of the top side surface, the drips will flow down to the drip edge of the guard and into the sink bowl. The splash guard will prevent these drips and splashes from ending up on the countertop and will keep the countertop dry and clean.

Figure 16A:
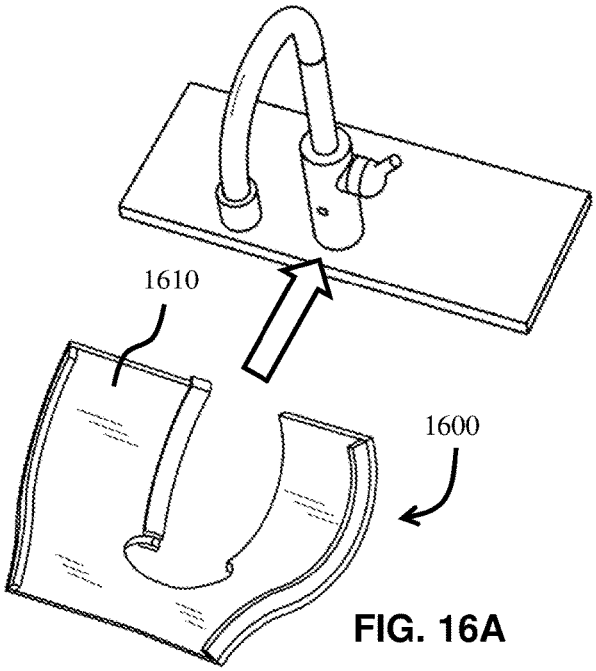
FIGS. 16A-16D show an example of installing a splash guard on the neck of the faucet with FIGS. 16A and 16B show an example embodiment of a splash guard having the slit opened to be coupled to the neck of a faucet and FIGS. 16C and 16D show the example splash guard embodiment of FIGS. 16A and 16B secured to the neck of the faucet.
Figure 16B:
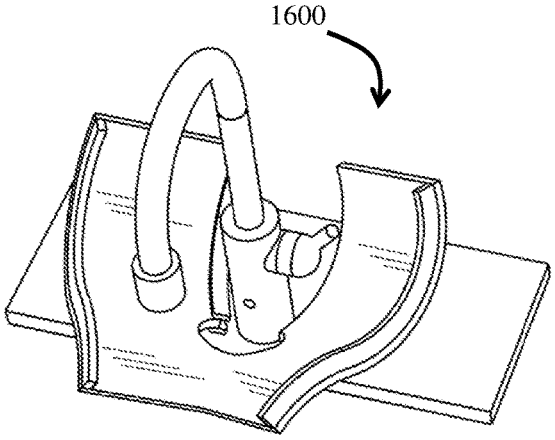
Figure 16D:
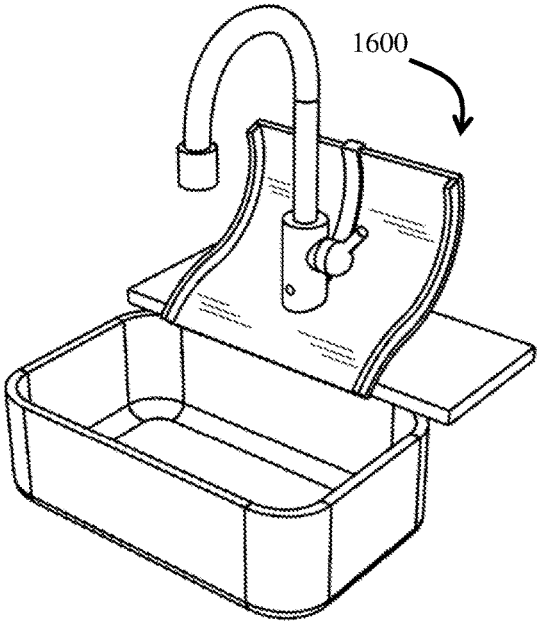
Figure 16C:
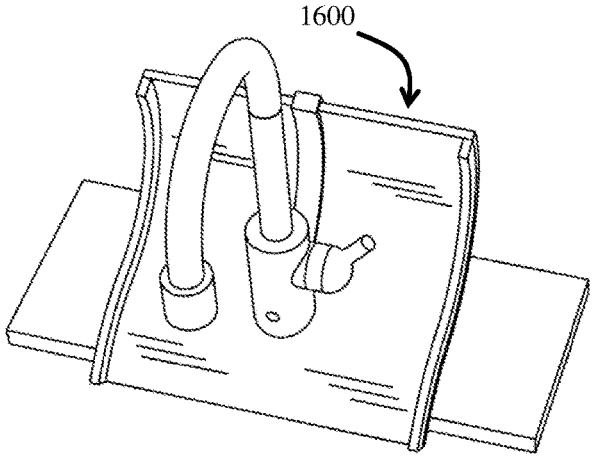

FIGS. 16A and 16B show an example embodiment of installing a splash guard without collar. As shown in FIG. 16A, the slit of the guard sheet 1610 is opened by deforming the guard sheet and the splash guard 1600 is slid horizontally toward to center of the faucet neck as shown and positioned so that the slit will be between the handle and counter top board and the collar surrounds the faucet neck. As shown in FIGS. 16D and 16C, the splash guard is frictionally secured to the neck of the faucet when the slit is closed.

Figure 35:
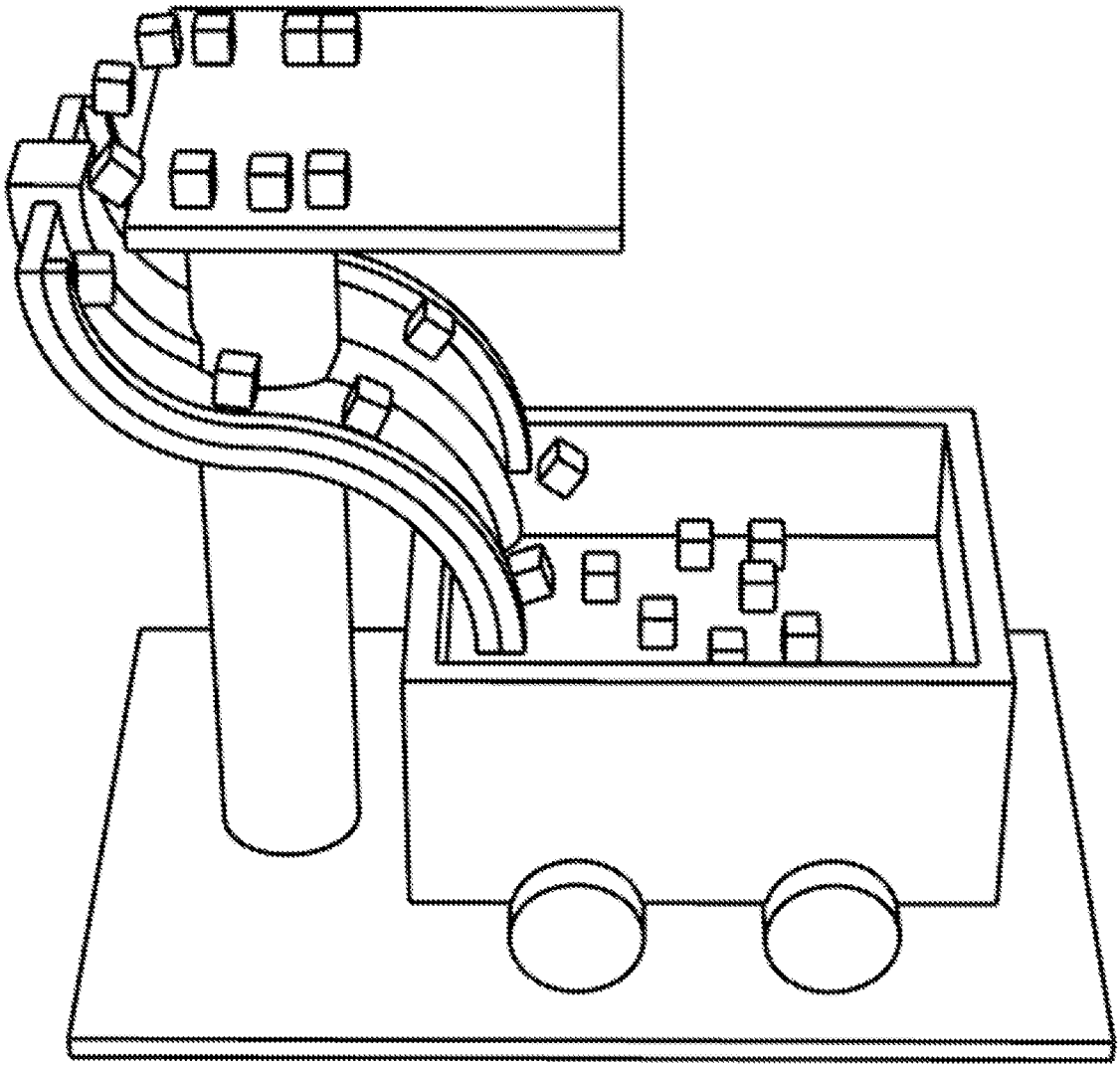
FIG. 35 shows an example embodiment of a splash guard coupled to another object, here a cart, and used to deflect objects such as blocks into the cart.

FIG. 35 shows an example embodiment of a splash guard coupled to another object, here a cart, and used to deflect objects such as blocks into the cart.

Although this invention has been described in the above forms with a certain degree of particularity, it is understood that the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention which is defined in the claims and their equivalents.

I claim:

1. A splash guard comprising:

a flexible guard sheet having an upper portion, a lower portion and a middle portion;

the middle portion having a through hole defining an opening;

the upper portion comprising a slit extending from a proximal end of the flexible guard sheet to the opening whereby the upper portion of the flexible guard sheet may be deformed to receive an object through the slit;

a flexible collar having a collar slit along a length whereby the flexible collar may be deformed to receive the object through the collar slit and frictionally couple the flexible collar to the object; and the opening configured to receive the object and the flexible collar through the slit to couple the flexible guard sheet to the flexible collar.

2. The splash guard of claim 1 wherein:

the lower portion further comprises a ridge extending from a distal end of the lower portion to the opening; and the ridge defining a raised portion on a top side surface of the flexible guard sheet whereby a fluid retained on the top side surface of the flexible guard sheet will be urged to flow away from the ridge by a force of gravity.

3. The splash guard of claim 2 wherein a cross-sectional profile of the ridge consists of one cross-sectional profile selected from the group of:

an arcuate profile;

a rectangular profile; and a v-shaped profile.

4. The splash guard of claim 2 wherein:

the slit comprises a through-seam extending from the top side surface of the flexible guard sheet to a bottom side surface of the flexible guard sheet; and a raised edge extends over the slit on the top side surface of the flexible guard sheet whereby a fluid retained on the top side surface of the flexible guard sheet will be urged to flow away from the slit by a force of gravity.

5. The splash guard of claim 4 wherein the raised edge forms a slit channel to receive one edge of the slit and make a water-resistant seal with the slit.

6. The splash guard of claim 5 further comprising a raised edge on one or more edges of the flexible guard sheet whereby a fluid retained on the top side surface of the flexible guard sheet will be urged to be retained on the top side surface by the force of gravity.

7. The splash guard of claim 6 wherein the opening further comprises a raised edge forming a collar extending on the top side surface of the flexible guard sheet whereby a fluid retained on the top side surface of the flexible guard sheet will be urged away from the object by the force of gravity.

8. The splash guard of claim 7 wherein the collar further comprises a notch whereby a sensor on the object will not be covered by the collar when the splash guard is secured to the object.

9. The splash guard of claim 8 wherein:

the object is a neck of a faucet;

the opening frictionally secures the flexible guard sheet to the neck; and the sensor is a motion sensor on the neck.

10. The splash guard of claim 1 wherein:

the flexible collar further comprises one or more protrusions extending from a surface of the flexible collar whereby the one or more protrusions engage a bottom side surface of the flexible guard sheet and support the flexible guard sheet on the object; and the length of the flexible collar configured to define a raised edge on a top end of the flexible collar extending beyond a top side surface of the flexible guard sheet whereby a fluid retained on the top side surface of the flexible guard sheet will be urged away from the object by a force of gravity.

11. The splash guard of claim 10 wherein:

the lower portion further comprises a ridge extending from a distal end of the lower portion to the opening; and the ridge defining a raised portion in a top side surface of the flexible guard sheet whereby a fluid retained on the top side surface of the flexible guard sheet will be urged to flow away from the ridge by a force of gravity.

12. The splash guard of claim 11 wherein a cross-sectional profile of the ridge consists of one cross-sectional profile selected from the group of:

an arcuate profile;

a rectangular profile; and a v-shaped profile.

13. The splash guard of claim 11 wherein:

the slit comprises a through-seam extending from the top side surface of the flexible guard sheet to the bottom side surface of the flexible guard sheet; and a raised edge extends over the slit on the top side surface of the flexible guard sheet whereby a fluid retained on the top side surface of the flexible guard sheet will be urged to flow away from the slit by a force of gravity.

14. A splash guard for use around a neck of a faucet, the splash guard comprising:

a flexible guard sheet;

the flexible guard sheet comprising an elastic material;

the flexible guard sheet having a substantially planar shape with a substantially even thickness and an undulating side profile;

the flexible guard sheet having an upper portion, a lower portion and a middle portion;

the upper portion having a slit through the thickness of the flexible guard sheet and extending from an upper end of the flexible guard sheet to an opening whereby the upper portion of the flexible guard sheet may be deformed to receive the neck through the slit;

the middle portion having a through hole defining the opening to receive and frictionally engage the neck when positioned in the opening;

a collar;

an elastically deformable section of the flexible guard sheet whereby:

the slit may be expanded to allow the neck to pass through the slit and engage the opening, the elastically deformable section of the flexible guard sheet urges the slit to close, and the elastically deformable section urges the opening to frictional engage the neck and secure the flexible guard sheet to the neck.

15. The splash guard of claim 14 wherein:

the lower portion further comprises a ridge extending from a distal end of the lower portion to the opening;

the ridge defining a raised portion in a top side surface of the flexible guard sheet whereby a fluid retained on the top side surface of the flexible guard sheet will be urged to flow away from the ridge by a force of gravity; and the ridge further defining the elastically deformable section of the flexible guard sheet.

16. The splash guard of claim 15 wherein a cross-sectional profile of the ridge consists of one of the group selected from:

an arcuate profile;

a rectangular profile; and a v-shaped profile.

17. The splash guard of claim 15 further comprising one or more raised edge forming a slit channel to receive one edge of the slit and make a water-resistant seal with the slit.

18. The splash guard of claim 15 further comprising a raised edge on one or more edges of the flexible guard sheet whereby a fluid retained on the top side surface of the flexible guard sheet will be urged to be retained on the top side surface by a force of gravity.

19. The splash guard of claim 15 wherein the undulating side profile is a single-curve "J" shaped side profile.

20. The splash guard of claim 15 wherein a drip end edge of the flexible guard sheet further comprises a notch.

* * * * *